US006205960B1

(12) United States Patent
Vallejos

(10) Patent No.: US 6,205,960 B1
(45) **Date of Patent: *Mar. 27, 2001**

(54) ROTARY AND RECIPROCATING INTERNAL COMBUSTION ENGINE AND COMPRESSOR

(76) Inventor: Tony Vallejos, 1109 E. Hastings Rd., Spokane, WA (US) 99218

( * ) Notice: Subject to any disclaimer, the term of this patent is extended or adjusted under 35 U.S.C. 154(b) by 0 days.

This patent is subject to a terminal disclaimer.

(21) Appl. No.: 09/253,811

(22) Filed: Feb. 18, 1999

Related U.S. Application Data

(63) Continuation of application No. 08/848,536, filed on Apr. 28, 1997, now Pat. No. 5,875,744.

(51) Int. Cl.[7] ..... F02B 57/00

(52) U.S. Cl. ..... 123/44 R; 123/190.4; 123/190.17; 32/58; 417/273

(58) Field of Search ..... 123/80 R, 80 BA, 123/190.1, 190.17, 190.4, 44 R; 91/491; 92/58; 417/273

(56) References Cited

U.S. PATENT DOCUMENTS

| | | | | |
|---|---|---|---|---|
| 2,683,422 | | 6/1954 | Richards, Jr. . | |
| 3,192,914 | * | 7/1965 | Kopczyk | 123/80 B |
| 3,200,797 | | 8/1965 | Dillenberg . | |
| 3,968,777 | | 7/1976 | Franke . | |
| 3,990,423 | | 11/1976 | Cross et al. | 123/190 |
| 4,300,487 | | 11/1981 | Triulzi . | |
| 4,331,108 | * | 5/1982 | Collins | 123/50 R |
| 4,339,988 | * | 7/1982 | Steele | 91/493 |
| 4,433,655 | * | 2/1984 | Villella | 123/196 R |
| 4,741,300 | * | 5/1988 | Benson | 123/43 R |
| 5,875,744 | * | 3/1999 | Vallejos | 123/44 R |
| 5,878,707 | * | 3/1999 | Ballard | 123/190.17 |

FOREIGN PATENT DOCUMENTS

| | | |
|---|---|---|
| 617663 | 2/1949 | (GB) . |
| 973134 | 10/1964 | (GB) . |
| WO 80/02584 | 11/1980 | (WO) . |

* cited by examiner

*Primary Examiner*—Willis R. Wolfe
*Assistant Examiner*—Hai Huynh
(74) *Attorney, Agent, or Firm*—Wells, St. John, Roberts, Gregory & Matkin, P.S.

(57) ABSTRACT

Disclosed is a self-sealing valve and cylinder configuration, an internal combustion rotary engine, or pump or compressor, with a rotating central housing which includes at least one cylinder aperture, a non-rotating timing pulley mount concentrically positioned within the central housing, a crank shaft eccentrically mounted within the central housing, a valve housing attached to the central housing and which retains a cylinder between it and the central housing, a piston within each cylinder, the piston rod is eccentrically mounted to the crank shaft, and a rotating valve within each valve housing.

28 Claims, 46 Drawing Sheets

ROTARY AND RECIPROCATING INTERNAL COMBUSTION ENGINE AND COMPRESSOR

RELATED PATENT DATA

This patent is a continuation application of U.S. application Ser. No. 08/848,536, filed Apr. 28, 1997, entitled "A Rotary & Reciprocating Internal Combustion Engine And Compressor" which refers to the first application naming Tony Vallejos as inventor and which will issue as U.S. Pat. No. 5,875,744 on Mar. 2, 1999, the disclosure of which is hereby incorporated by reference.

TECHNICAL FIELD

This invention generally pertains to an internal combustion engine for use in vehicles as well as other applications, and more particularly, this invention pertains to a rotary engine with reciprocating pistons and rotary valves therein, and a system for the self-sealing of the valve and cylinder in an engine. This invention can also be a compressor or a pump.

BACKGROUND OF THE INVENTION

For many years the predominant engine used for vehicles has been the reciprocating engine. While the concept of a rotary engine is superior to reciprocating valve engines for many reasons, there have been inherent problems with the specific applications of rotary engines which have been attempted. The major problem with prior attempts at the rotary engine have been related to the effective and reliable sealing of the cylinder where the forces from combustion eventually overcome the sealing means used.

It will be appreciated by those skilled in the art that this invention has applications not only for engines, but also for pumps and compressors, even though an engine will be referred to and used throughout this specification.

Objects of this invention are without limitation:

1. To provide an engine wherein the net effective valve opening is increased and is superior.
2. To provide an engine wherein traditional poppet valves are eliminated.
3. To provide an engine which achieves the superior rotation features of a rotary engine and thereby eliminates the acceleration, deceleration, reversal, re-acceleration, deceleration and seating that a traditional poppet valve engine continually undergoes.
4. To provide an engine which maintains a maximum orifice opening due to the rotary motion, and which consequently results in more crank degrees than in traditional poppet valve engine.
5. To provide an engine wherein the number of valves needed to achieve a certain power level is greatly minimized, and consequently, the need for valve seals, valve keepers, valve springs, buckets, valve guides and cam shafts is likewise greatly reduced or eliminated.
6. To provide an engine wherein the required overall mass of the engine is substantially reduced, as compared to a typical reciprocating engine.
7. To provide an engine wherein the vibration of the engine is greatly reduced as compared to the vibration experienced in a reciprocating engine. This reduction in vibration further results in greatly minimizing or eliminating the need for counter-weighting and balancing, and thereby maximizes the overall balance and durability of the engine.
8. To substantially increase the overall efficiency of the engine as compared to a traditional poppet valve engine.

9. To provide a more efficient combustion chamber by greatly reducing or eliminating complex shapes, by reducing crevice volumes and thereby achieving faster gas flow rates.
10. To provide an engine configuration which achieves more efficient cooling and larger flow paths by having embodiment options which may configure the cylinders and the rotary valves as thermally separate from one another.
11. To provide an engine wherein the surface-to-volume ratio is minimized, thereby minimizing emission levels and the heat transfer per cycle.
12. To provide an engine configuration wherein the flame front utilizes a substantially shorter path than in typical reciprocating engines.
13. To provide an engine wherein the need for a head gasket is eliminated, which thereby has the advantages of also eliminating the leaks, failures and large crevice volumes associated with head gaskets.
14. To provide an engine wherein the number of components or parts needed in the engine and the combustion chamber is minimized, which also has the advantage of minimizing crevice volumes.
15. To provide an engine in which the size of the cylinder head is minimized and the overall mass and volume of the engine is minimized.
16. To provide an engine which eliminates the side-to-side swing motion of the piston rod which occurs in a typical reciprocating engine, which also serves to eliminate of side loads on the piston. This invention achieves this object by utilizing a piston motion which is co-linear with the cylinder, combined with a rotation system for maintaining the piston rod and piston head properly aligned within the cylinder.
17. To provide an engine which minimizes the effective length of the exhaust path, which consequently minimizes the heat transfer within the engine.
18. To provide an engine which maximizes the air intake, which is achieved by positioning the air intake at the spin or rotational center of the engine, the engine being a centrifugal device. Therefore, higher revolutions per minute act analogously to a supercharger in increasing flow efficiency, overall engine efficiency and the miles per gallon the engine can achieve in a vehicle.
19. To provide an engine wherein the centrifugal effects of the rotary motion increases the natural flow of exhaust as the rotational motion will naturally tend to move the exhaust radially out of the combustion chamber. Achieving this objective has the further advantage of reducing the tendency to create back pressure.
20. To provide an engine wherein the need for a crank or torsion damper is eliminated, which also results from the minimal crank length utilized by this invention.
21. To provide an engine which has embodiment options which may eliminate the need to use castings to manufacture the engine, which this invention achieves due to its unique configuration and design.
22. To provide an engine which reduces emissions, which is expected to be accomplished by this invention by the reduction of valve overlap, achieving superior volumetric combustion efficiency, achieving a faster burn and by reducing crevice volumes.
23. To provide an engine which can run more efficiently than typical reciprocating engines at higher revolutions per minute. This is achieved through the improved overall engine balance of its mass, the supercharging effect of the centrifugal motion, the general engine configuration, and the reduction or elimination of the need for counters weights.

24. To provide an engine which maximizes power and torque, which is achieved through the numerous advantages and achievements stated above.
25. To provide an engine which minimizes the necessary length of the crank shaft, which in turn minimizes the flex of the crank shaft.
26. To provide an engine in which the spacing between the bearings is minimized or reduced, which provides for a more stable engine with less vibration.

BRIEF DESCRIPTION OF THE DRAWINGS

Preferred embodiments of the invention are described below with reference to the following accompanying drawings:

FIG. 4 is a top view of the embodiment of this invention illustrated in FIG. 2, with the pulley mount support removed and exposing the interior of the central housing;

FIG. 10 is an elevation view illustrating one example of how an embodiment of the invention can be configured with respect to an exhaust manifold within an engine housing, and relative to gearing leading to a drive train;

FIGS. 11 through 82, each show one stage of the cycle of the illustrated embodiment of the engine at the angles indicated below.

FIG. 11 is the starting point or baseline, the zero angle illustrative starting point for valve assembly 6, and further illustrates a spark occurring within the cylinder of valve assembly 6;

FIG. 71 is 600 degrees clockwise from FIG. 11;
FIG. 72 is 610 degrees clockwise from FIG. 11.

FIG. 75 is 640 degrees clockwise from FIG. 11;

FIG. 76 is 650 degrees clockwise from FIG. 11;

FIG. 82 is 710 degrees clockwise from FIG. 11.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Many of the fastening, connection and other means and components utilized in this invention are widely known and used in the field of the invention described, their exact nature or type is not necessary for an understanding and use of the invention by a person skilled in the art or science, and they will not therefor be discussed in significant detail.

Furthermore, the various components shown or described herein for any specific application of this invention can be varied or altered as anticipated by this invention and the practice of a specific application of any element may already be widely known or used in the art or by persons skilled in the art or science and each will not therefor be discussed in significant detail.

Applicant is only required to describe the preferred embodiment of the invention, and is not required to describe every possible embodiment or form of the invention contemplated by or within the scope of the claims.

While the invention is primarily directed to an internal combustion rotary engine, it will likewise be appreciated by those in the art that it can be utilized as a compressor or pump as well.

Figure 1:
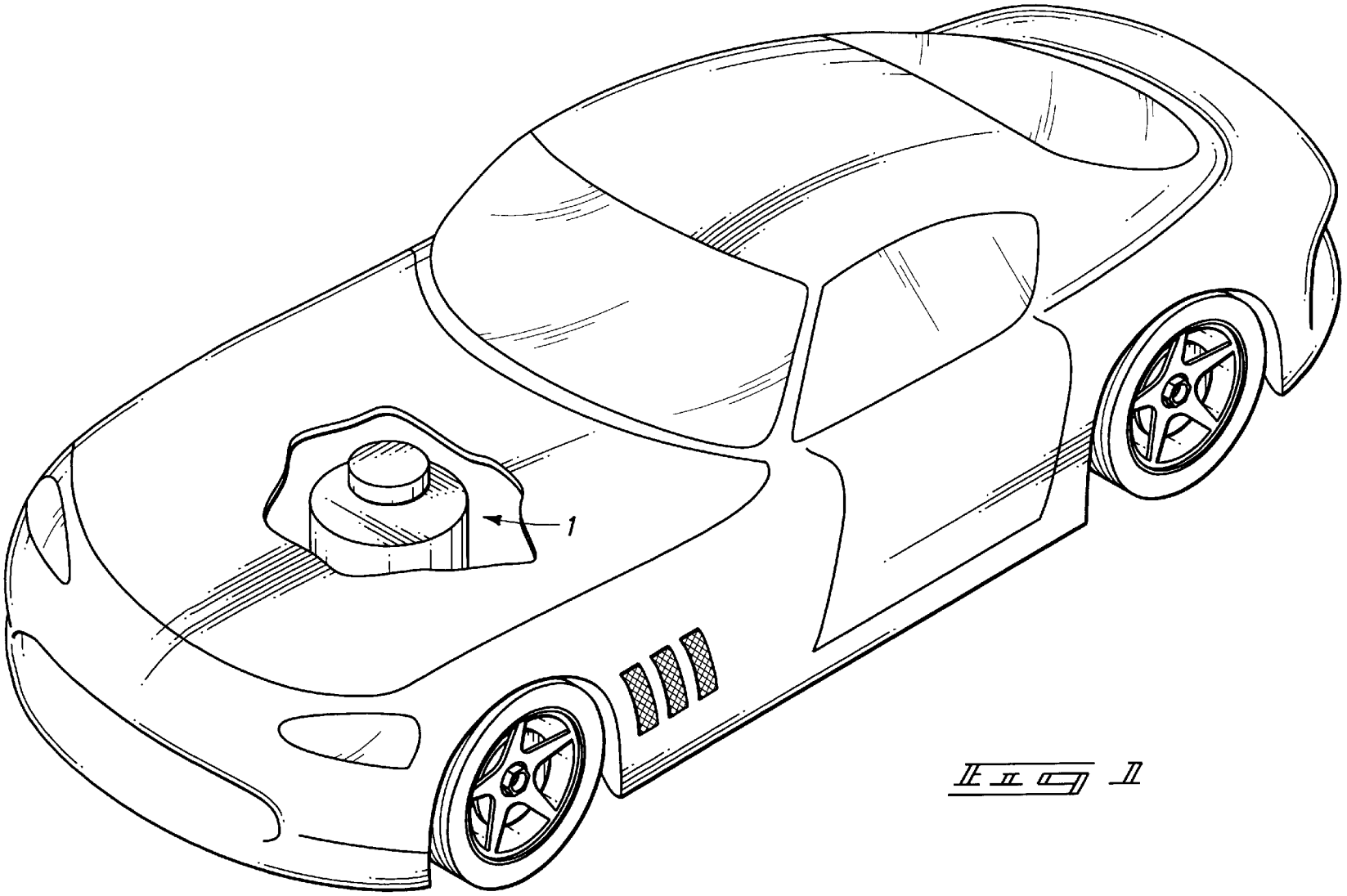
FIG. 1 is a perspective view of a vehicle, illustrating the invention contained therein.

FIG. 1 shows a vehicle with an internal combustion rotary engine 1 contained therein.

Figure 2:
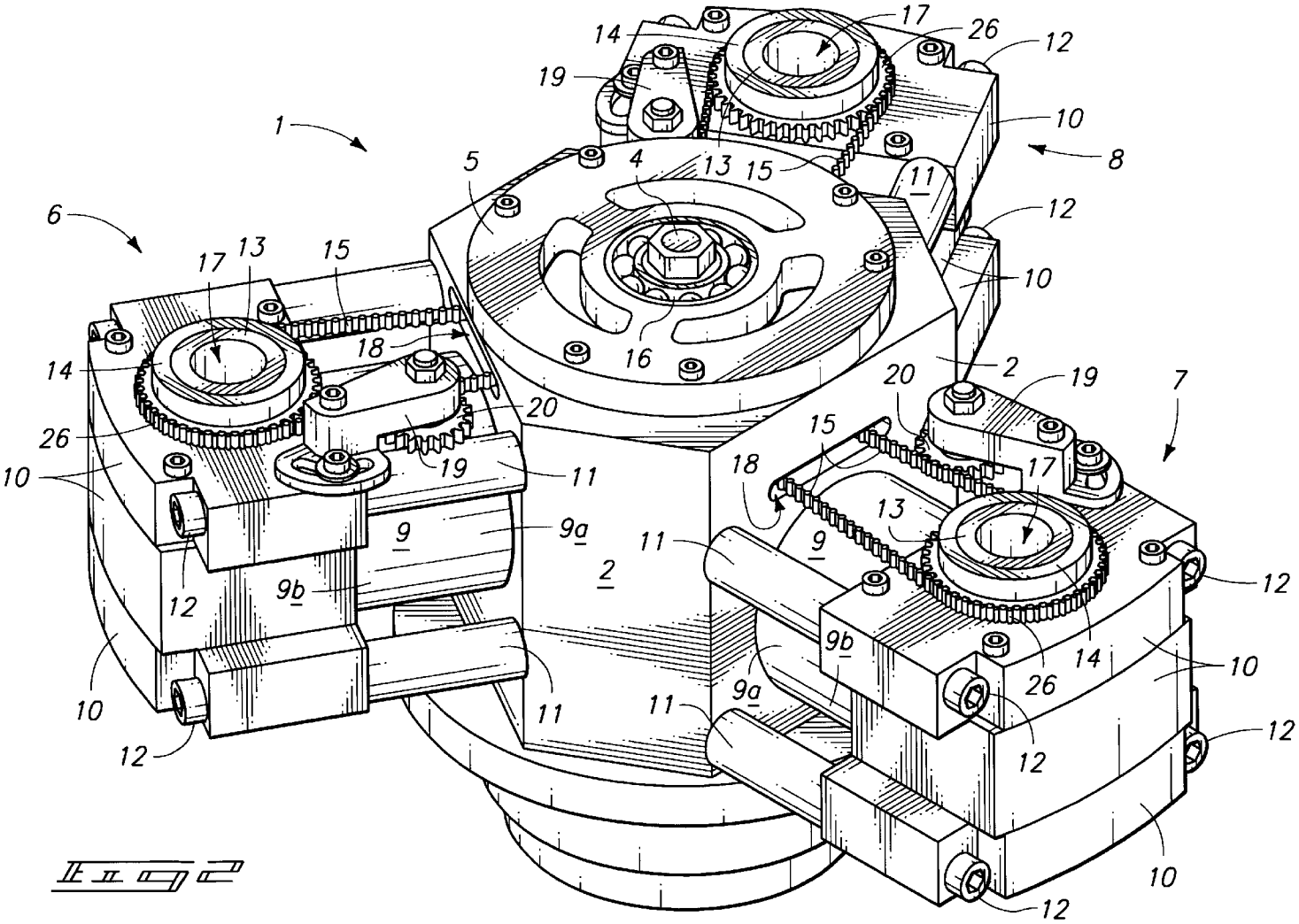
FIG. 2 is a perspective view of one embodiment of this invention, this embodiment having three cylinder assemblies.

FIG. 2 is a perspective view of one embodiment of an internal combustion rotary engine 1 contemplated by the invention, illustrating a central housing 2 is shown with three radially extending cylinder assemblies 6, 7 & 8. While the central housing 2 has similarities to what is generally referred to as a block in a reciprocating engine, it is more broadly used in this description.

Each of the three cylinder assemblies 6, 7 & 8 are similarly situated and attached to the central housing 2 in this embodiment of the invention, however, variations of individual components of the valve assemblies can be made, as contemplated by this invention.

In the cylinder assemblies 6, 7 & 8, valve housing 10 is attached or connected to central housing 2 by valve housing mount support screws 12, which pass through valve housing support mounts 11 and engage corresponding threaded apertures in the central housing 2 Although the valve housing 10 shown in FIG. 1 is comprised of three sections or pieces 10*a*, 10*b* and 10*c*, it can be constructed in any number of different forms, sections, and number of pieces including a one piece molded configuration, within the contemplation of this invention, with no one in particular being required to practice this invention.

One end of cylinder 9, i.e. the proximal end 9*a* of the cylinder 9, is slidably mounted within cylinder aperture in the central housing 2 and the other end, the terminal end 9*b* of the cylinder 9, is slidably mounted with respect to valve housing 10, such that cylinder 9 may have relative movement with respect to rotary valve 13, as is more fully illustrated and discussed with respect to FIGS. 6, 7, 8 & 9. It should be noted that the cylinder aperture in central housing 2, need not receive the entire cylinder 9, but instead need only facilitate the attachment of the piston 28 to the crank shaft 22.

Instead, in order to achieve the preferred means of mounting the cylinder 9, i.e. such that it can slide or move with respect to the central housing 2, it could be mounted to the central housing in other ways, such as by using mating circular grooves on the outer surface of the central housing 2 to receive the central housing end of the cylinder 9, which would also allow for its movement or sliding with respect to the rotary valve 13.

While FIG. 2 illustrates the preferred embodiment, it will also be appreciated that this invention may utilize or take advantage of the slight relative movement between the terminal end 9*b* of the cylinder 9 and the rotary valve 13 to achieve the desired seal effects. Therefore, while it is preferred that the cylinder 9 be slidably mounted to the central housing 2 in some way, it is not necessary to practice this invention, so long as the terminal end 9*b* of the cylinder 9 is mounted such that the terminal wall 67 of the cylinder 9 may slide or move with respect to the rotary valve 13.

The forenamed alternative may be accomplished for instance by fixing the cylinder 9 to the central housing 2 (or even making it as one piece with the cylinder 9) and then making the terminal wall 67 of the cylinder 9 a separate piece from the remainder of the cylinder 9, with the terminal end 9*b* of the cylinder 9 being movable by the combustion, towards the rotary valve 13.

Therefore when the term "mounted" is used with respect to the cylinder 9 being mounted on to the central housing 2, the term includes mounted such that it can move with respect to the central housing 2, and/or mounted firmly or securely to the central housing 2, or it even may be constructed as one piece with the central housing 2.

It should further be noted that while the valve housing 10 is described as being attached to the central housing 2, and while it is preferred to fix the valve housing 10 relative to the central housing 2, this is not required by this invention. This invention also contemplates that there may be some movement between the valve housing 10 and the central housing 2. Therefore when the term "attached" is used with respect to the valve housing 10 being attached to the central housing 2, it is deemed and used as including, but broader than fixed, and also contemplates movement between the two components. The important feature is that there be potential relative movement between the terminal wall 67 of the cylinder 9 and the rotary valve 13, or even with respect to the valve housing 10.

Rotary valve 13 is rotatably mounted within valve housing 10 such that it rotates relative to and within valve housing 10. Although a rotary valve 13 is shown, other types of valves may be used in combination with this invention, both known and to later be discovered or developed. FIG. 2 further illustrates that rotary valve 13 has intake port 17 for receiving a mixture of air and fuel, which is then routed through the appropriate ports for combustion in the combustion chamber.

Although the preferred embodiment contemplates the use of one rotary valve 13 which includes both a valve intake port 50 and a valve exhaust port 51, this invention is not limited to one rotary valve 13 with two ports. Instead, it is within the scope of this invention that the engine may include one or more rotary valves 13 per cylinder assembly. As an example, it will be appreciated by those in the art that two rotary valves could instead be used, one which would include a valve intake port, and the other which would include a valve exhaust port.

Rotary valve sprocket 26 is mounted on rotary valve 13 by valve gear mount 14, such that when rotary valve sprocket 26 rotates, it causes rotary valve 13 to also rotate. Timing chain 15 is disposed between a timing gear 43 located within the central housing 2, and the rotary valve sprocket 26. The timing chain 15 passes through housing chain aperture 18 and interacts with rotary valve sprocket 26 to cause rotation of the rotary valve, as more fully described below.

Chain tension mechanism 19 is mounted on valve housing 10 and maintains tension on timing chain 15. Although timing chain 15 is identified as a chain, it could likewise be a belt or any other means by which rotation is transferred from rotary valve sprocket 26 to what will be shown in later drawings as timing gear 43, which is mounted on timing pulley mount 4. Chain tension sprocket 20 is attached to chain tension mechanism 19 and disposed to interact with timing chain 15 to maintain the desired tension therein. That timing pulley mount 4 is concentrically positioned within central housing 2, means that it is mounted at the approximate axis or center of rotation of the central housing 2.

For purposes of identification, three cylinder assemblies are shown, namely first cylinder assembly 6, second cylinder assembly 7 and third cylinder assembly 8. Although three cylinders are shown in this embodiment of the invention, this invention contemplates that there may be one or more cylinder assemblies utilized, depending on the application.

Mounted to central housing 2 is pulley mount support 5, which is a housing cap and which, in this embodiment of the invention, holds and positions the timing pulley mount 4 at the center axis of central housing 2. Central housing 2 rotates relative to the engine base (which is item 99 in FIG. 10), whereas timing pulley mount 4, on the other hand, does not rotate relative to the engine base 99 in this embodiment of the invention. Pulley mount support 5 supports and is rotatably mounted to timing pulley mount 4 through pulley mount bearing 16.

Figure 3:
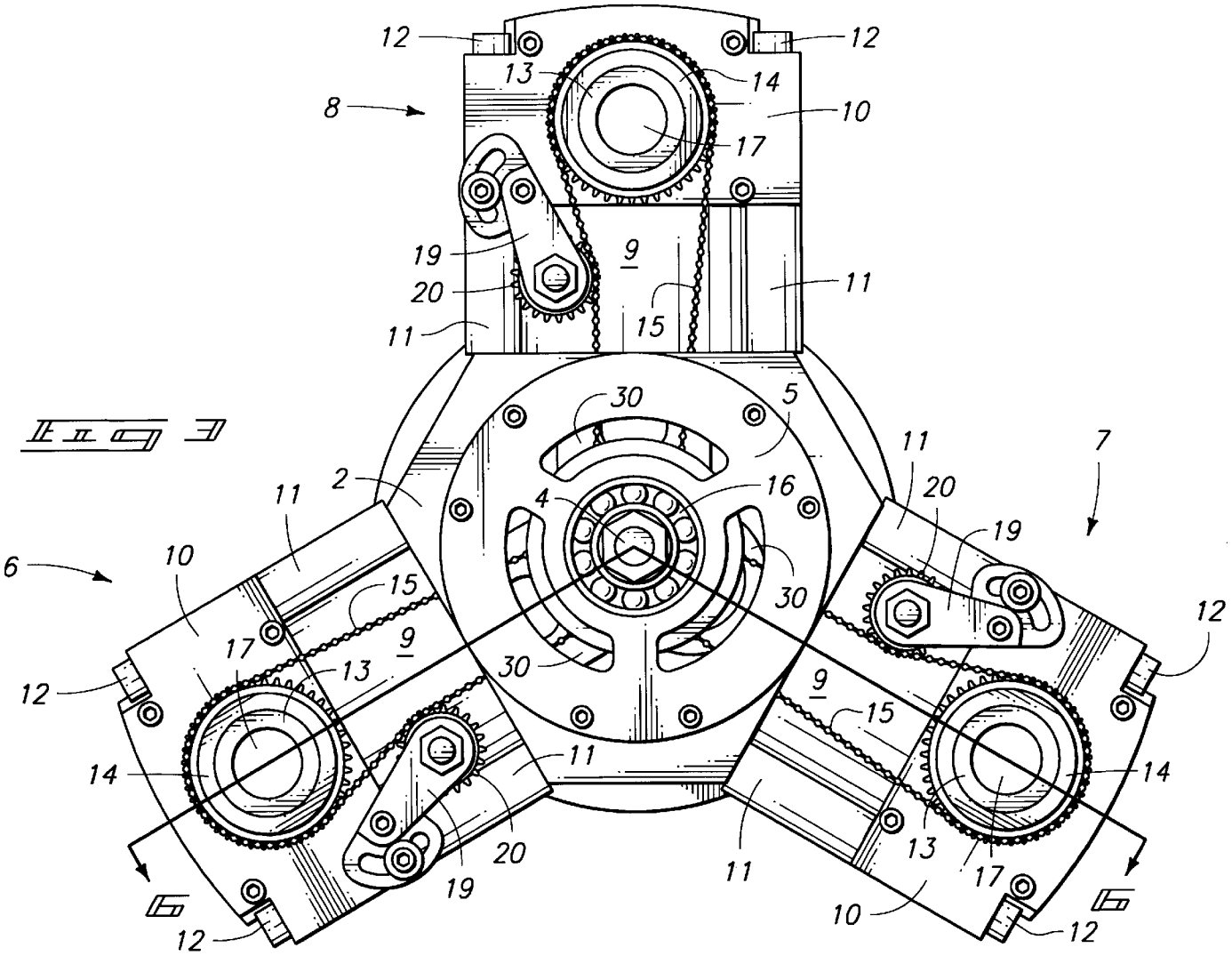
FIG. 3 is a top view of the embodiment of this invention illustrated in FIG. 2, with the pulley mount support attached to the central housing.

FIG. 3 shows a top view of the embodiment of the engine as illustrated in FIG. 2, with the same corresponding item numbers. Additionally shown through apertures or openings in pulley mount support 5, are piston rods 30, which are further illustrated and described below with respect to other figures.

FIG. 4 shows the same top view of the embodiment of the invention as shown in FIG. 3, only with the pulley mount support 5 removed. Piston rods 30 are more fully illustrated in FIG. 3, as is timing pulley mount 4.

FIG. 4 further serves to illustrate that while central housing 2 rotates about its own center axis, the axis of rotation for the crank shaft 22, which will be later illustrated and described, is shown offset from the axis or center of rotation of the central housing 2. The axis of rotation for crank shaft 22 is illustrated as item 55 in FIG. 4. FIG. 4 further shows how timing chain 15 transmits rotation between timing pulley mount 4 and rotary valve sprocket 26. Because timing pulley mount 4 does not rotate, rotary valve 13 therefore must rotate as the cylinder assemblies are rotating with the central housing 2, since rotary valve 13 is rotatably mounted within valve housing 10 and timing chain 15 engages rotary valve 13 and the non-rotating timing pulley mount 4.

As the central housing 2, and consequently the cylinder assemblies, rotate about the center axis of central housing 2, the fixed and non-rotating timing pulley mount 4, by being connected to rotary valve sprocket 26 via timing chain 15, causes rotary valve 13 to rotate. The rate of rotation of rotary valve 13 can be predetermined or pre-set by the selection of the relative sizes of rotary valve sprocket 26 and timing gears 43, as shown more fully in FIG. 6.

In this embodiment of the invention, the relative sizing of timing gears 43 to rotary valve sprocket 26 is in a ratio of one to two. This ratio causes rotary valve 13 to rotate at one-half the rotation of the rotation of central housing 2.

Figure 5:
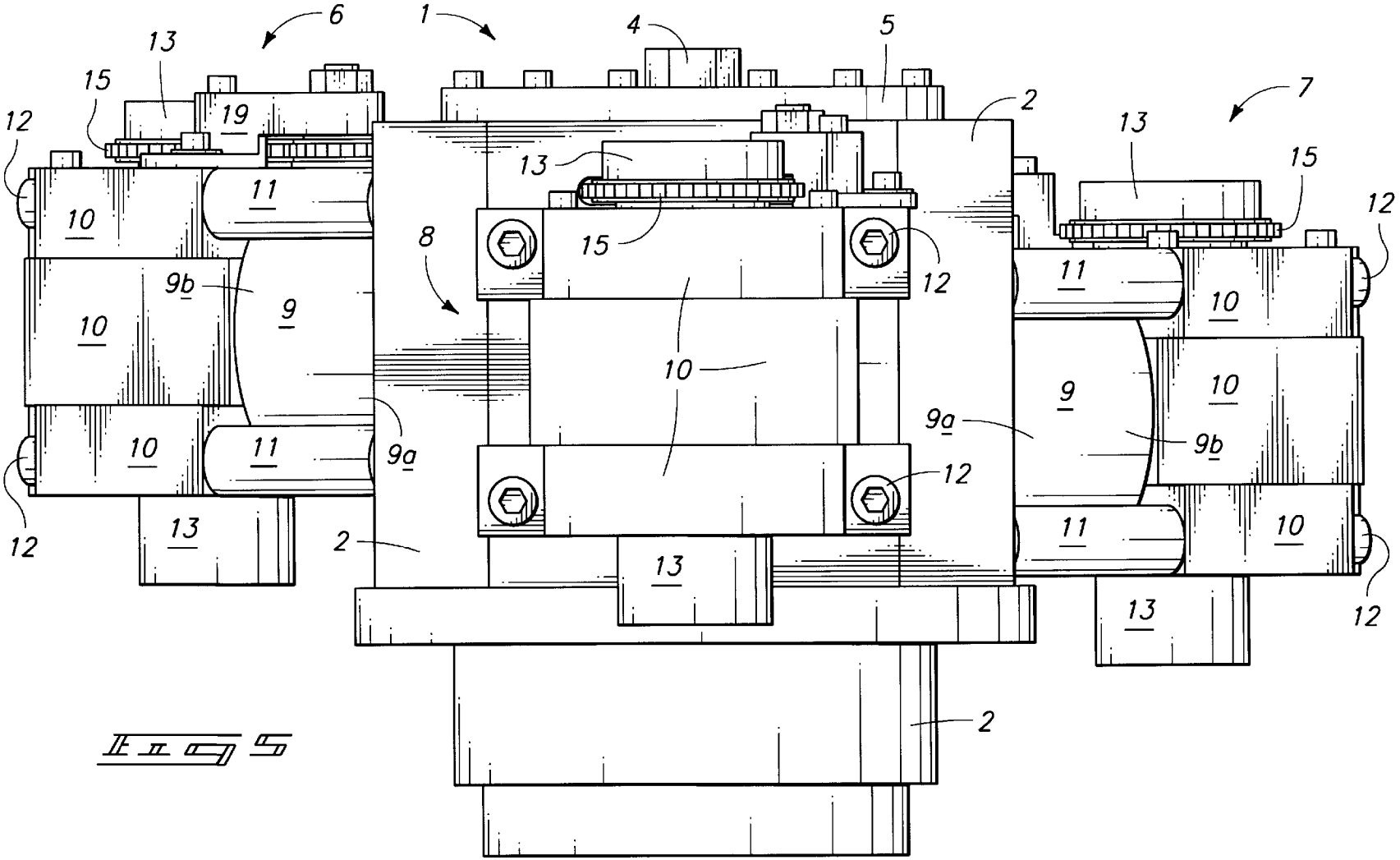
FIG. 5 is an elevation view of the embodiment of this invention illustrated in FIG. 2.

FIG. 5 is an elevation view of the embodiment of rotary engine 1 contemplated by this invention shown in FIG. 2, and utilizes the same item number references as shown in FIG. 2. FIG. 5 shows that the three valve assemblies 6, 7 & 8, are at slightly different elevations or heights with respect to one another. This relative vertical offset of the cylinder assemblies positions each cylinder assembly such that each piston rod may be appropriately mounted on the crank shaft 22 without interference from the other piston rods.

FIG. 5 also illustrates how valve housing 10 is mounted to central housing 2 with valve housing mount support screws 12. FIG. 5 further illustrates one possible configuration for mounting rotary valve 13 within valve housing 10, and illustrates how an intake port may be attached to an intake manifold on the upper side of rotary valve 13, and to an exhaust manifold on the lower side of rotary valve 13.

FIG. 5 further shows valve housing mount supports 11, timing chain 15, pulley mount support 5 and further identifies first cylinder assembly 6, second cylinder assembly 7 and third cylinder assembly 8.

Figure 6:
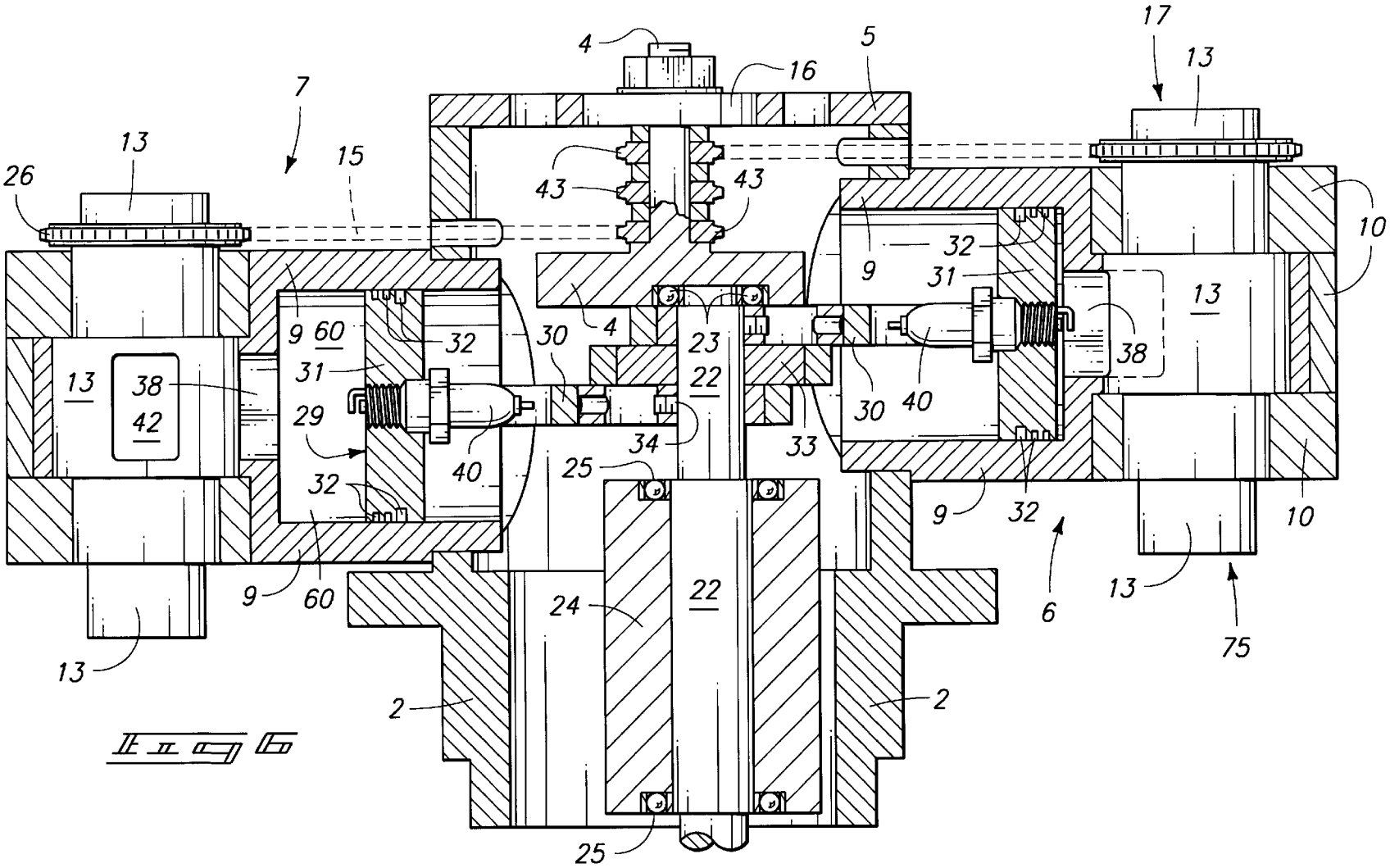
FIG. 6 is an elevation section view of the embodiment of this invention illustrated in FIG. 3.

FIG. 6 is the section as indicated from FIG. 3 and illustrates the inner workings of the embodiment of the rotary engine shown in FIG. 2. In FIG. 5, pulley mount support 5 is mounted on central housing 2, to mount and support timing pulley mount 4 at its approximate location at the central axis of central housing 2.

FIG. 6 best illustrates the relative rotations and configuration of rotary valve 13 to timing pulley mount 4 through timing chain 15 and the relationship of these components to the eccentrically mounted crank shaft 22, with crank shaft 22 being offset from the axis or center of rotation of central housing 2 (which is at the center line of timing pulley mount 4). It should further be noted that crank shaft 22 is "eccentrically" mounted or positioned within central housing 2, in that it does not have the same center of rotation or axis of rotation as central housing 2.

Timing gears 43 are provided on timing pulley mount 4, which does not rotate with central housing 2, but instead is non-rotational with respect to the engine base. One way to keep the timing pulley mount 4 from rotating with central housing 2 is illustrated in FIG. 6, which shows the eccentric mounting of crank shaft 22 in the lower section of timing pulley mount 4.

FIG. 6 shows how crank shaft 22 is eccentrically positioned and end supported by timing pulley mount 4 by the crank shaft end bearing 23 which allows crank shaft 22 to rotate about its axis of rotation while concurrently preventing timing pulley mount 4 from rotating. Crank shaft 22 is further rotatably mounted within crank shaft mount device 24 and further rotatably supported by crank shaft mount bearings 25. The crank shaft mount device 24 can be directly or indirectly mounted to the engine base.

Cylinder 9 is shown mounted between valve housing 10 and central housing 2, with rotary valve 13 being rotatably mounted within valve housing 10. Rotary valve 13 has intake port 17 and exhaust port 75 are also illustrated in FIG. 6.

FIG. 6 also illustrates piston 28 within cylinder 9, showing piston face 29, piston rod 30, which can also be referred to as a piston arm, and piston head 31. Ring groves 32 are shown in piston head 31 and can be of any type known in the industry.

FIG. 6 also shows spark plug 40 mounted on piston rod 30 such that it is in spark communication with combustion chamber 60, where it can provide spark or ignition. It is not necessary to practice this invention to mount the spark plug 40 on the piston 28, but instead the spark plug 40 can be mounted anywhere around the combustion chamber 60 such that it can perform the typical function(s) of a spark plug 40 such as being a source of ignition.

The first valve port 42 in rotary valve 13 is shown partially rotated away from the transfer port 38 at the valve housing end of cylinder 9. The central housing end of cylinder 9 is shown open to the interior of central housing 2.

Figure 7:
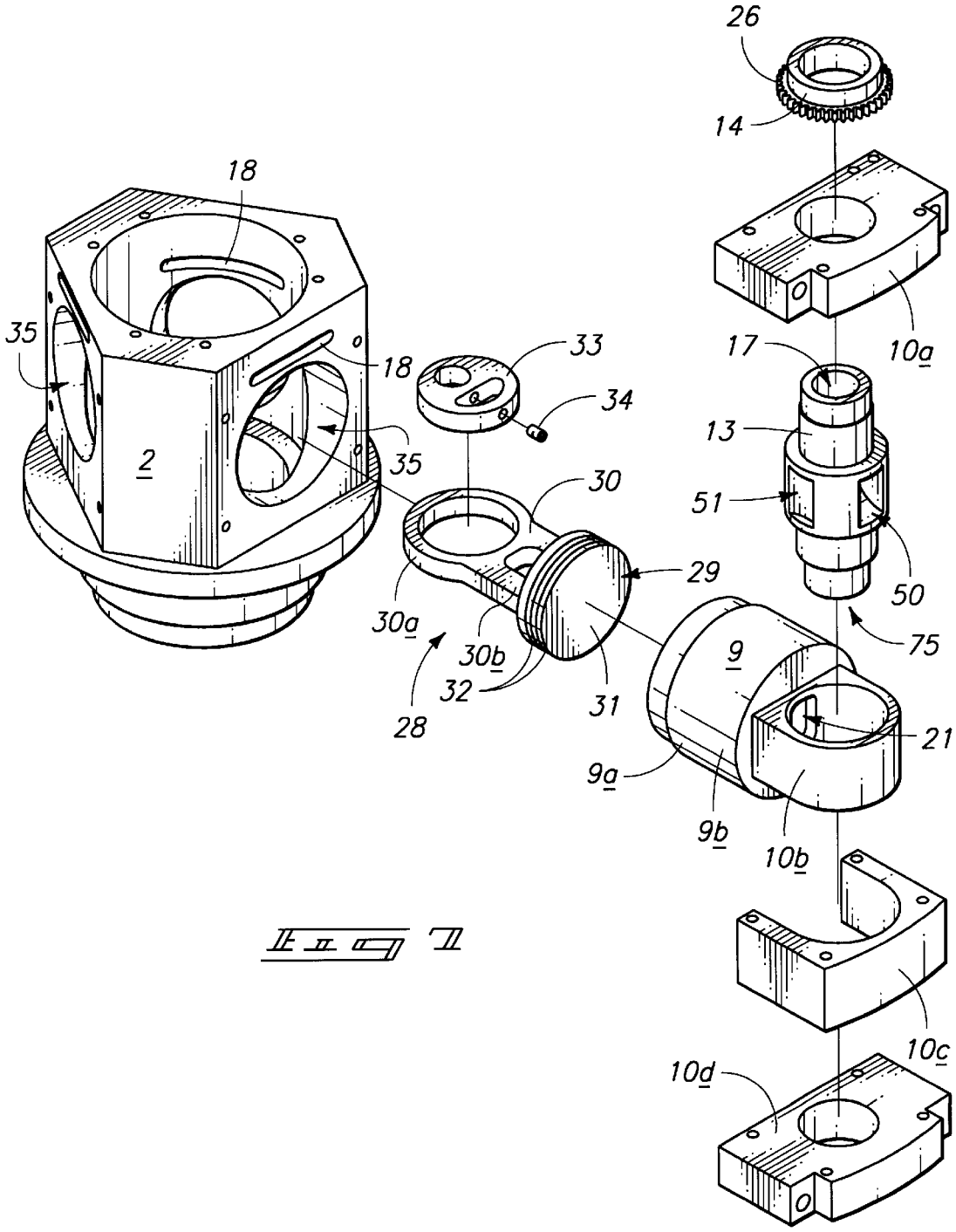
FIG. 7 is an exploded perspective view of the central housing and cylinder assembly, including the piston and cylinder, of the embodiment of this invention illustrated in FIG. 2.

FIG. 6 further illustrates how piston rods 30 are mounted to crank shaft 22 by eccentric 33 and eccentric set screw 34, all as further illustrated in FIG. 7.

This invention contemplates that there may be different ratios of rotation between rotary valve 13, central housing 2 and crank shaft 22. In the preferred embodiment of this invention, rotary valve 13 is operationally connected to the rotary valve sprocket 26 on timing pulley mount 4 such that rotary valve 13 rotates at one-half the revolutions per minute as central housing 2, as described above.

Additionally however, due to the combination of the offset of the axis of rotation of crank shaft 22 from the axis of rotation of central housing 2, and the eccentric mounting of piston rods 30 to crank shaft 22, there is a also a two to one ratio of rotation between crank shaft 22 and central housing 2. The result is that crank shaft 22 rotates at twice the speed of the central housing 2. This combination results in a one to four ratio of rotational revolutions per minute between rotary valve 13 and crank shaft 22, based on the ratios selected for this embodiment of the invention.

A sprocket or gear can therefore be mounted on central housing 2 and then connected to a gear mounted on crank shaft 22 to synchronize the relative rotation of the two, in the two to one ratio described above. The appropriate gearing can be used to achieve the synchronization, as will be further illustrated and described below with respect to FIG. 10.

It should further be noted that the crank shaft 22 in this embodiment of the invention is straight and that the movement or stroke of the piston 28 within the cylinder 9 is accomplished in part by the eccentric way of mounting the piston 28 on the crank shaft 22, combined with the fact that the crank shaft 22 is mounted offset from the center of rotation of the central housing 2. The combination provides the reciprocating movement of the piston 28 and allows the minimization of the length of the piston rod 30.

FIG. 7 is an exploded perspective view of certain components of the embodiment of the rotary engine 1 shown in FIG. 2. Central housing 2 in this embodiment contains three cylinder apertures 35 to receive cylinders 9, although only one exemplary cylinder 9 is shown in the figure.

It should also be noted that the cooler temperature of the intake gas will aid in the cooling of the cylinder 9 and piston 28, as well as other engine components.

Piston 28 includes piston rod 30 and piston head 31, which includes piston ring groves 32. The eccentric 33 and eccentric set screw 34 are shown in relation to piston 28.

The valve housing 10 components are shown, with upper valve housing 10*a,* central valve housing 10*b,* rear valve housing 10*c* and lower valve housing 10*d.* Central valve housing 10*b* is shown as one piece with cylinder 9 as an example of one way to achieve the combination making central valve housing 10*b* integral or one piece with cylinder 9. Making central valve housing 10*b* one piece with cylinder 9, although not necessary to practice the invention, eliminates the need for gaskets and thereby eliminates the problems typically associated with the use of gaskets.

FIG. 7 further illustrates how rotary valve 13 is mounted within valve housing 10 and shows valve gear 26 mounted on valve gear mount 14. The intake port 17 to rotary valve 13 and the exhaust port 75 to rotary valve 13 are also illustrated, as is timing chain aperture 18 within central housing 2.

It should be further noted that using eccentric 33 to mount piston rod 30 to crank shaft 22 not only serves to achieve the rotation ratios described above, but also serves to keep the piston 28 properly aligned within the interior chamber of cylinder 9. This maintains the relative alignment of piston rod 30 and piston head 31 within the interior of cylinder 9, and eliminates the need for relative or articulating movement between the piston rod 30 and piston head 31 in a typical reciprocating engine.

Piston rod 30 is also shown with a first end 30*a* and a second end 30*b,* the first end 30*a* for eccentric mounting on the crank shaft 22, and the second end which attaches to the piston head 31. Piston head 31 includes piston ring grooves 32 and piston face 29.

Figure 8:
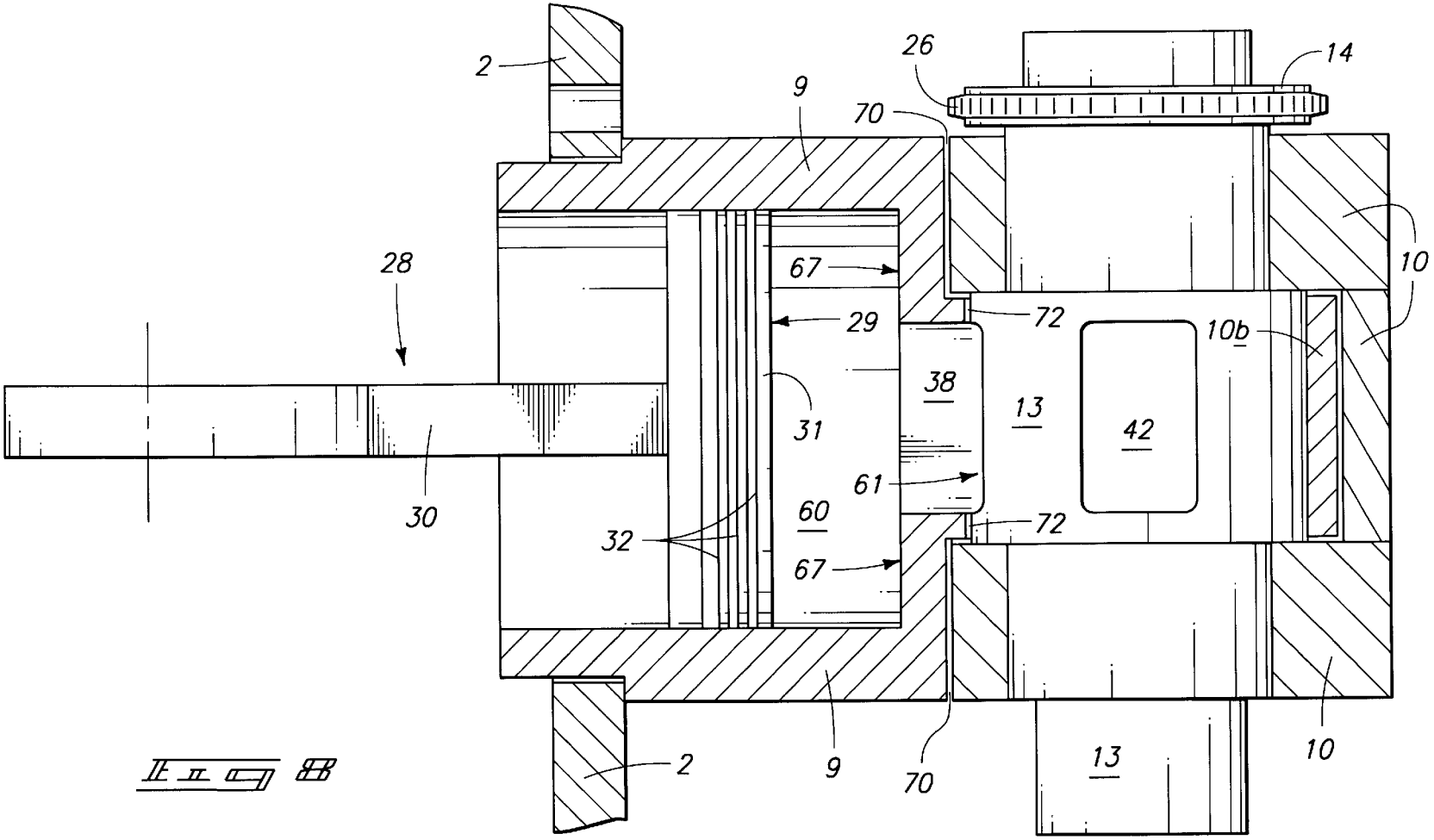
FIG. 8 is an elevation section view of the embodiment of this invention illustrated in FIGS. 2 & 3, showing one way to practice the cylinder assembly, and combined with FIG. 9, illustrates the relative movement of the cylinder with respect to the rotary valve.

FIG. 8 illustrates the relative relationship and cooperation between central housing 2, cylinder 9, valve housing 10 and rotary valve 13. Piston 28 is shown in reciprocating relation to the interior chamber of cylinder 9. Piston rod 30 is attached to piston head 31, which reciprocate longitudinally within the interior chamber of cylinder 9. The piston face 29, combined with the terminal wall 67 and side walls of the interior of cylinder 9, form combustion chamber 60. Transfer port 38 within cylinder 9 is also an area for combustion, but also serves as a transfer area or port between combustion chamber 60 and ports in rotary valve 13.

When either of the intake port or the exhaust port of rotary valve 13 are aligned with transfer port 38 of cylinder 9, a transfer of either a fuel and air mixture, or of products of combustion, may occur between the combustion chamber 60 and the exhaust port or the intake port of rotary valve 13.

FIG. 8 further illustrates a cross section view of central valve housing 10*b* with respect to valve housing 10, which shows valve gap 70 between valve housing 10 and cylinder 9, and further shows the cylinder-rotary valve clearance 72 between rotary valve 13 and cylinder 9. The valve gap 70 and cylinder-rotary valve clearance 72 illustrated in FIG. 8 are exaggerated for purposes of illustration, with the exaggeration being intended to show the movement of cylinder 9 toward rotary valve 13 that occurs during combustion within the combustion chamber 60.

When combustion occurs within combustion chamber 60, forces applied on terminal wall 67 within cylinder 9, force cylinder 9 toward 9 rotary valve 13 and thereby effectively eliminates valve gap 70 and the cylinder-rotary valve clearance 72. This uses the full forces realized from combustion to create and maintain a seal primarily between cylinder 9 and rotary valve 13, but also potentially between cylinder 9 and valve housing 10. The relative movement of the cylinder 9 as described above, will create an adequate and effective seal and thereby avoid appreciable leakage through valve gap 70 and/or cylinder-rotary valve clearance 72.

The term "gap", as used herein, is used in a broader sense than its typical definition, because in the embodiment of the invention shown in FIG. 8, there would not be a gap which is perceivable to the unaided human eye. However, the term is used to indicate that there is some relative movement of cylinder 9 with respect to the central housing 2, valve housing 10 and with respect to rotary valve 13. The effective seal between the cylinder 9 and the rotary valve 13 would be activated and/or maintained by ignition, combustion, compression and exhaust within the combustion chamber 60. Furthermore, the effective seal is aided by the centrifugal forces inherent in a rotating engine such as this, as the rotation would impart an outward force on the terminal wall 67 of the cylinder 9.

FIG. 8 further illustrates first valve port 42, which could either be an intake or an exhaust port, but it is just shown in this figure for purposes of illustration.

Figure 9:
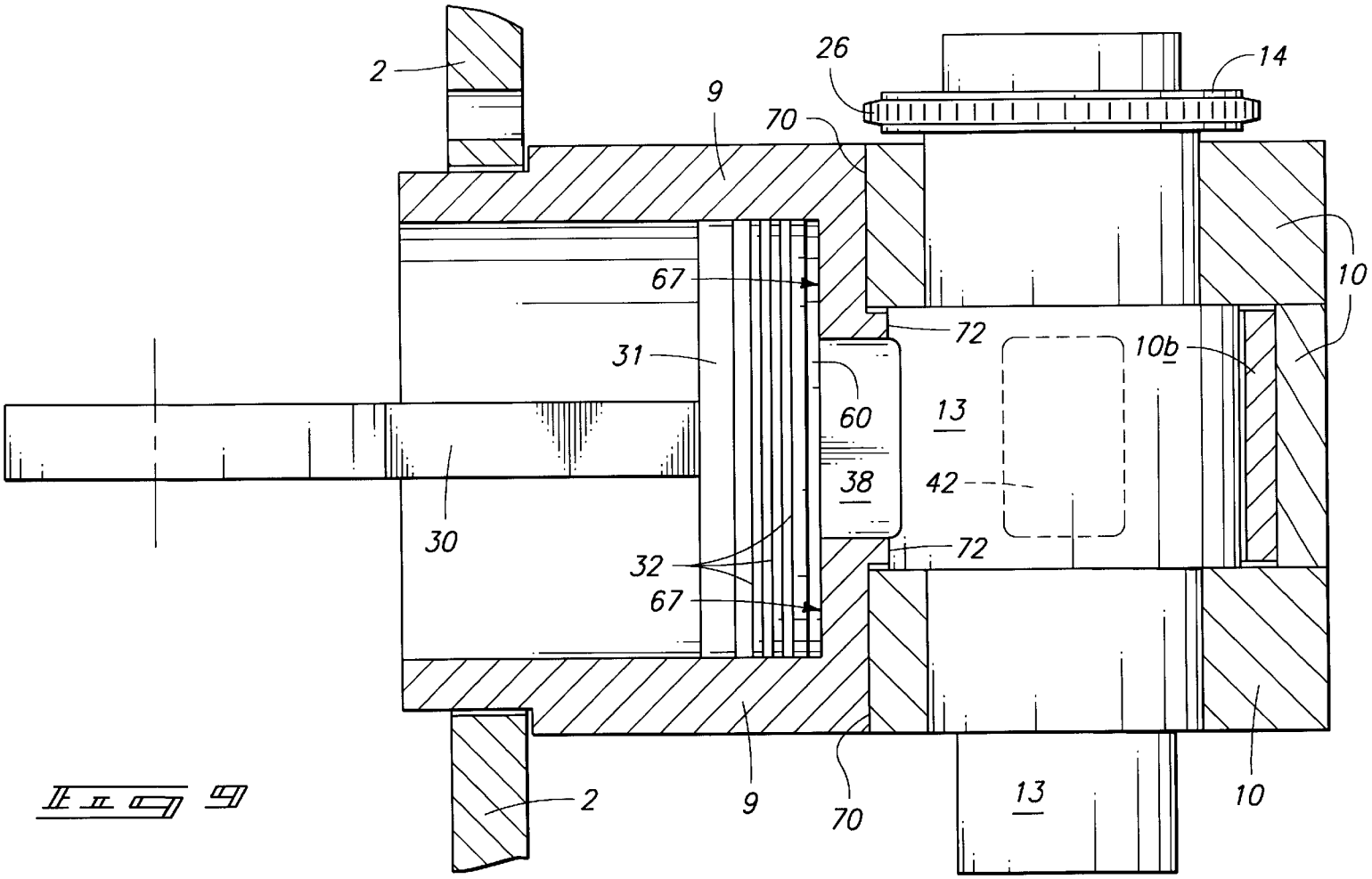
FIG. 9 is an elevation section view of the embodiment of this invention illustrated in FIGS. 2 & 3, showing one way to practice the cylinder assembly, and combined with FIG. 8, illustrates the relative movement of the cylinder with respect to the rotary valve.
Figure 11:
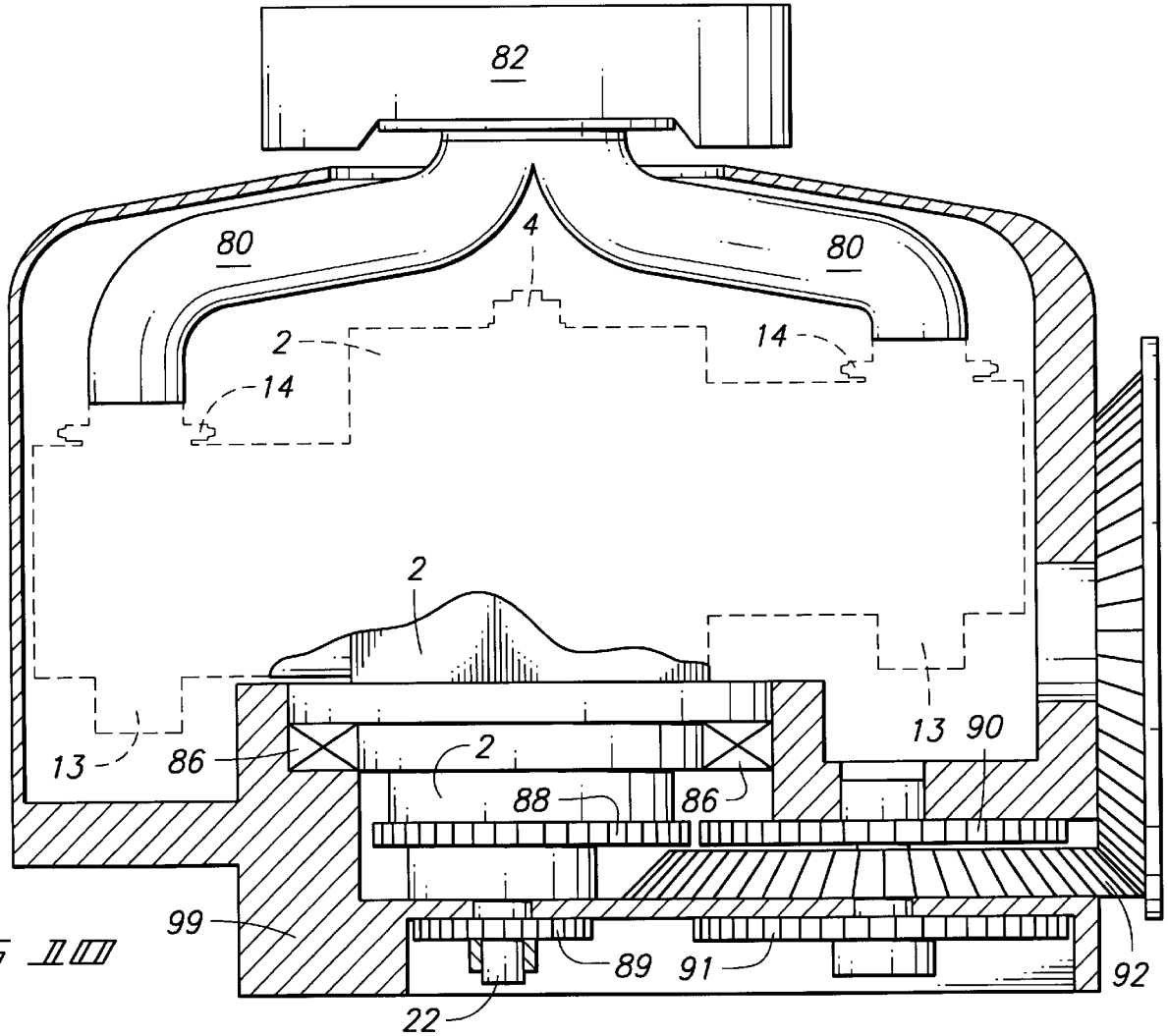
Figure 11:
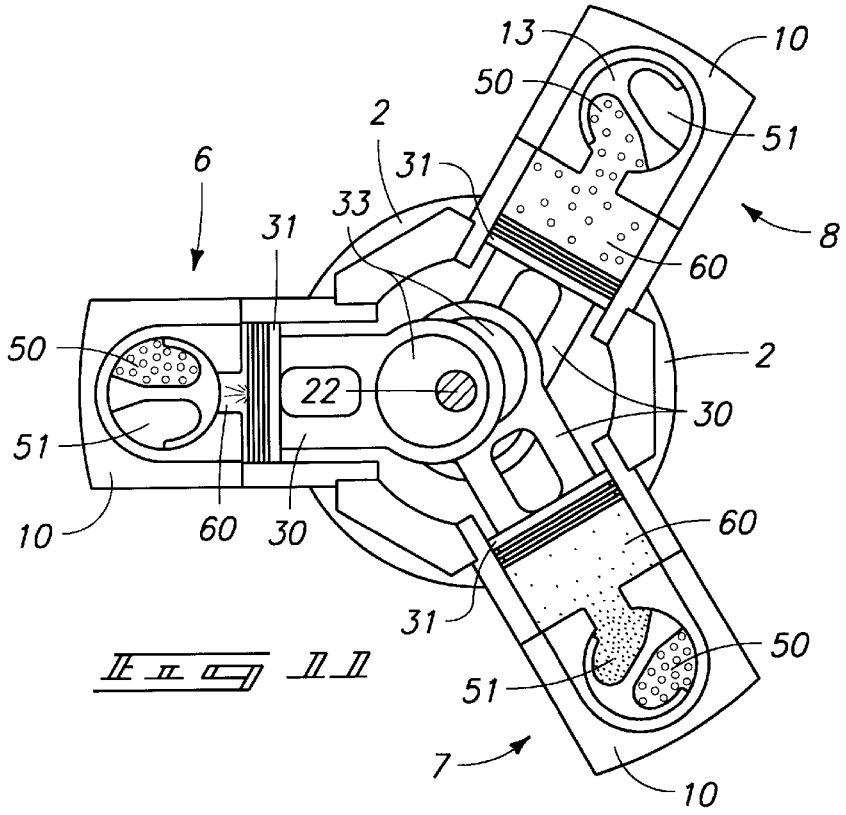

FIG. 9 is identical to FIG. 8 and serves to depict the closing of valve gap 70 and cylinder-rotary valve clearance 72, as the forces from combustion have forced cylinder 9 up against valve housing 10 and/or rotary valve 13, to effectively close the valve gap 70 and to effectively close the cylinder-rotary valve clearance 72, thereby effectively creating a self-sealing action. The self-sealing action also occurs at exhaust and compression and is aided by the outward forces inherent from the rotation of the engine and the resulting centrifugal forces created thereby.

It is anticipated that the valve cap 70 and the cylinder-rotary valve clearance 72 would only be in the magnitude of one-ten thousandths ($1/10{,}000$) of an inch to six-ten thousandths ($6/10{,}000$) of an inch. However, the invention contemplated is not limited to any particular valve gap 70 or cylinder-rotary valve clearance 72.

While FIG. 9 illustrates that both valve gap 70 and the cylinder-rotary valve clearance 72 are closed, both need not be closed or sealed to the same degree. It may be more practical from a wear standpoint to have some small space for valve gap 70 when the cylinder-rotary valve clearance 72 is in the closed position, so that as wear occurs between the cylinder 9 and the rotary valve 13 from the rotation of the rotary valve 13, the cylinder 9 can still be forced tightly into the rotary valve 13 without being impeded because the cylinder-rotary valve clearance 72 is completely closed and will not allow any further movement of cylinder 9 toward rotary valve 13.

FIG. 8 and FIG. 9 also further illustrate rotary valve sprocket 26 and valve gear mount 14.

FIG. 10 illustrates the rotary engine within an engine housing, which can also serve as the engine base 99. It should also be noted that in the pump embodiment of this invention, the engine base 99 would be called the pump base.

The engine can be rotatably mounted on the engine base 99 by engine mount bearing 86. The term engine base 99 is used very broadly herein as any structure or frame or housing upon which the central housing 2 is directly or indirectly mounted, and which the central housing 2 rotates with respect to. Therefore there may be intermediate structures between the engine base 99 and the central housing 2, i.e. an indirect mounting, within the contemplation of this invention.

FIG. 10 further illustrates intake manifold 80, and a representative fuel-air mixture device 82, which can be a fuel injector, a carburetor, or some other means to create the fuel to air mixture for intake into the rotary valve 13.

A central housing sprocket 88 is mounted on central housing 2 to provide a rotational sprocket reference for the rotation of central housing 2. Crank shaft sprocket 89 is mounted on crank shaft 22 to allow the transmission of rotation from crank shaft 22 through the drive-line of the vehicle.

The rotation of central housing 2 can be synchronized with the rotation of crank shaft 22 through the gearing arrangement shown in FIG. 10, which involves the transmission of rotation from central housing sprocket 88 to gear 90, which is attached to and rotates with gear 91. Gear 91 in turn can be rotationally attached to crank shaft sprocket 89 with a chain, belt or other means.

Output sprocket 92 is rotatably attached to both gear 91 and gear 92 and therefore directly connect it rotationally to the central housing 2 and crank shaft 22. Output sprocket 92 can then be interconnected with numerous other combinations of gears to provide rotational power output to transmit rotation to the drive train of the vehicle.

Figure 11:
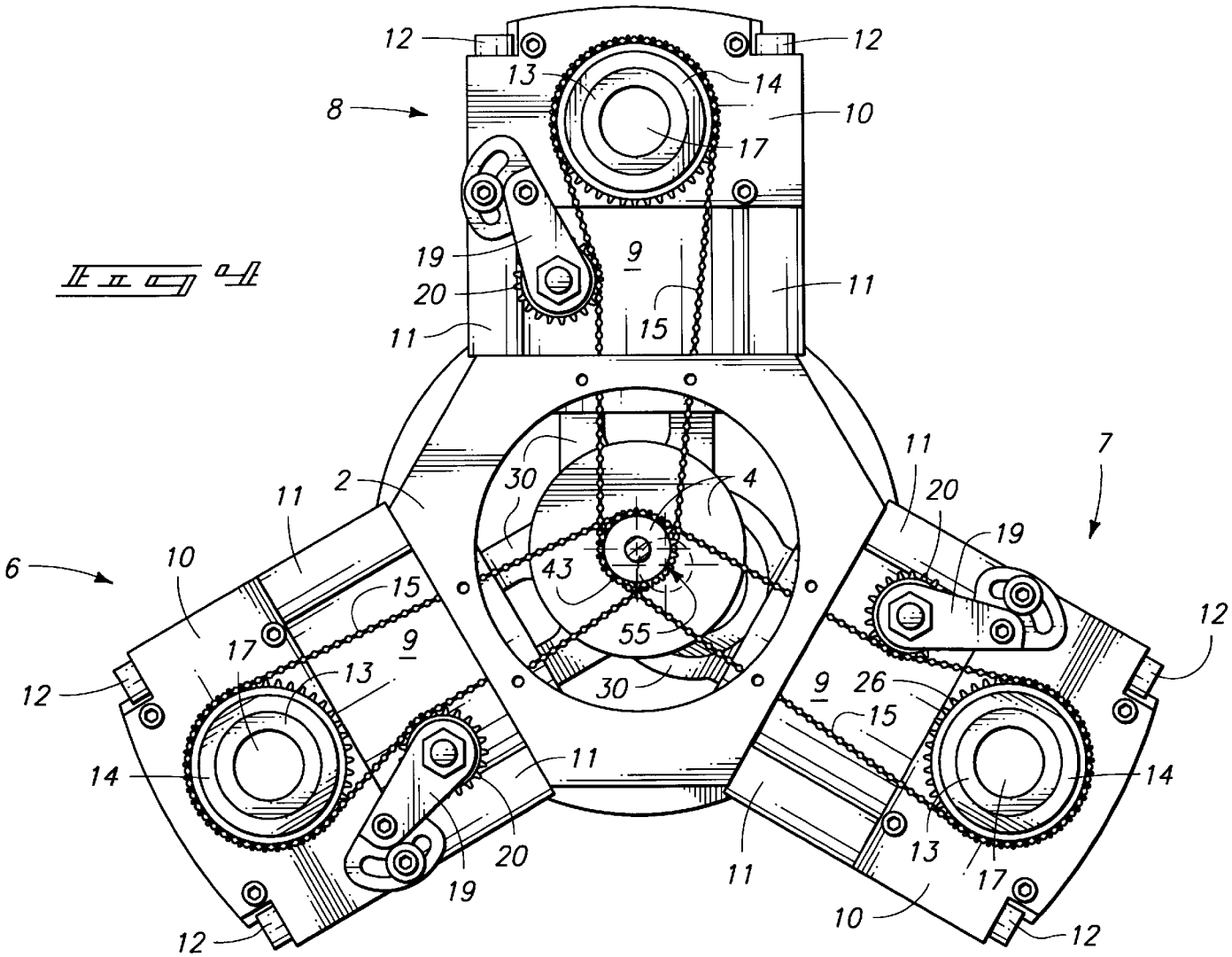
FIGS. 11 through 82 show a top schematic view illustration of the various stages of the cycle of the illustrated embodiment of the invention.
Figure 82:
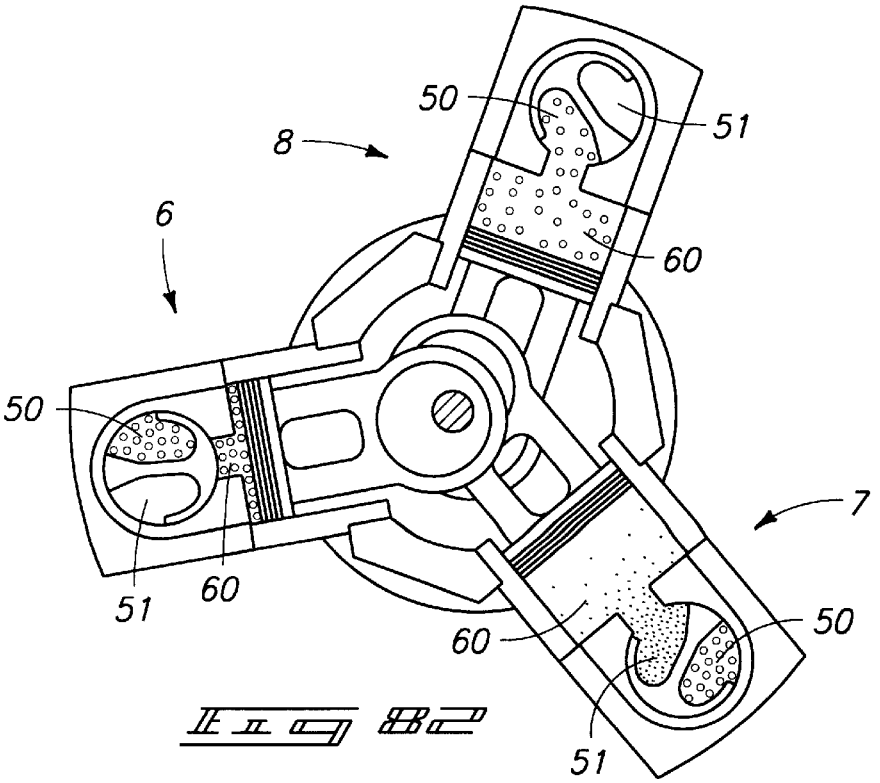

FIGS. 11 through 82 illustrate the complete cycling of the internal combustion rotary engine or compressor or pump as contemplated by this embodiment of the invention. For purposes of identification and tracking of the sequence, numerals have been used to identify the various cylinder assemblies, namely the first cylinder assembly 6, the second cylinder assembly 7 and the third cylinder assembly 8.

The schematic depictions in FIGS. 11 through 82 illustrate valve housing 10, central housing 2, piston rod 30, piston head 31, eccentric 33, crank shaft 22 and combustion chamber 60.

The sequence related items will show spark or ignition within the combustion chamber or transfer port and will illustrate the valve intake port 50 and the valve exhaust port 51. Small circles have been used to designate a fuel and air mixture to be used for combustion and will be within valve intake port 50. Conversely, small dots have been used to illustrate products of combustion and exhaust related to the valve exhaust port 51. Although there is a transfer port 38 in cylinder 9, for purposes of discussion of this sequence and for identification, the transfer port and combustion chamber have been combined and will be referred to or illustrated as item 60.

The combustion and cycle sequence illustrated in FIGS. 11 through 82 are shown at ten degree increments in the rotational cycle. FIG. 11 illustrates the starting point wherein first cylinder assembly 6 is in the horizontal configuration or starting point and third cylinder assembly 8 is approximately 120 degrees clockwise from first cylinder assembly 6. FIG. 11 illustrates a spark occurring within the first cylinder assembly 6. Second cylinder assembly 7 is approximately 240 degrees clockwise from first cylinder assembly 6, in all the figures illustrating the sequence, as more fully shown in FIGS. 11 through 82.

Figure 12:
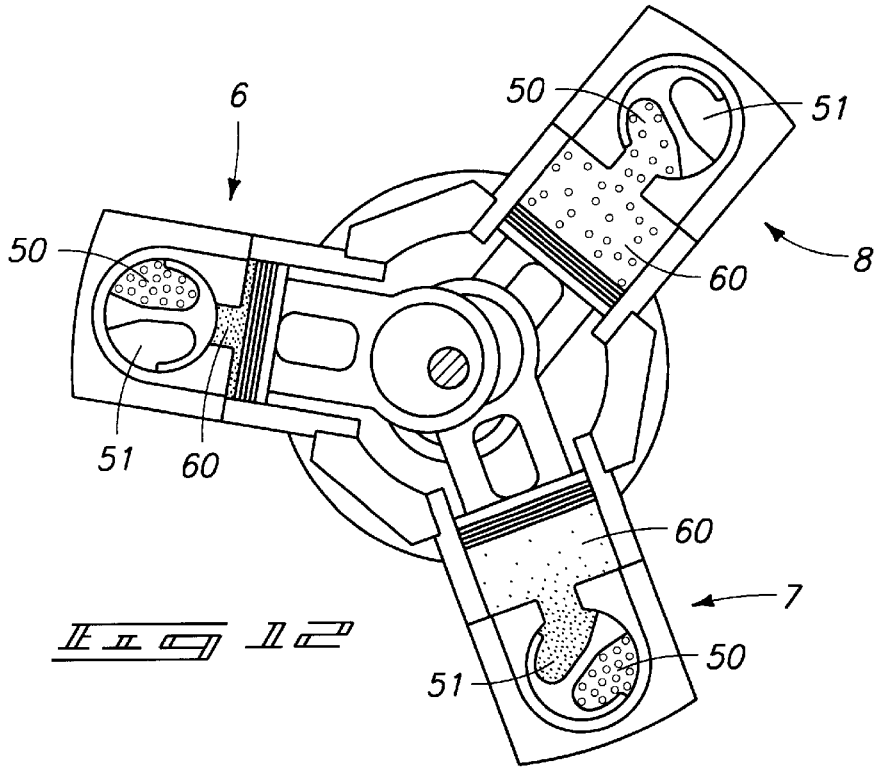
FIG. 12 is 10 degrees clockwise from FIG. 11.
Figure 13:
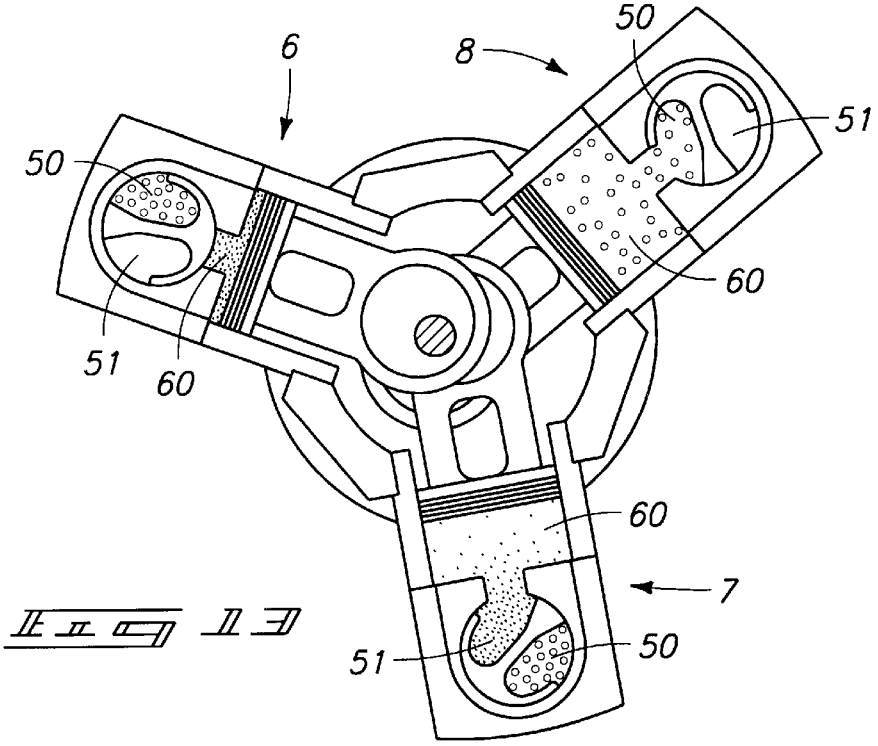
FIG. 13 is 20 degrees clockwise from FIG. 11.
Figure 14:
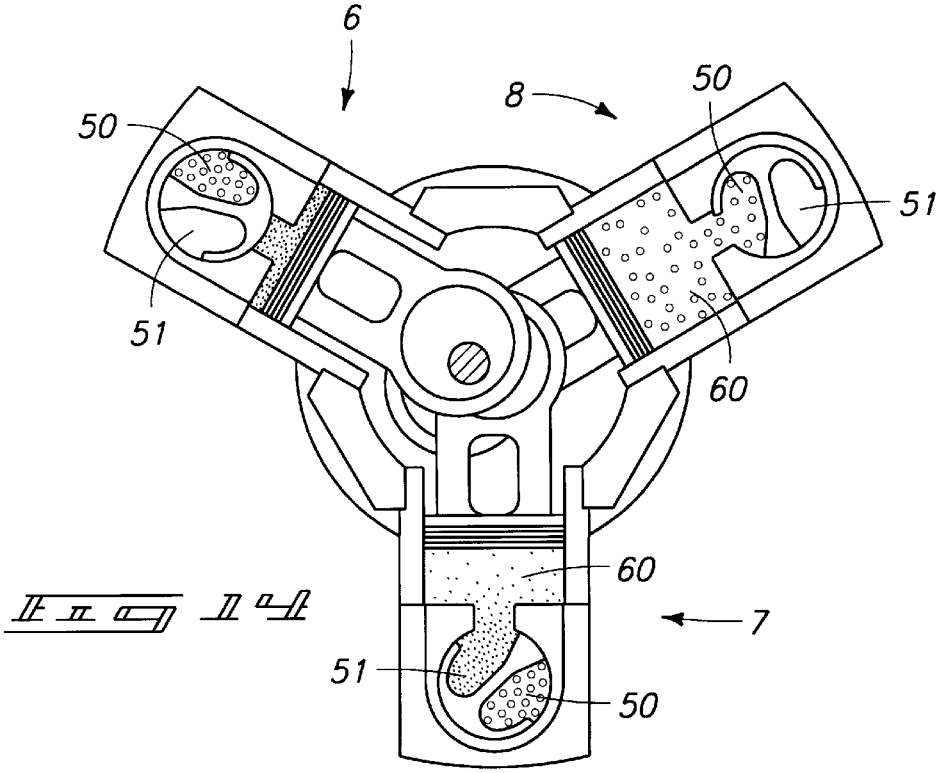
FIG. 14 is 30 degrees clockwise from FIG. 11.
Figure 15:
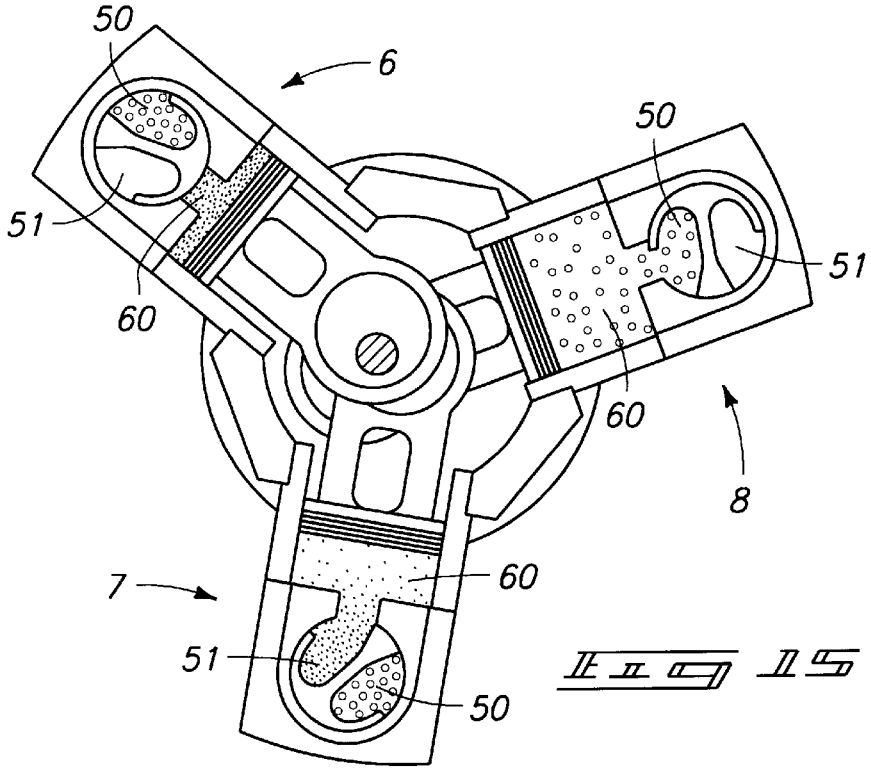
FIG. 15 is 40 degrees clockwise from FIG. 11.
Figure 16:
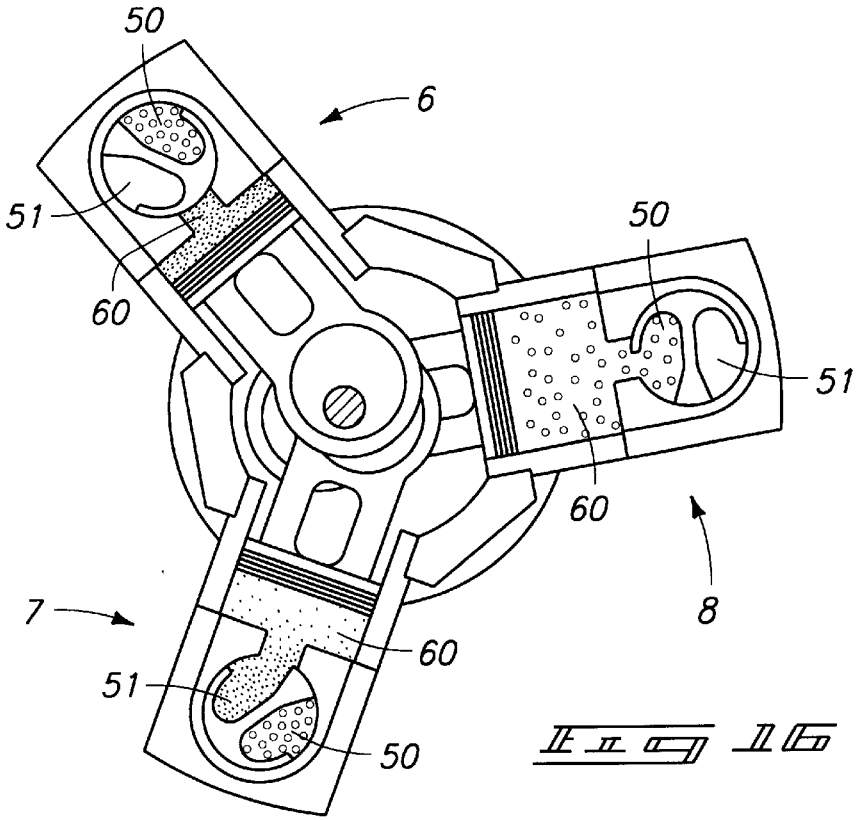
FIG. 16 is 50 degrees clockwise from FIG. 11.
Figure 17:
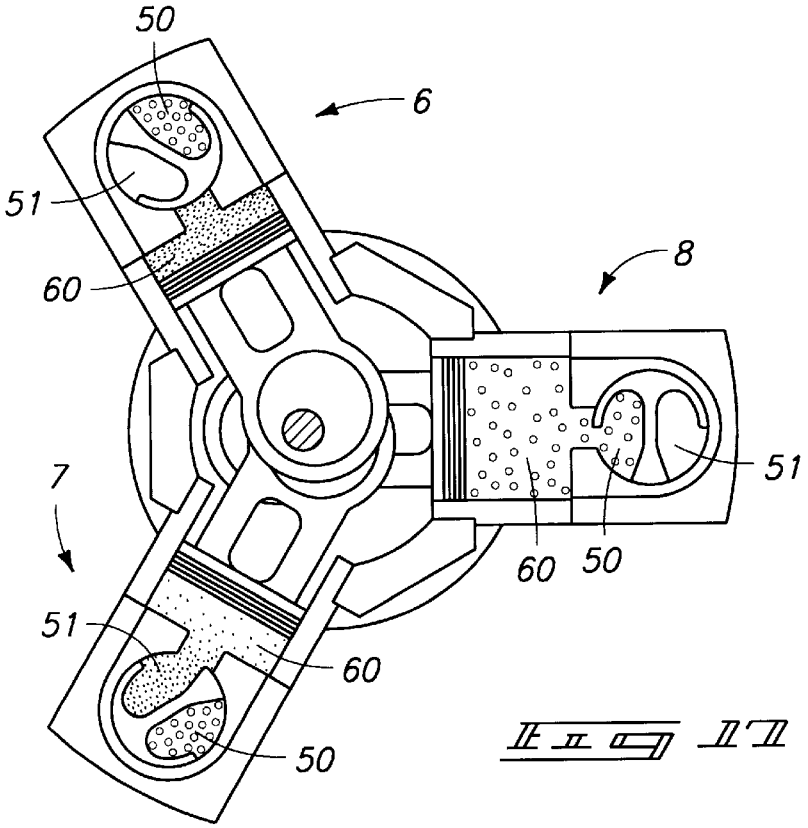
FIG. 17 is 60 degrees clockwise from FIG. 11.
Figure 18:
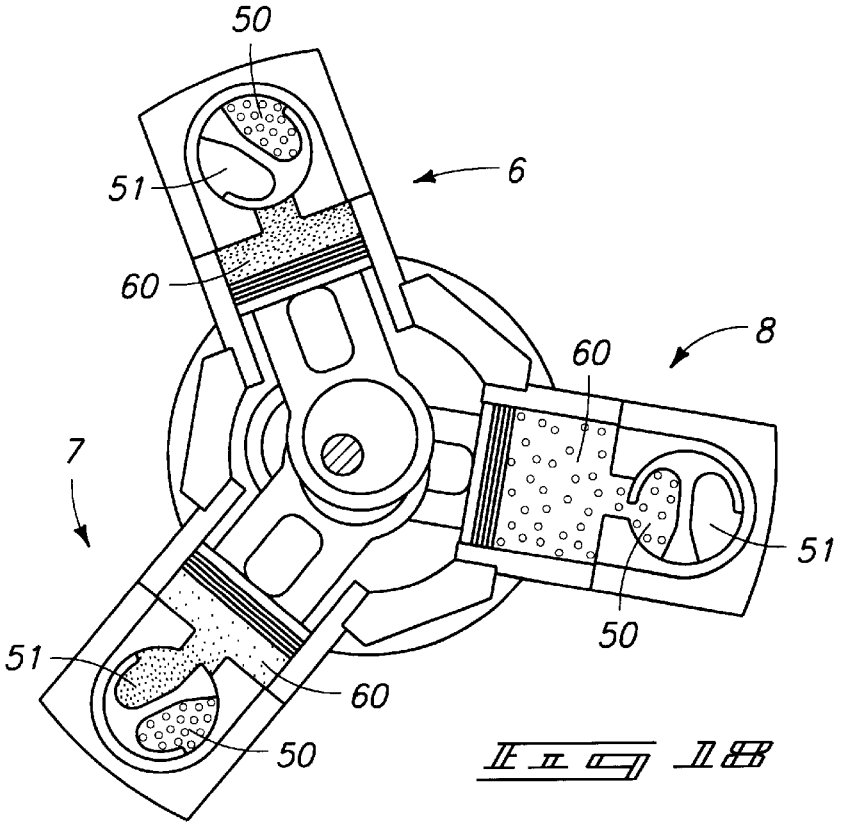
FIG. 18 is 70 degrees clockwise from FIG. 11.
Figure 19:
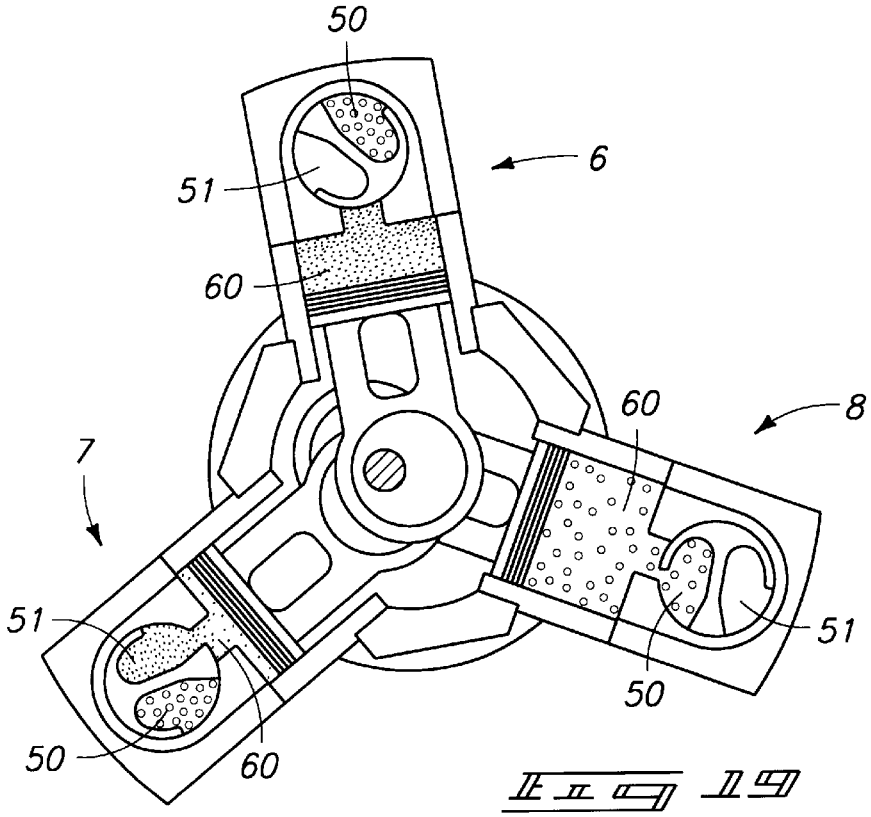
FIG. 19 is 80 degrees clockwise from FIG. 11.
Figure 20:
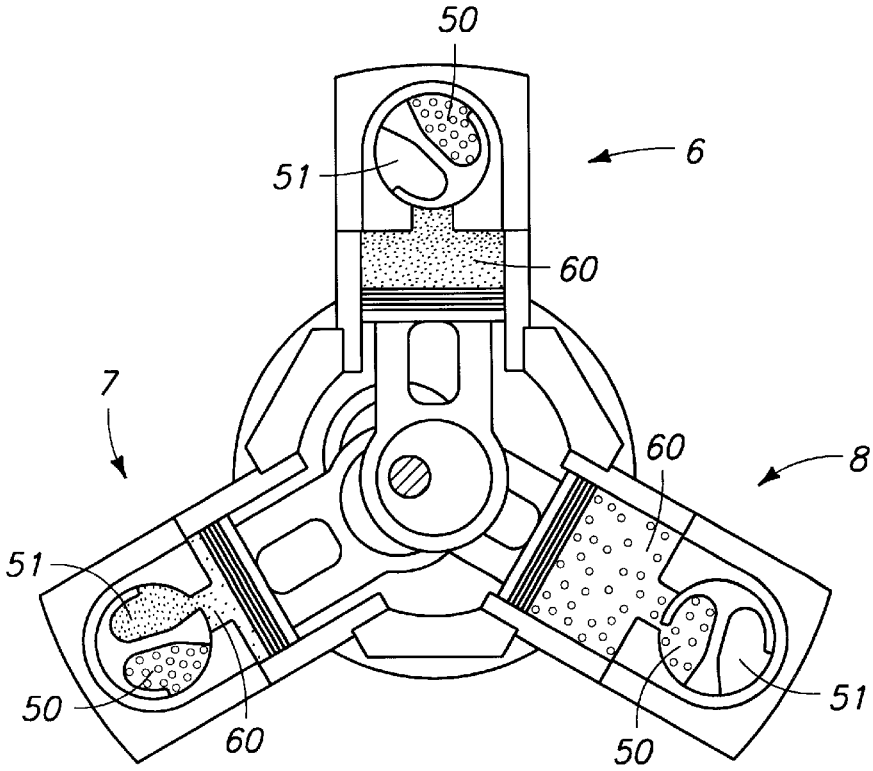
FIG. 20 is 90 degrees clockwise from FIG. 11.
Figure 21:
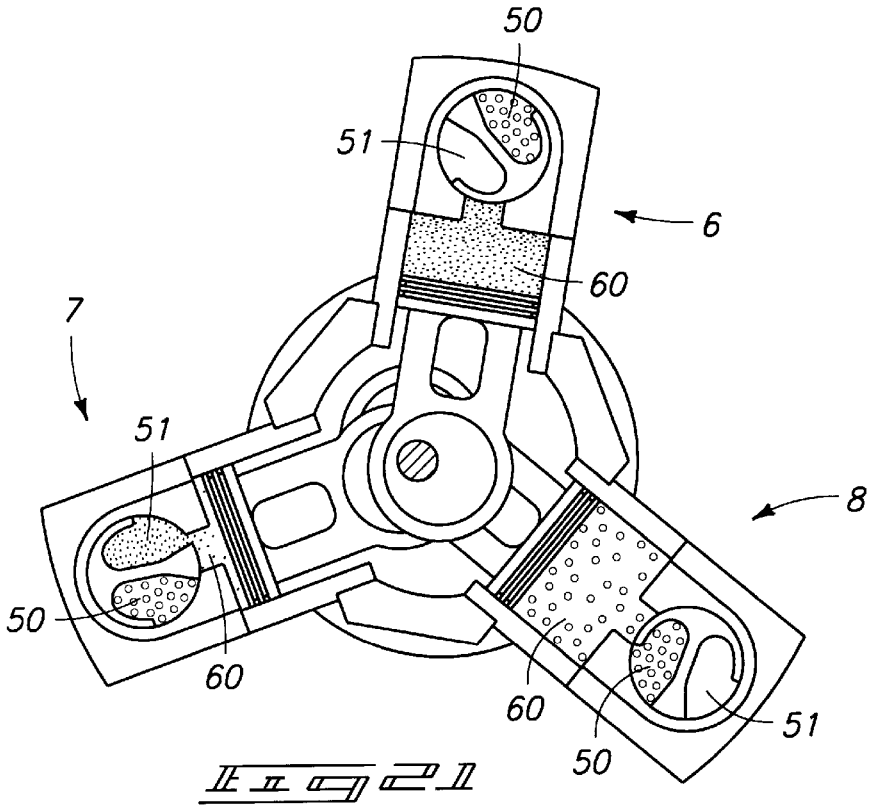
FIG. 21 is 100 degrees clockwise from FIG. 11.
Figure 22:
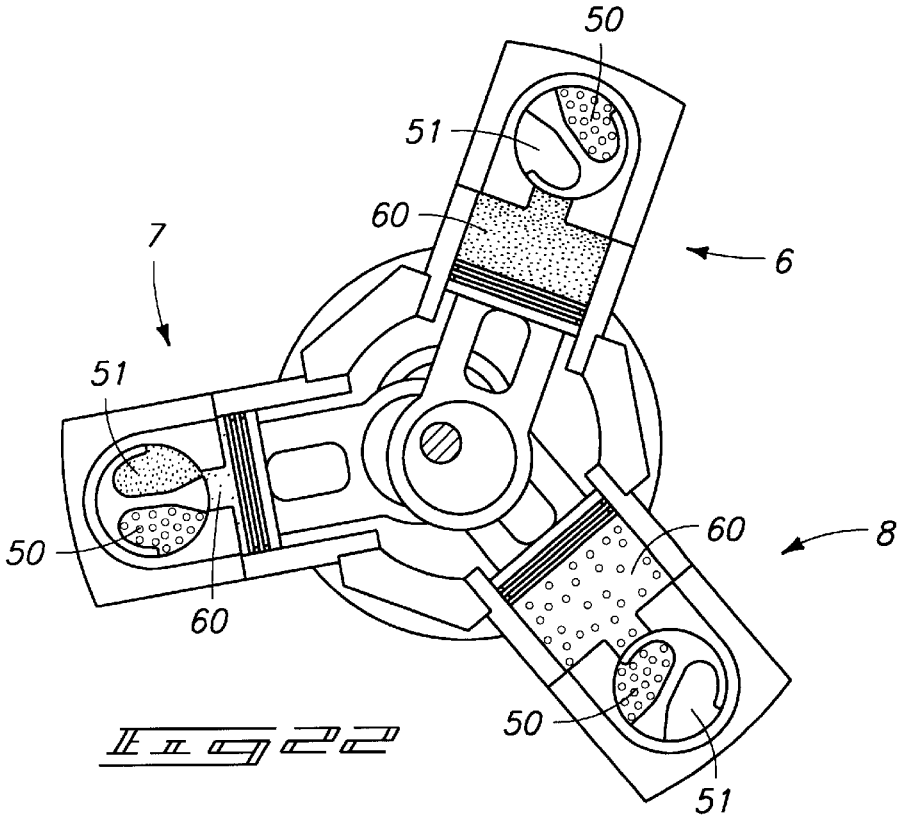
FIG. 22 is 110 degrees clockwise from FIG. 11.
Figure 23:
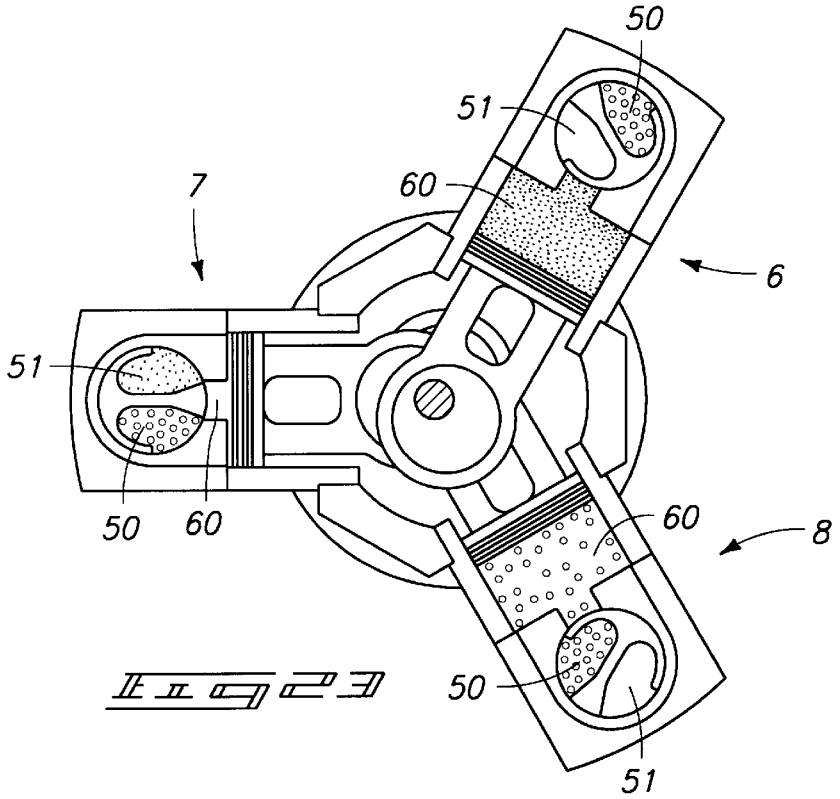
FIG. 23 is 120 degrees clockwise from FIG. 11.
Figure 24:
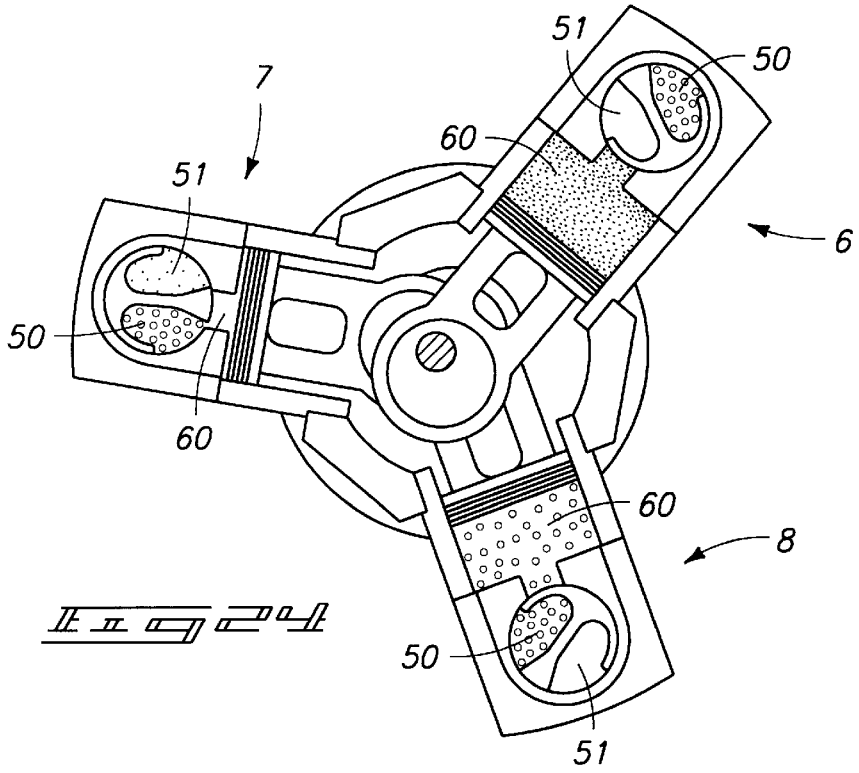
FIG. 24 is 130 degrees clockwise from FIG. 11.
Figure 25:
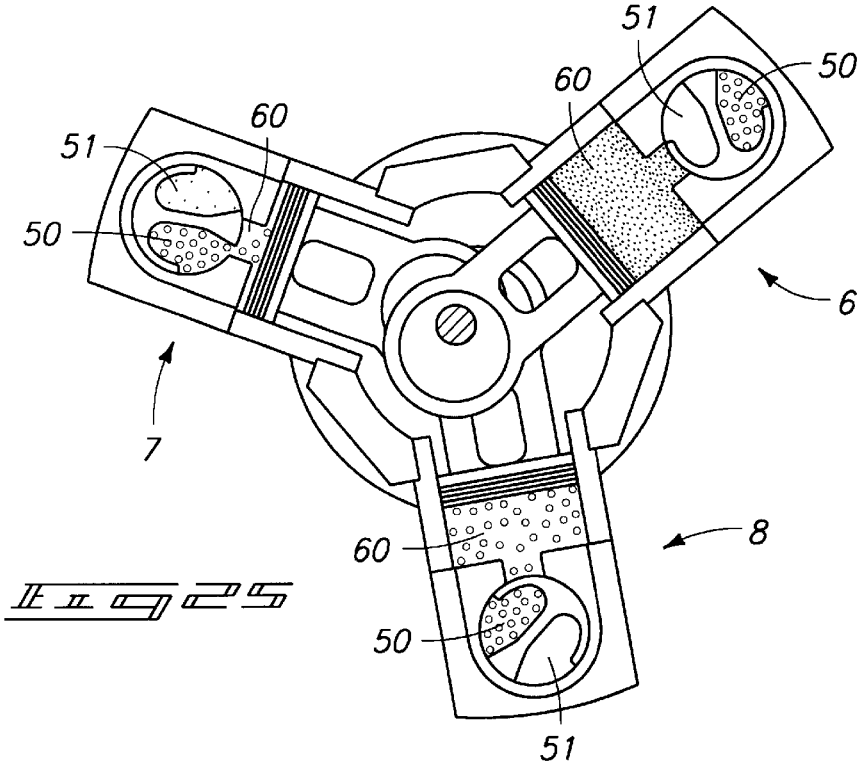
FIG. 25 is 140 degrees clockwise from FIG. 11.

For purposes of economy of space, each part or item referenced in the drawing will not be repeated for FIGS. 12 through 82, as this would be unnecessary repetition.

It will also be appreciated by those skilled in the art that the illustrations of the fuel and air mixture in the combustion chamber and the products of combustion, that while they are shown evenly dispersed for purposes of illustration, in actuality the mixtures and products may be unevenly dispersed in that they would be denser on one side than the other based on numerous factors, including the centrifugal forces from rotation, the forces of blowdown and other dynamic forces within the engine and combustion.

Figure 26:
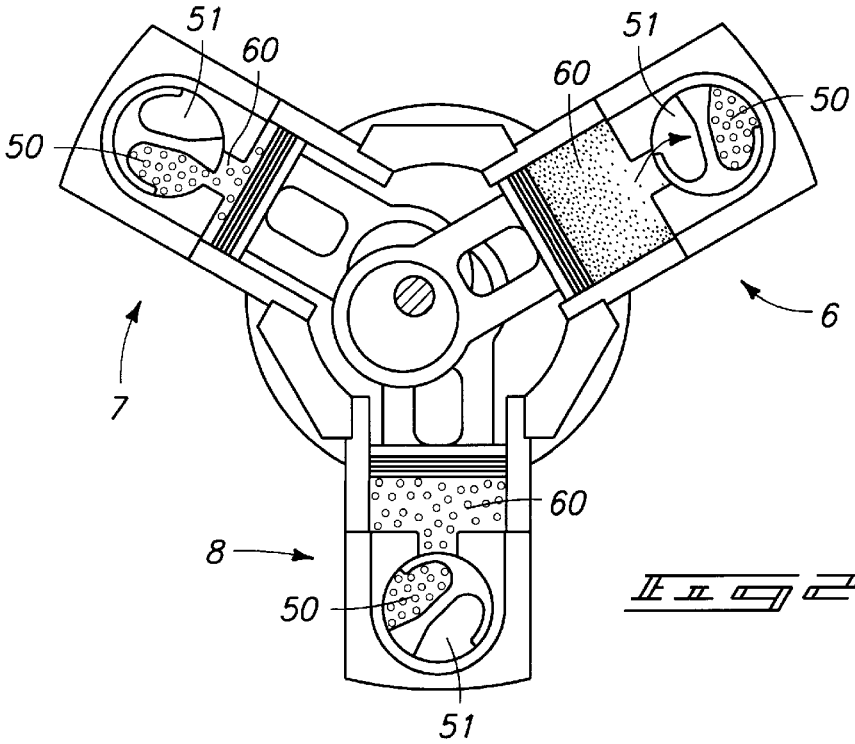
FIG. 26 is 150 degrees clockwise from FIG. 11.
Figure 27:
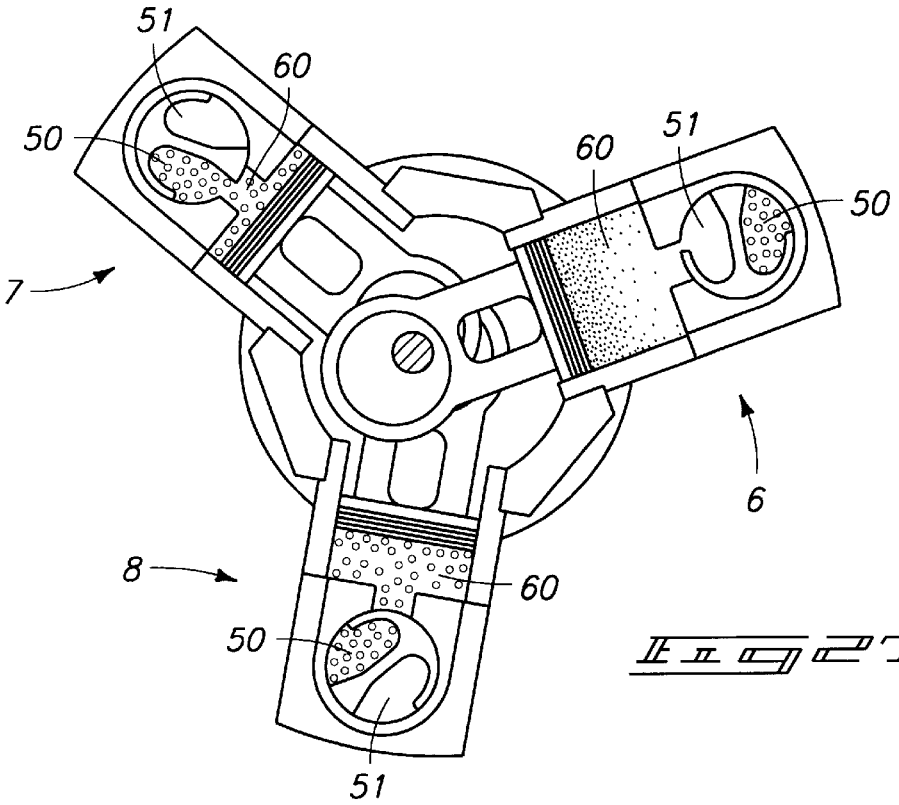
FIG. 27 is 160 degrees clockwise from FIG. 11.
Figure 28:
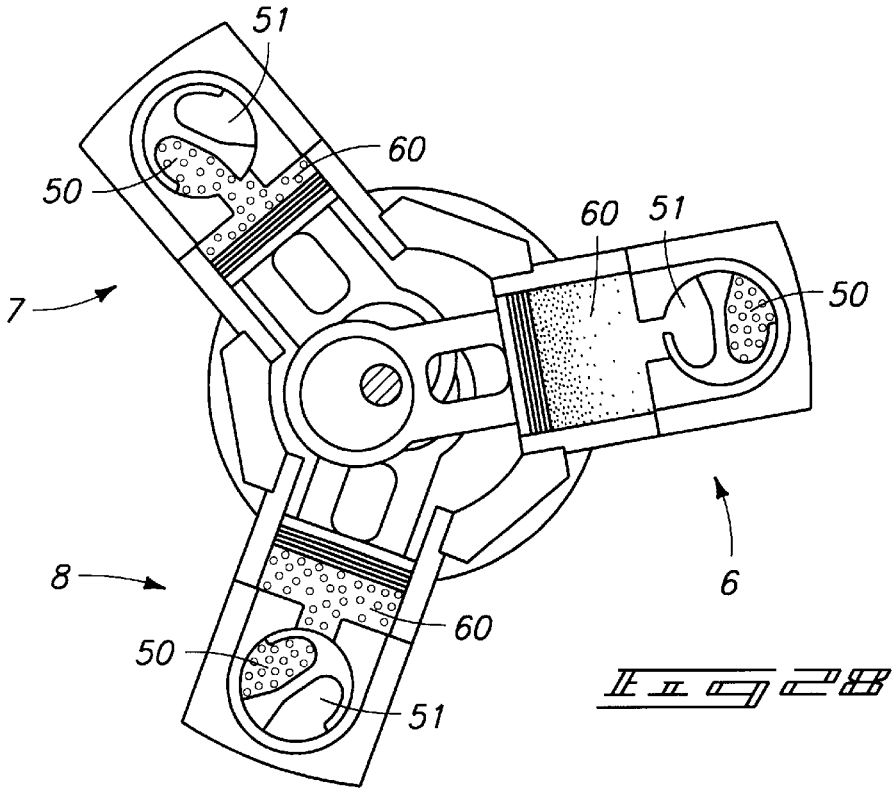
FIG. 28 is 170 degrees clockwise from FIG. 11.
Figure 29:
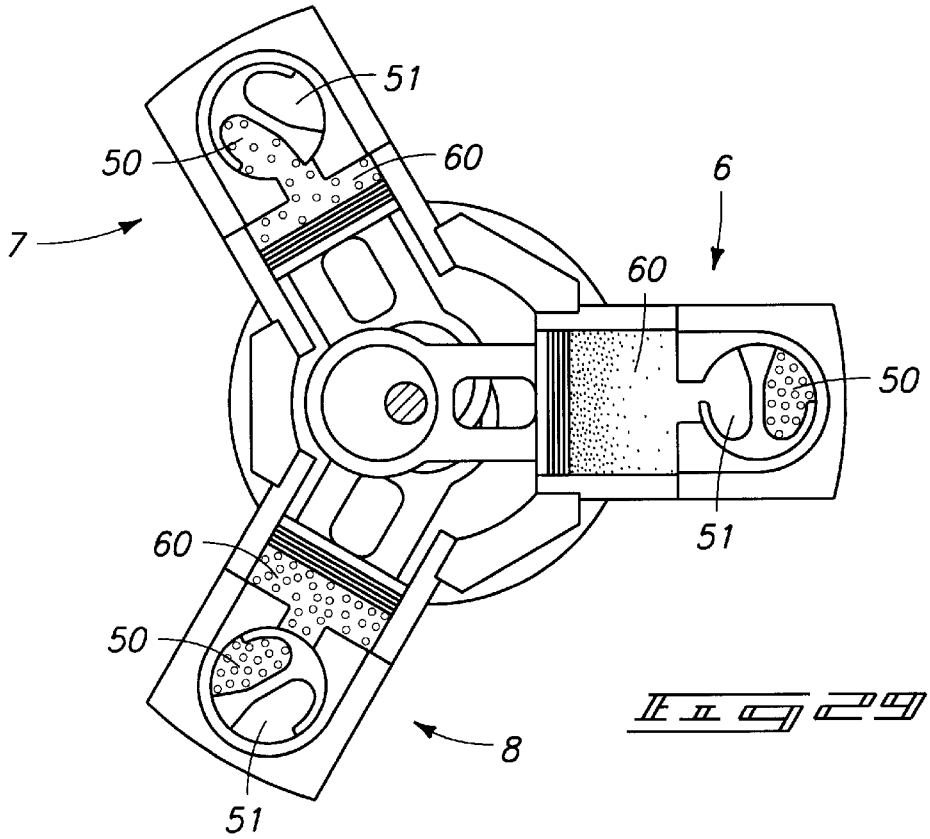
FIG. 29 is 180 degrees clockwise from FIG. 11.
Figure 30:
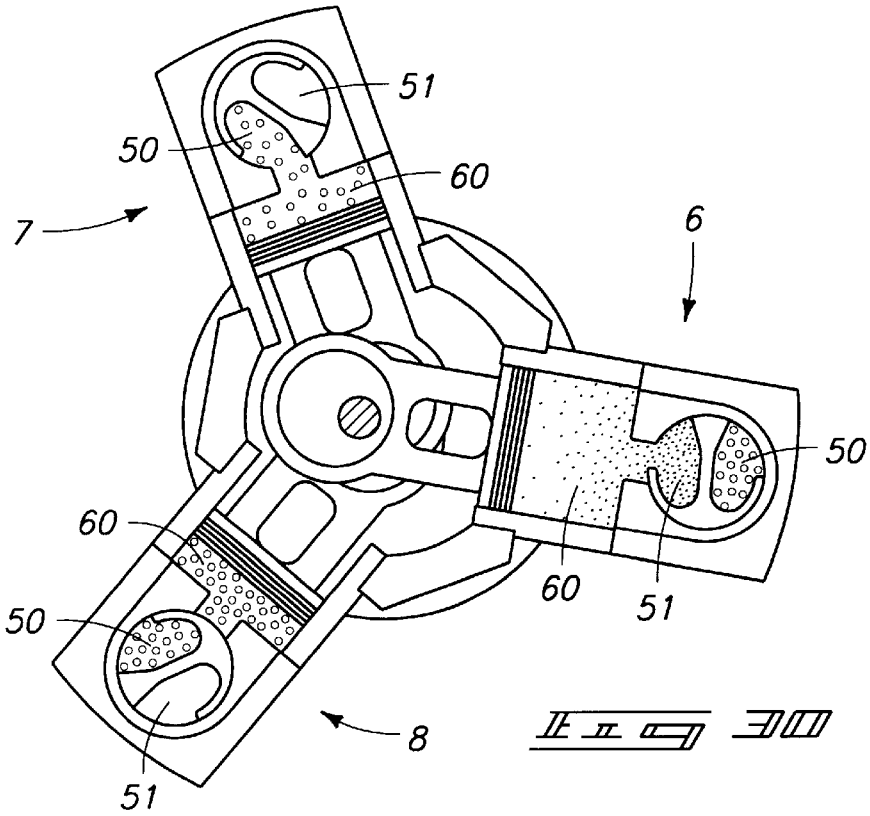
FIG. 30 is 190 degrees clockwise from FIG. 11.
Figure 31:
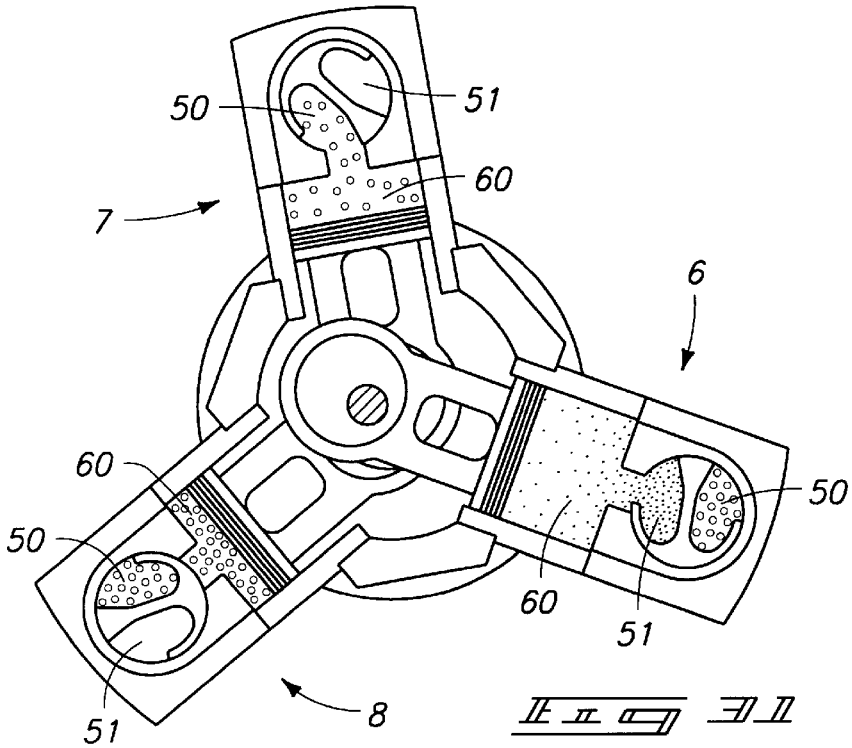
FIG. 31 is 200 degrees clockwise from FIG. 11.
Figure 32:
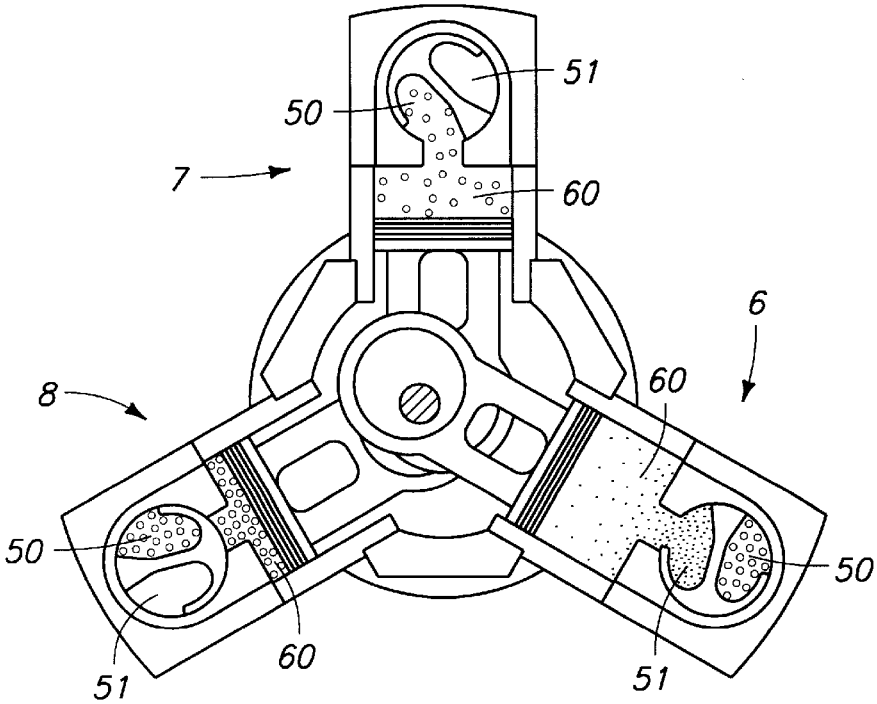
FIG. 32 is 210 degrees clockwise from FIG. 11.
Figure 33:
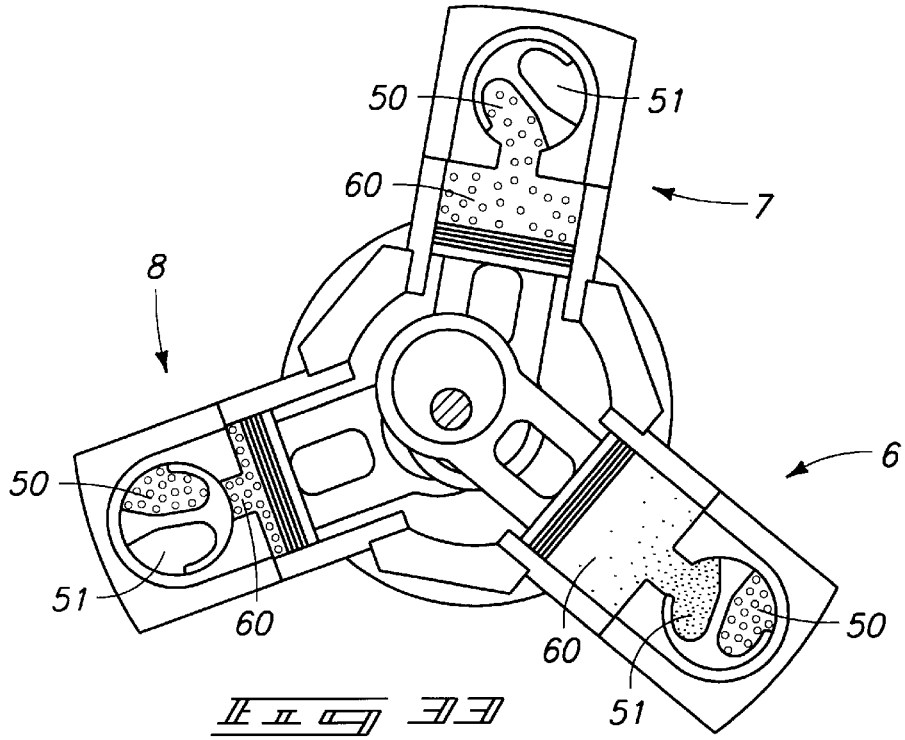
FIG. 33 is 220 degrees clockwise from FIG. 11.
Figure 34:
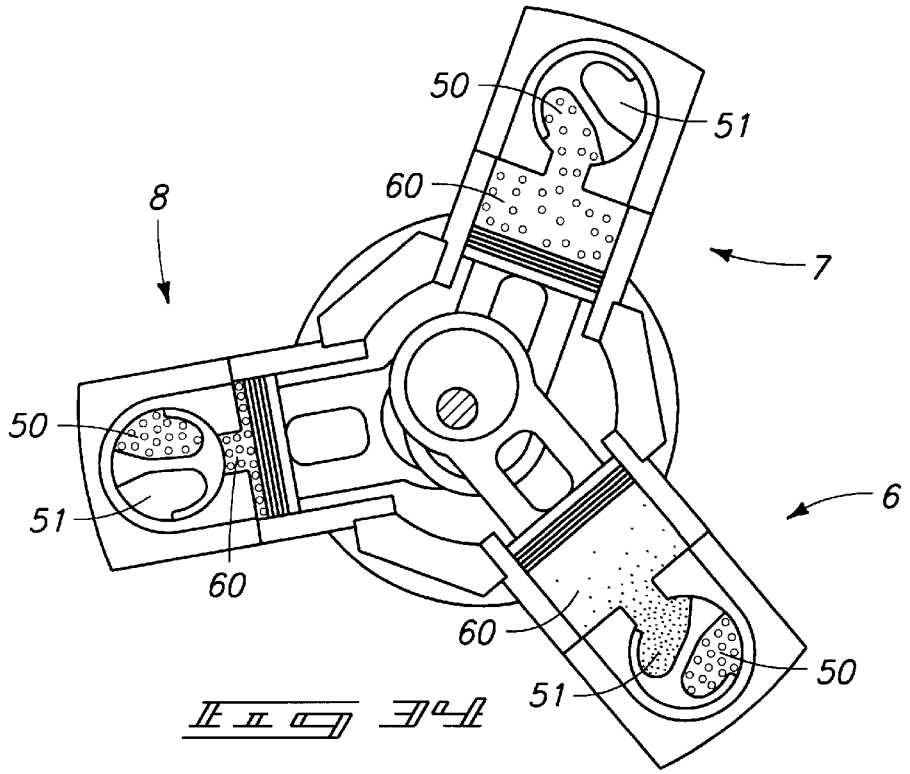
FIG. 34 is 230 degrees clockwise from FIG. 11.

FIG. 11 illustrates a spark or ignition of a fuel and air mixture in cylinder assembly 6. From FIG. 11 through FIG. 25, the explosion or ignition forces from combustion continue to impart a force on the terminal wall 67 of the cylinder 9, thereby maintaining the seal between the two. At FIG. 26, the valve exhaust port 51 begins to open and a rush or squirt of the products of combustion occurs from the combustion chamber 60 and into the valve exhaust port 51. This is sometimes referred to in the industry as blowdown.

Figure 35:
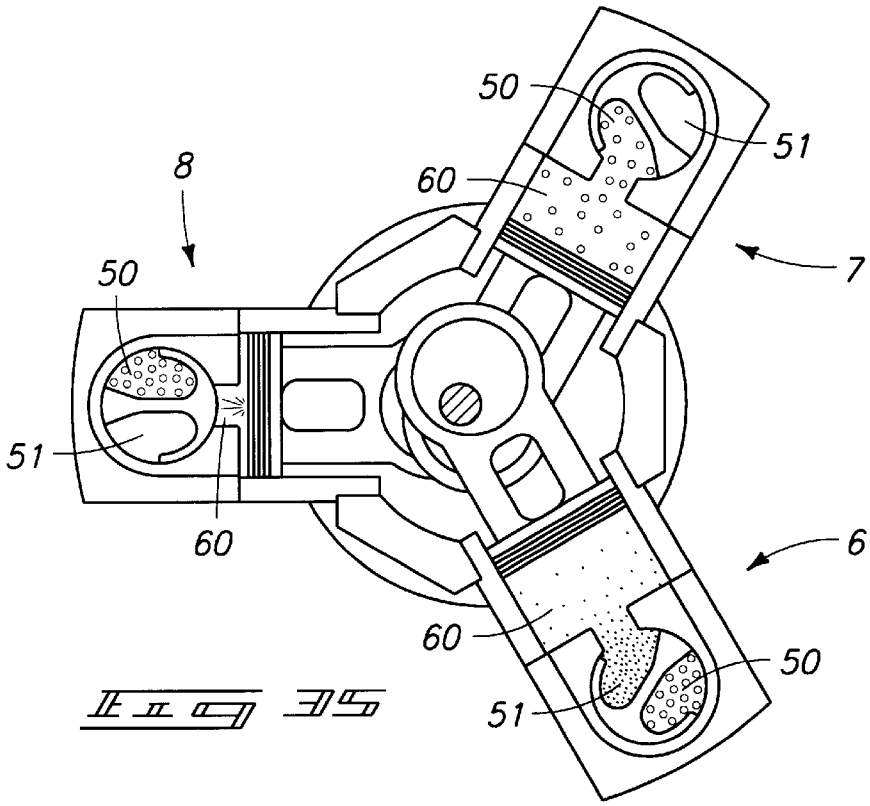
FIG. 35 is 240 degrees clockwise from FIG. 11 and illustrates a spark or ignition within cylinder assembly 8.
Figure 36:
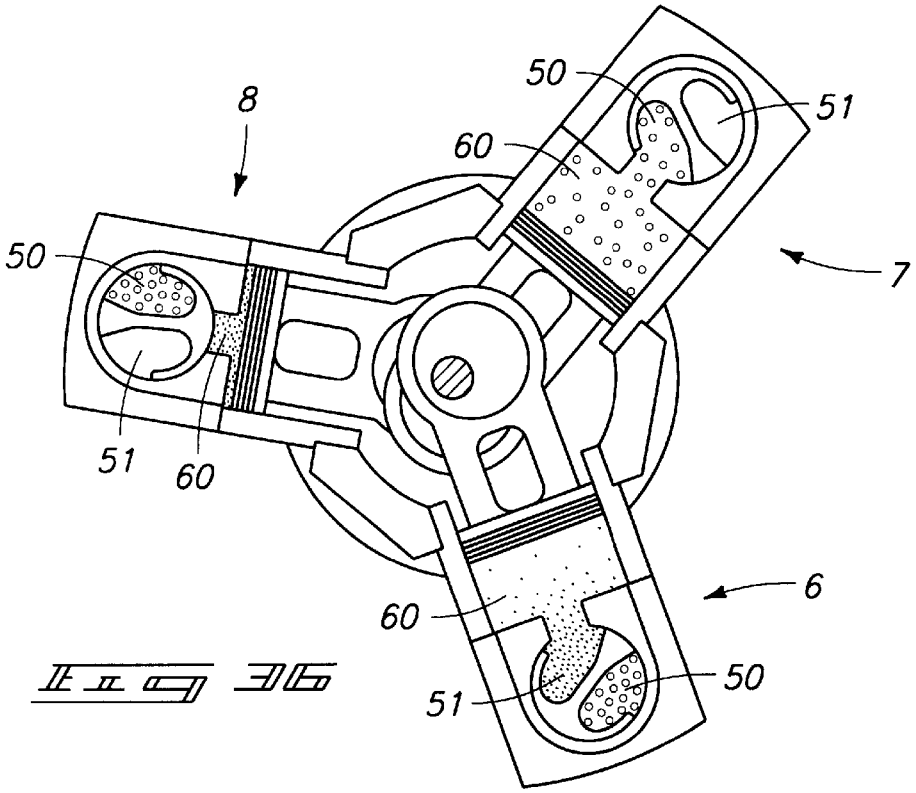
FIG. 36 is 250 degrees clockwise from FIG. 11.
Figure 37:
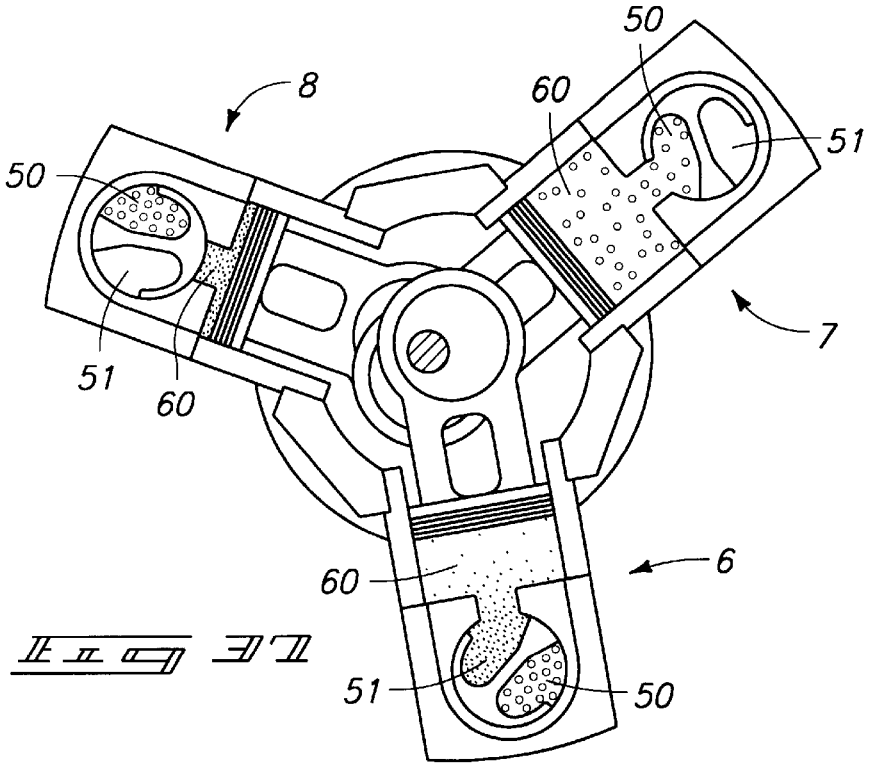
FIG. 37 is 260 degrees clockwise from FIG. 11.
Figure 38:
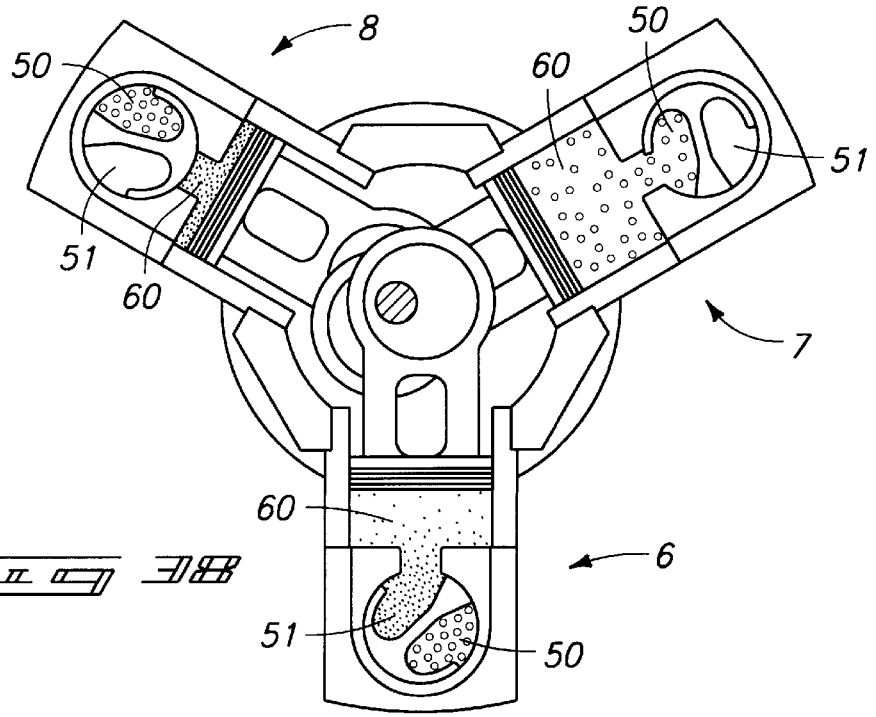
FIG. 38 is 270 degrees clockwise from FIG. 11.
Figure 39:
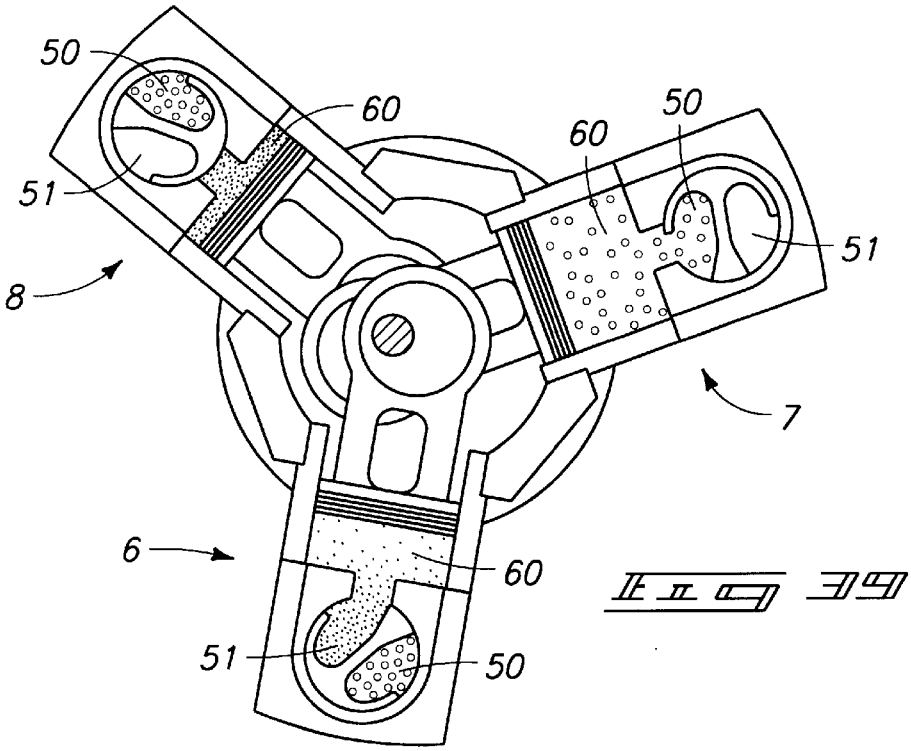
FIG. 39 is 280 degrees clockwise from FIG. 11.
Figure 40:
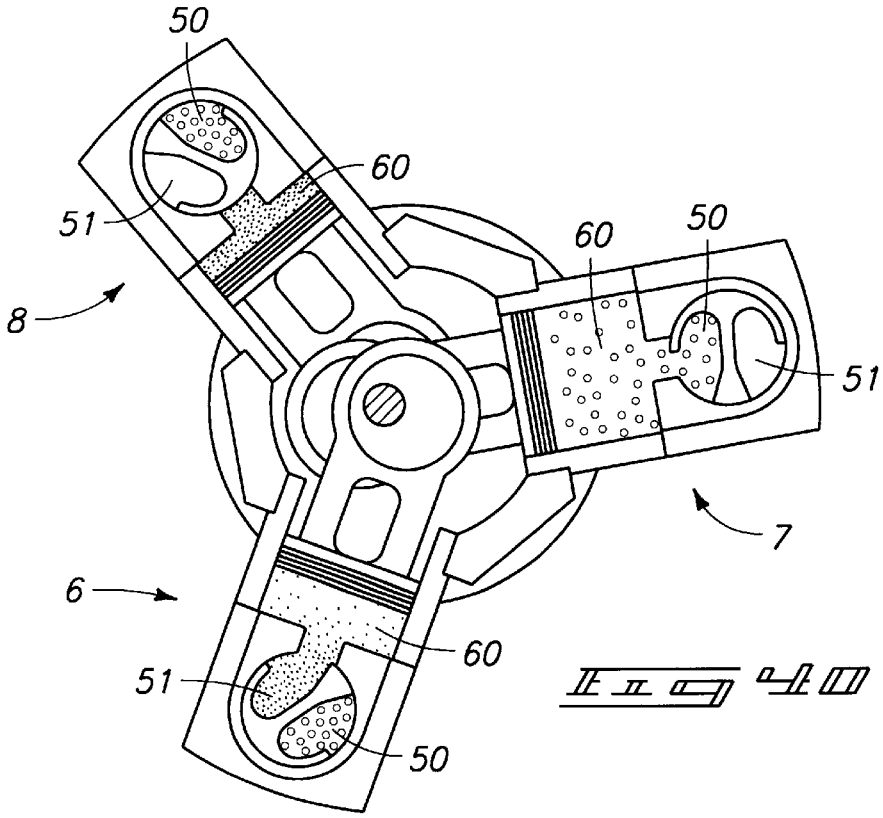
FIG. 40 is 290 degrees clockwise from FIG. 11.
Figure 41:
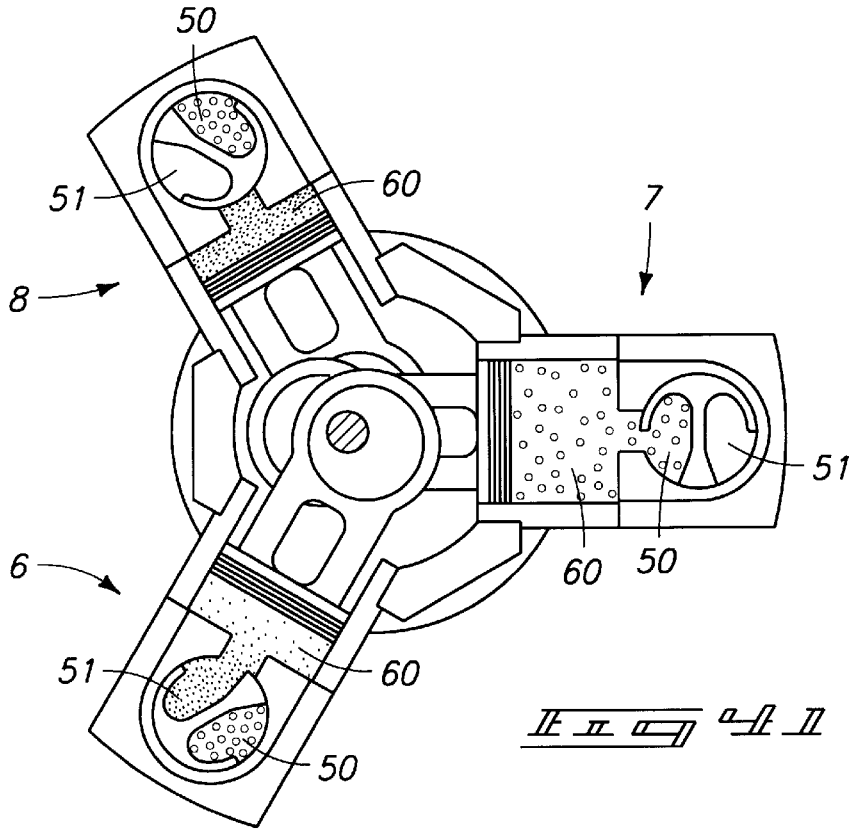
FIG. 41 is 300 degrees clockwise from FIG. 11.
Figure 42:
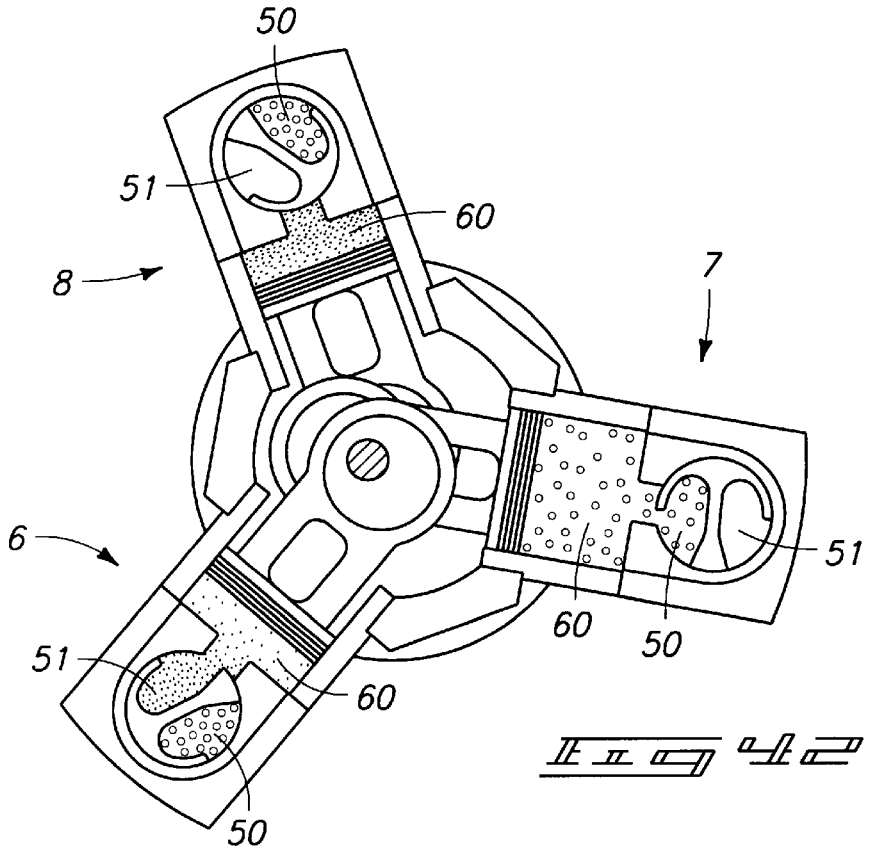
FIG. 42 is 310 degrees clockwise from FIG. 11.
Figure 43:
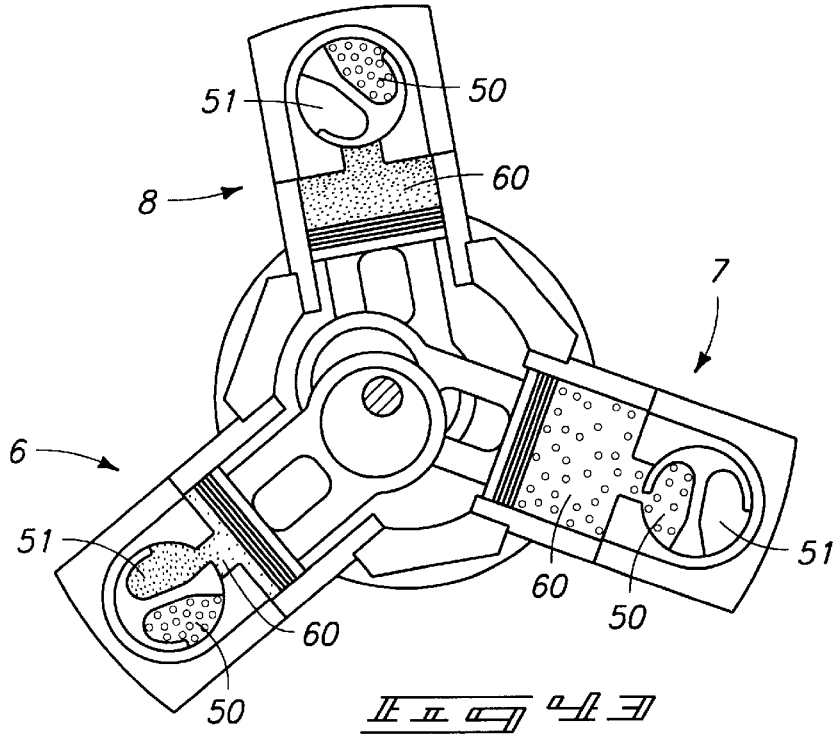
FIG. 43 is 320 degrees clockwise from FIG. 11.
Figure 44:
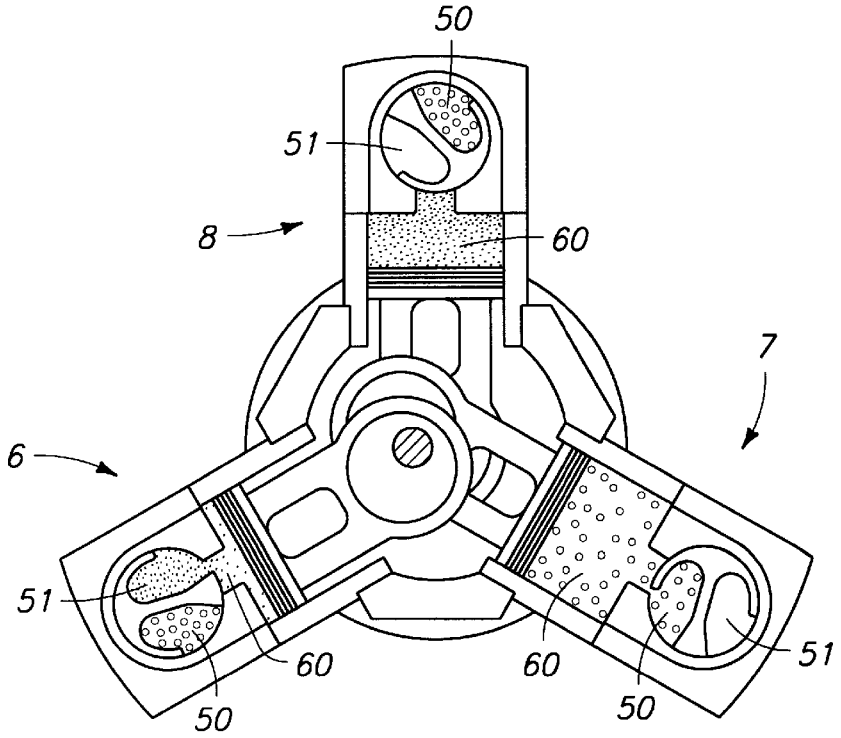
FIG. 44 is 330 degrees clockwise from FIG. 11.
Figure 45:
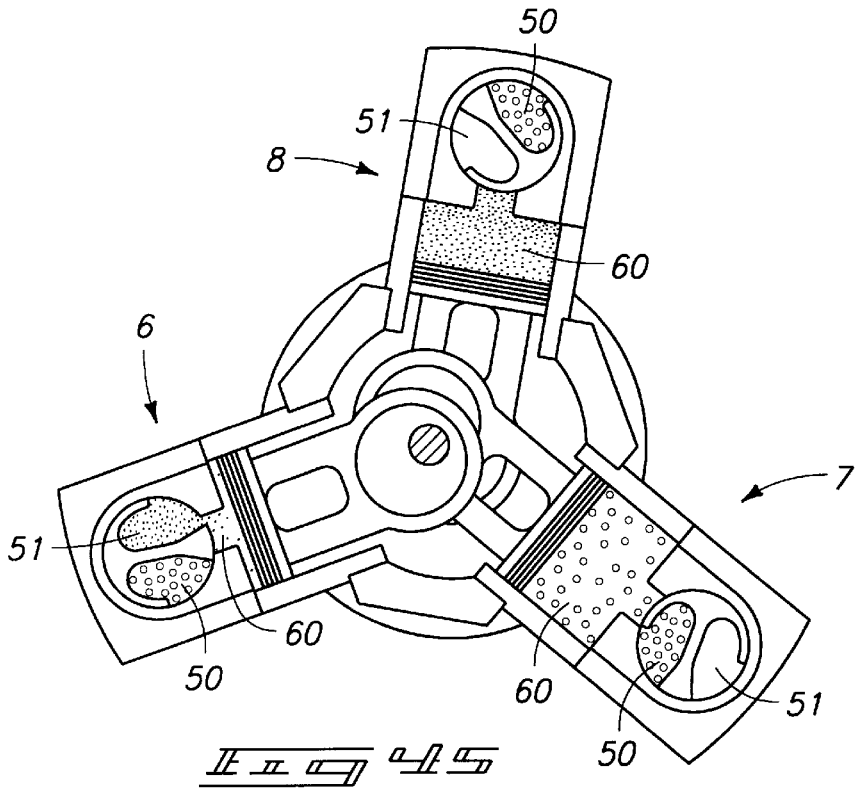
FIG. 45 is 340 degrees clockwise from FIG. 11.
Figure 46:
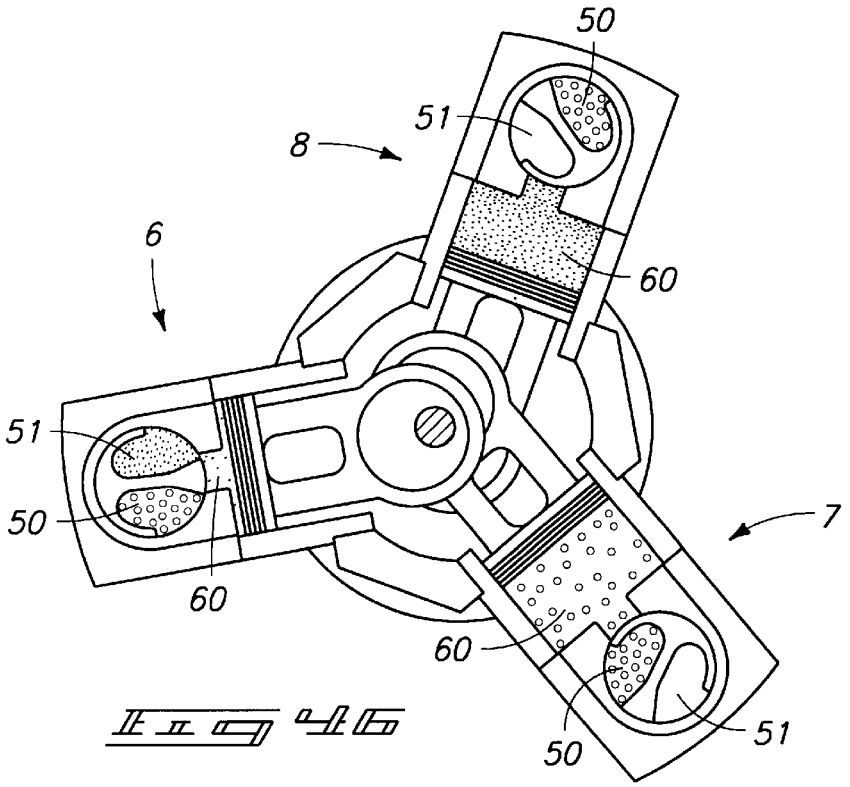
FIG. 46 is 350 degrees clockwise from FIG. 11.
Figure 47:
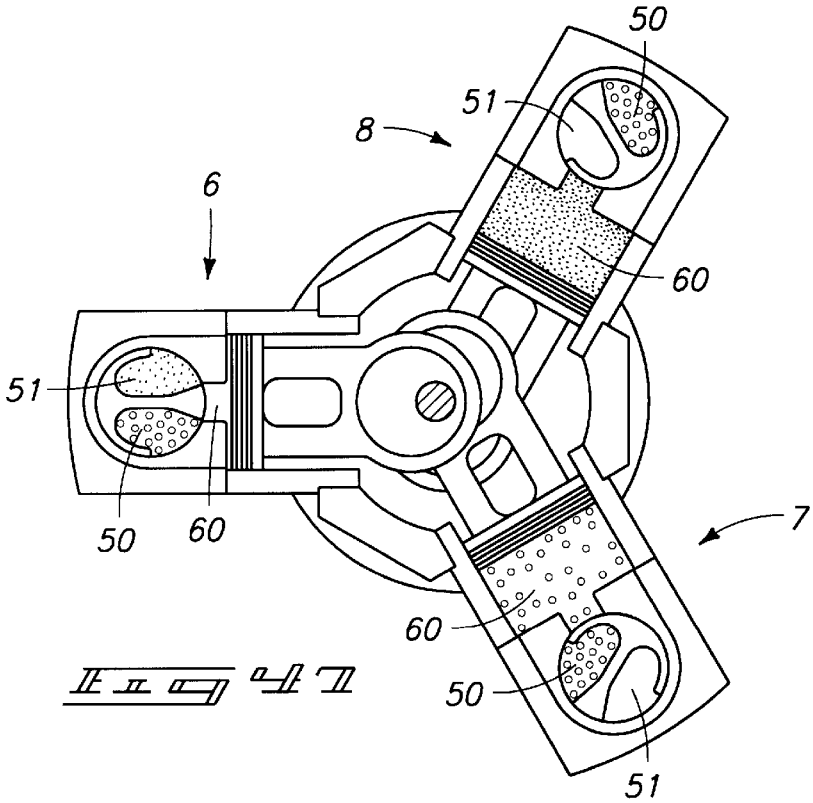
FIG. 47 is 360 degrees clockwise from FIG. 11.
Figure 48:
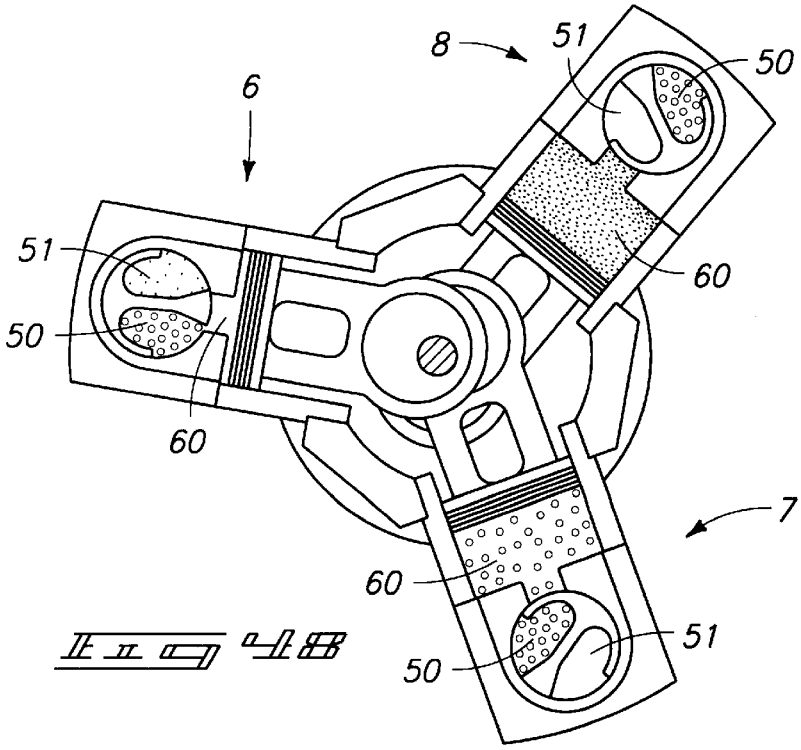
FIG. 48 is 370 degrees clockwise from FIG. 11.
Figure 49:
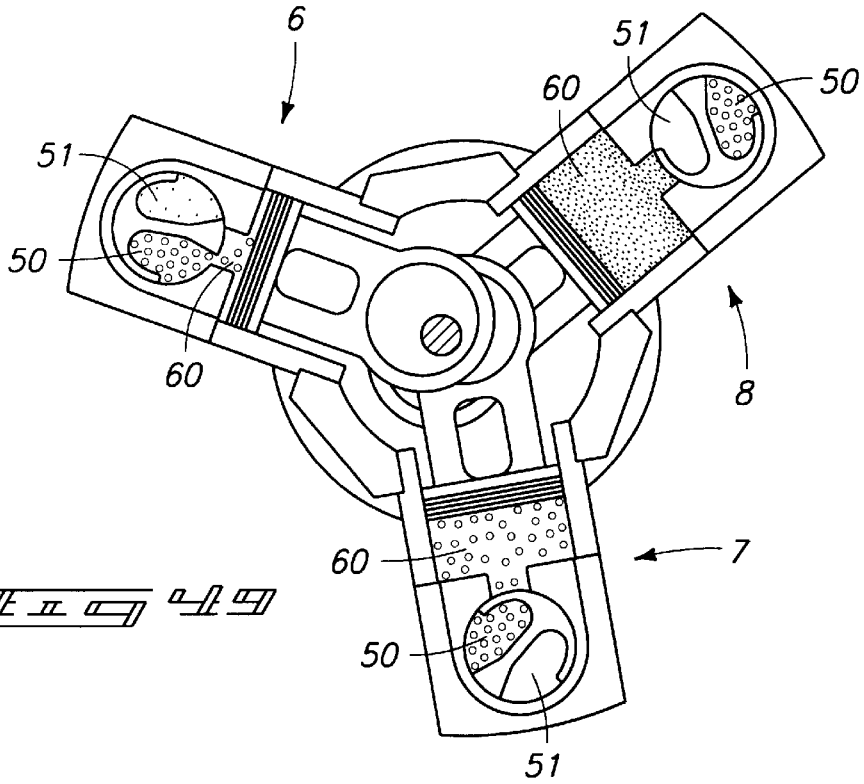
FIG. 49 is 380 degrees clockwise from FIG. 11.
Figure 50:
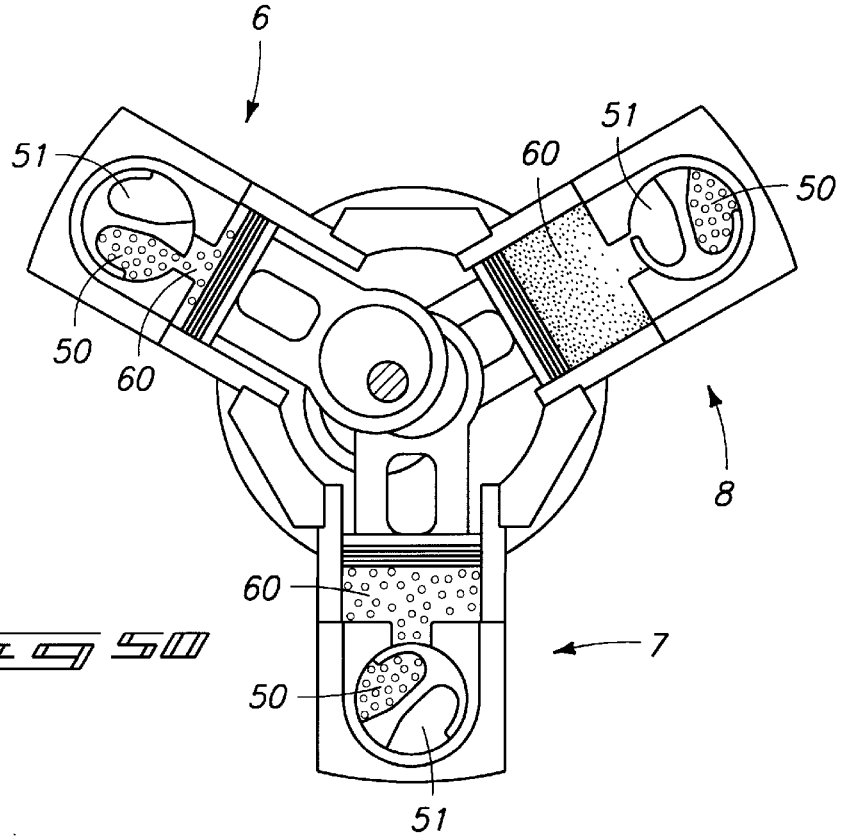
FIG. 50 is 390 degrees clockwise from FIG. 11.
Figure 51:
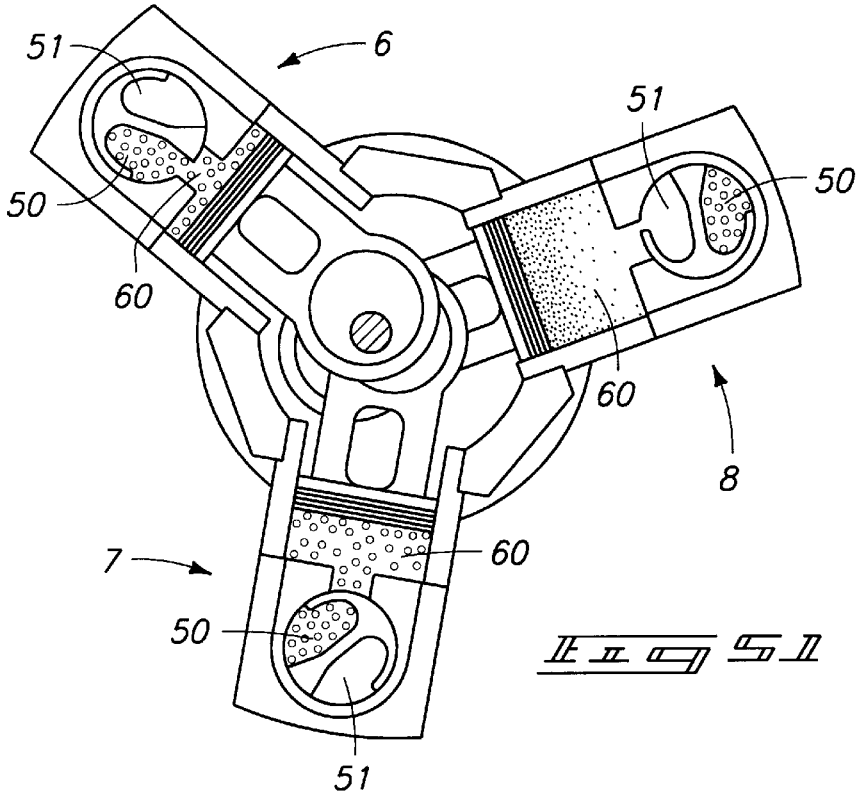
FIG. 51 is 400 degrees clockwise from FIG. 11.
Figure 52:
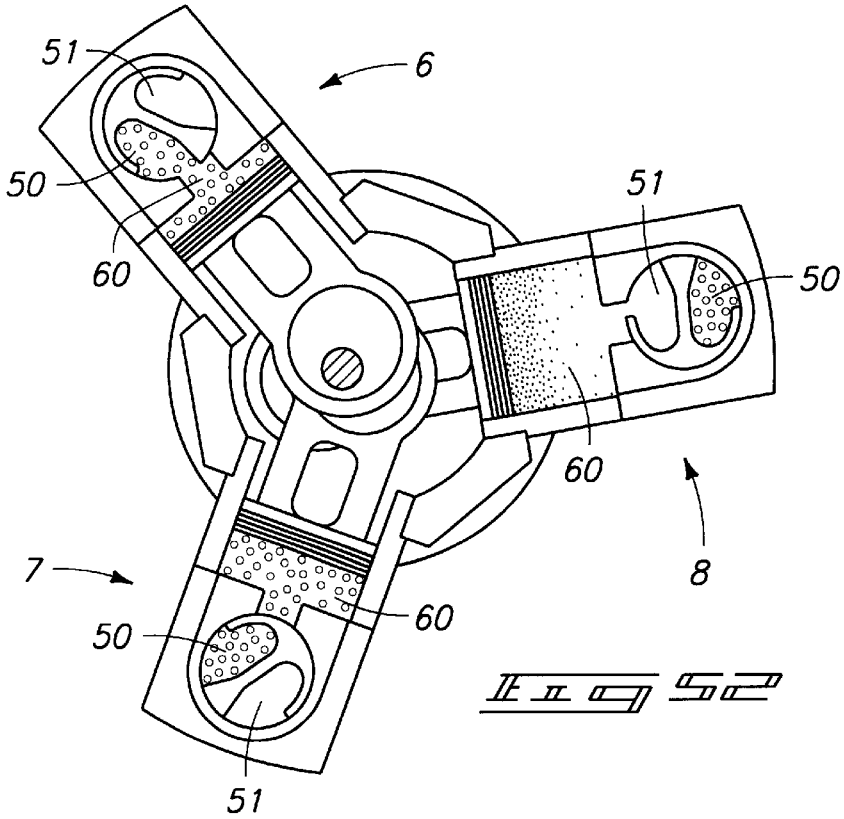
FIG. 52 is 410 degrees clockwise from FIG. 11.
Figure 53:
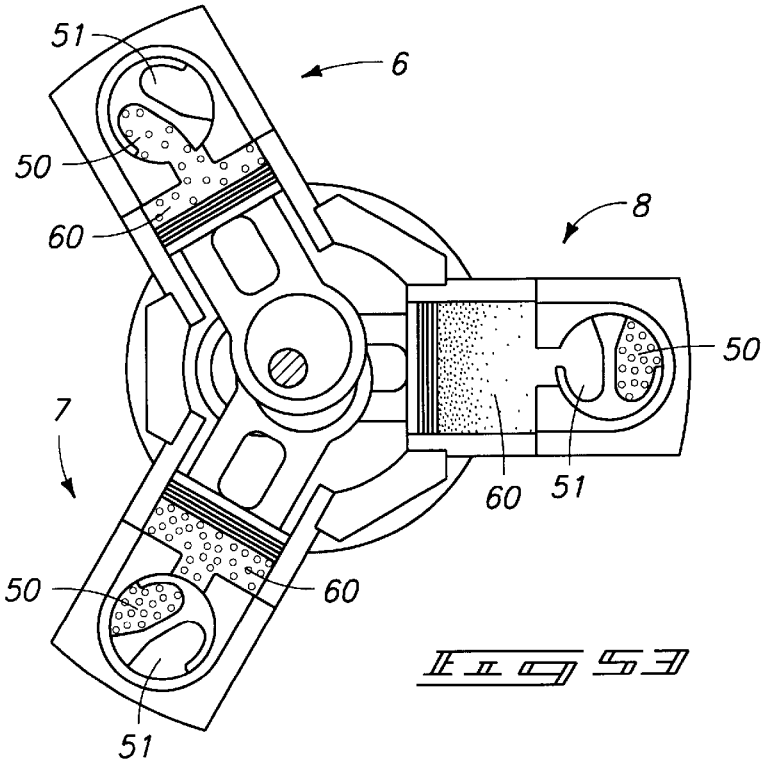
FIG. 53 is 420 degrees clockwise from FIG. 11.
Figure 54:
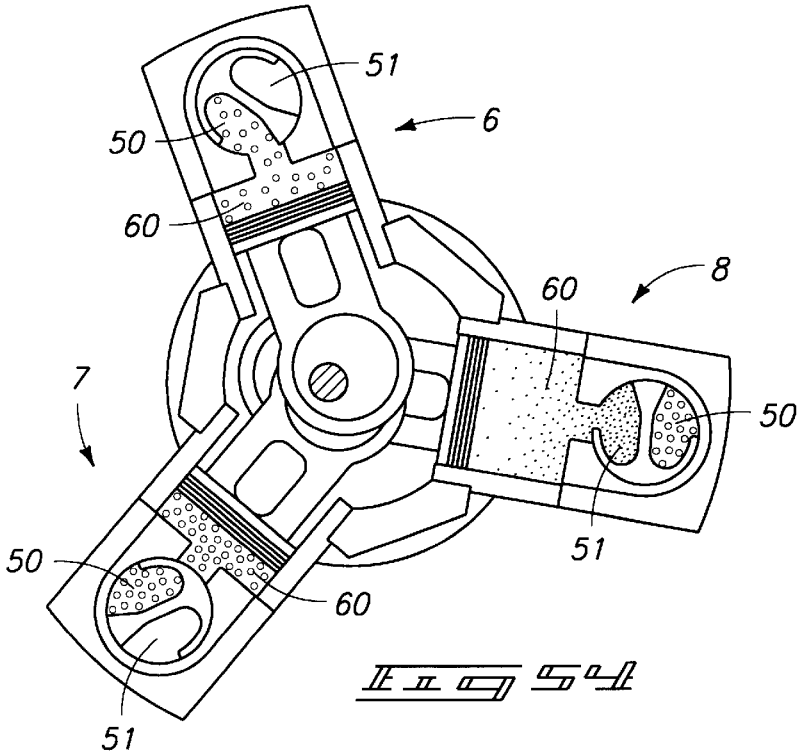
FIG. 54 is 430 degrees clockwise from FIG. 11.
Figure 55:
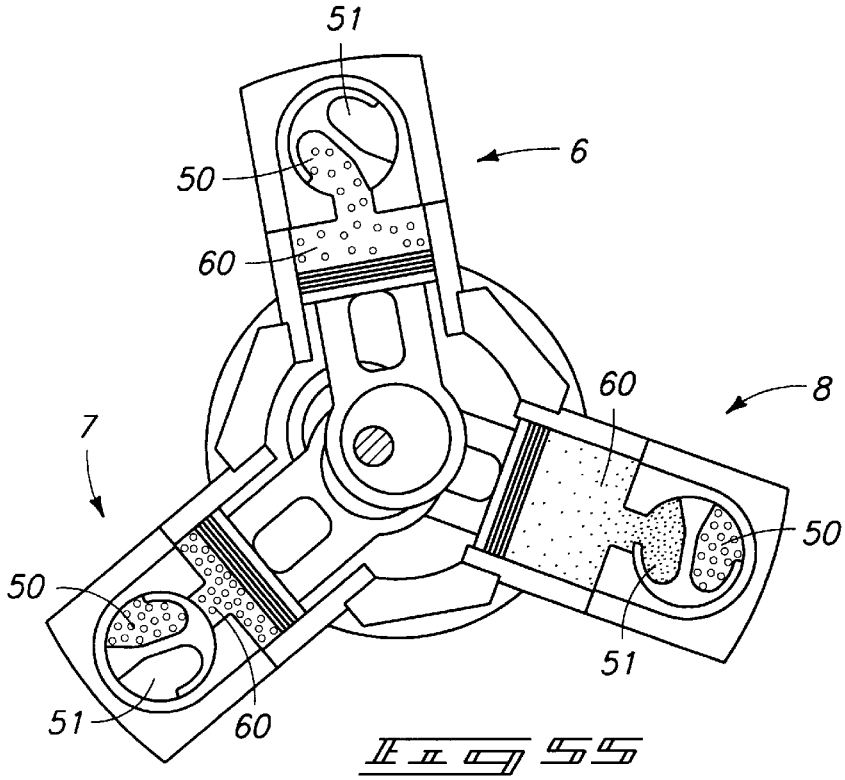
FIG. 55 is 440 degrees clockwise from FIG. 11.
Figure 56:
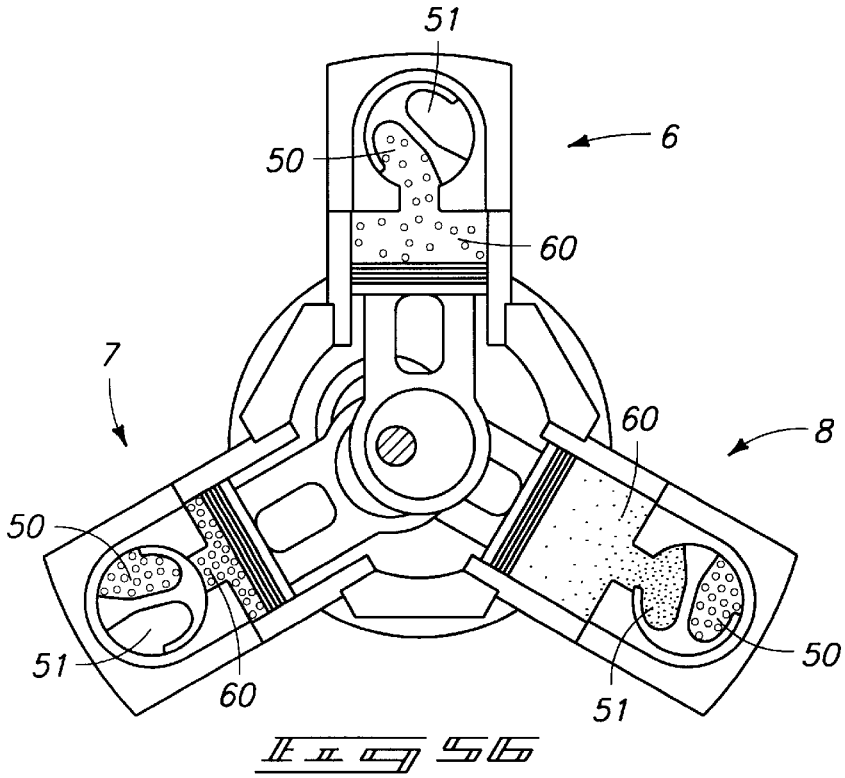
FIG. 56 is 450 degrees clockwise from FIG. 11.
Figure 57:
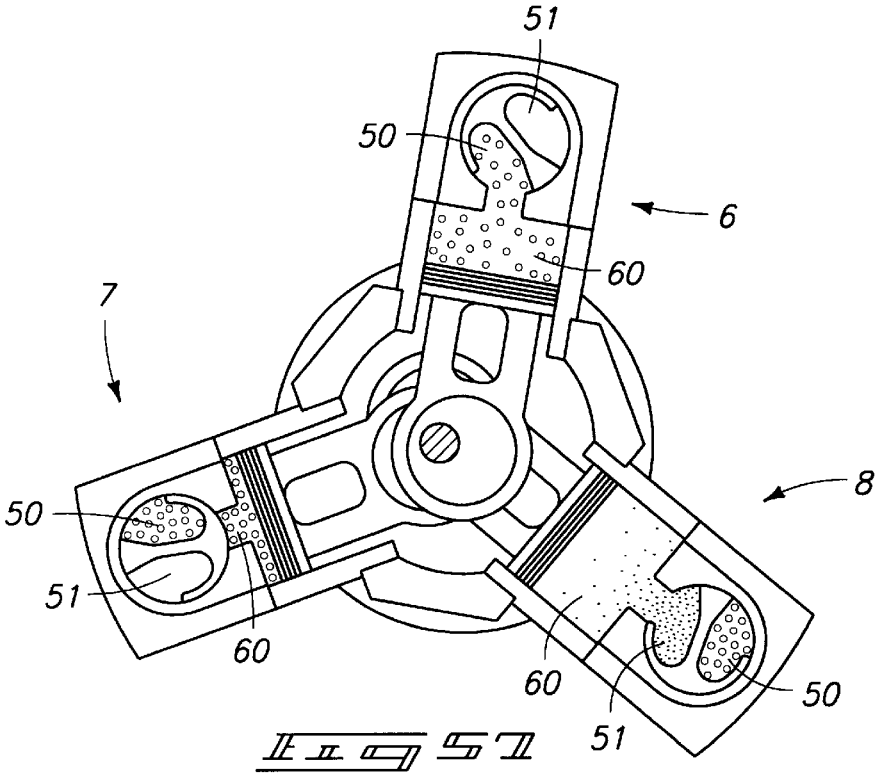
FIG. 57 is 460 degrees clockwise from FIG. 11.
Figure 58:
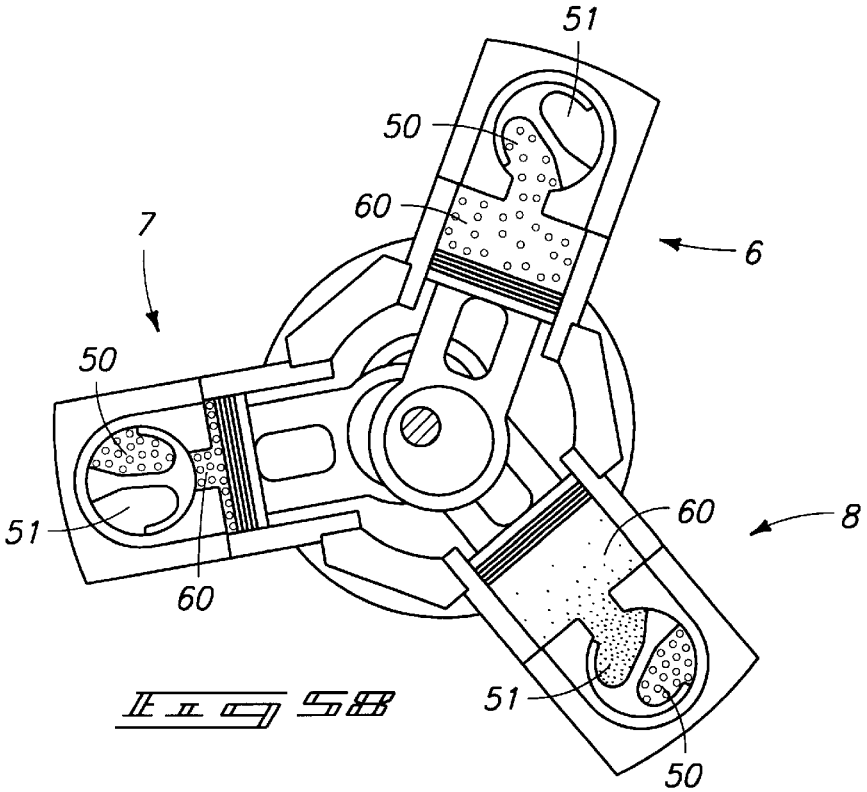
FIG. 58 is 470 degrees clockwise from FIG. 11.
Figure 59:
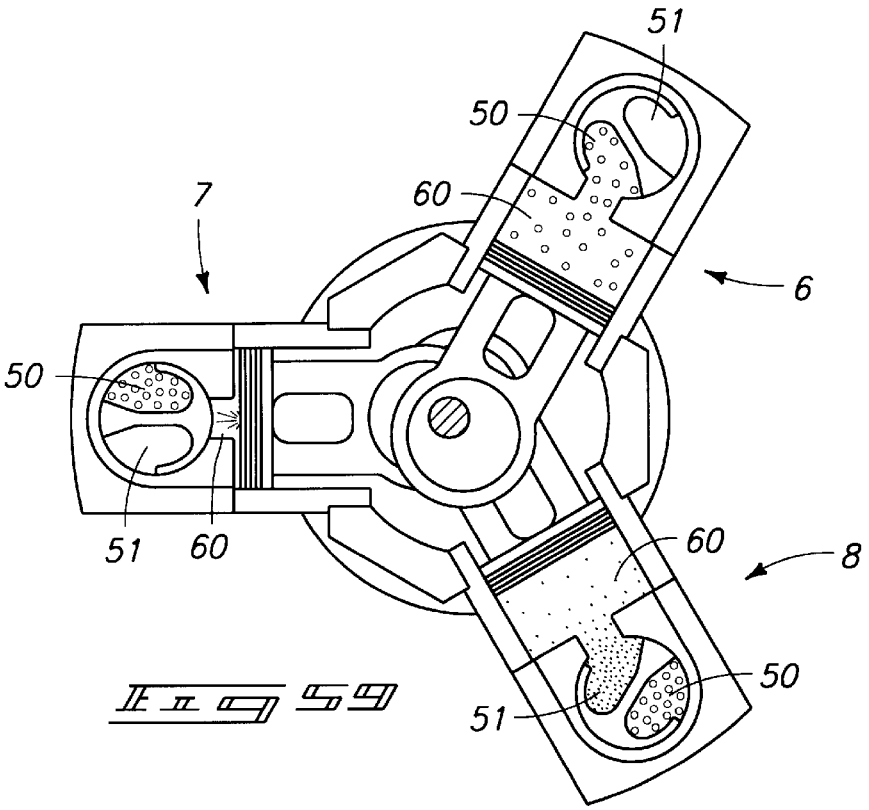
FIG. 59 is 480 degrees clockwise from FIG. 11 and illustrates a spark or ignition within cylinder assembly 7.
Figure 60:
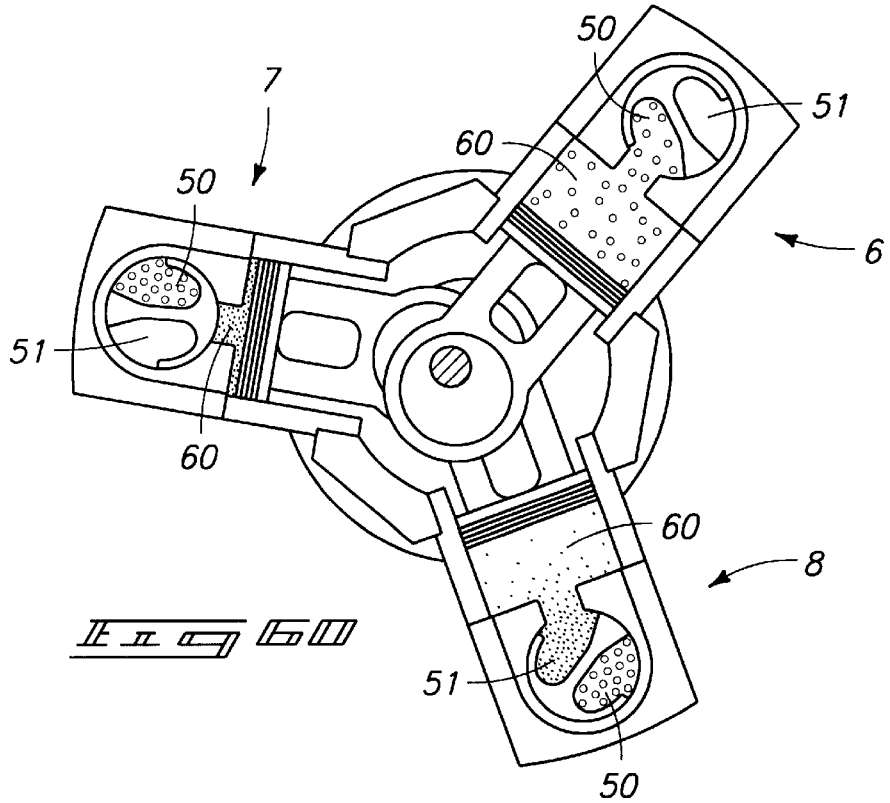
FIG. 60 is 490 degrees clockwise from FIG. 11.
Figure 61:
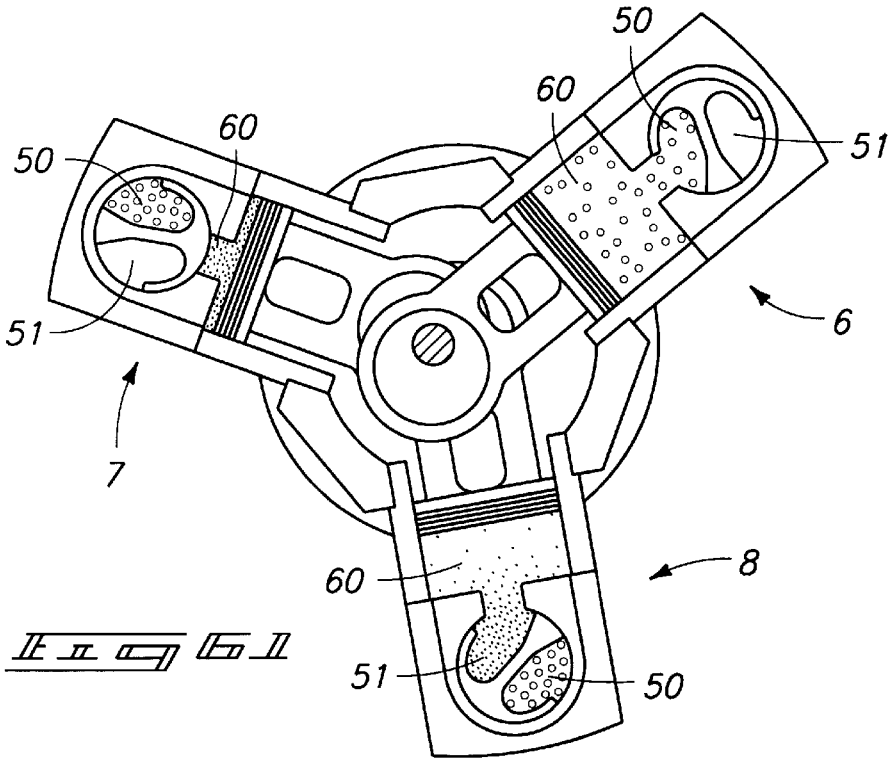
FIG. 61 is 500 degrees clockwise from FIG. 11.
Figure 62:
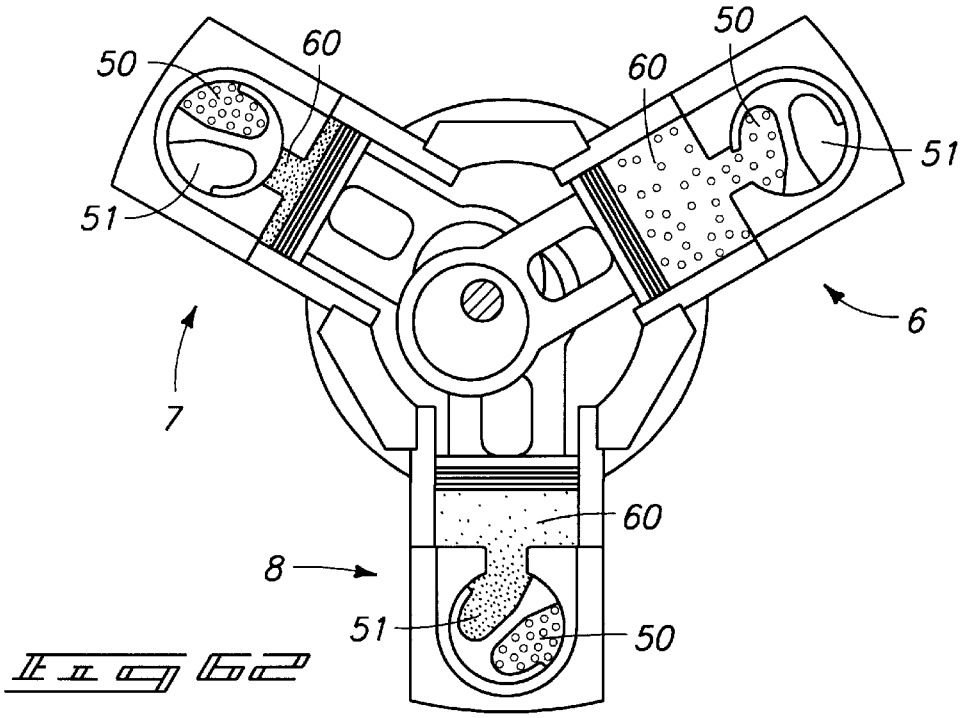
FIG. 62 is 510 degrees clockwise from FIG. 11.
Figure 63:
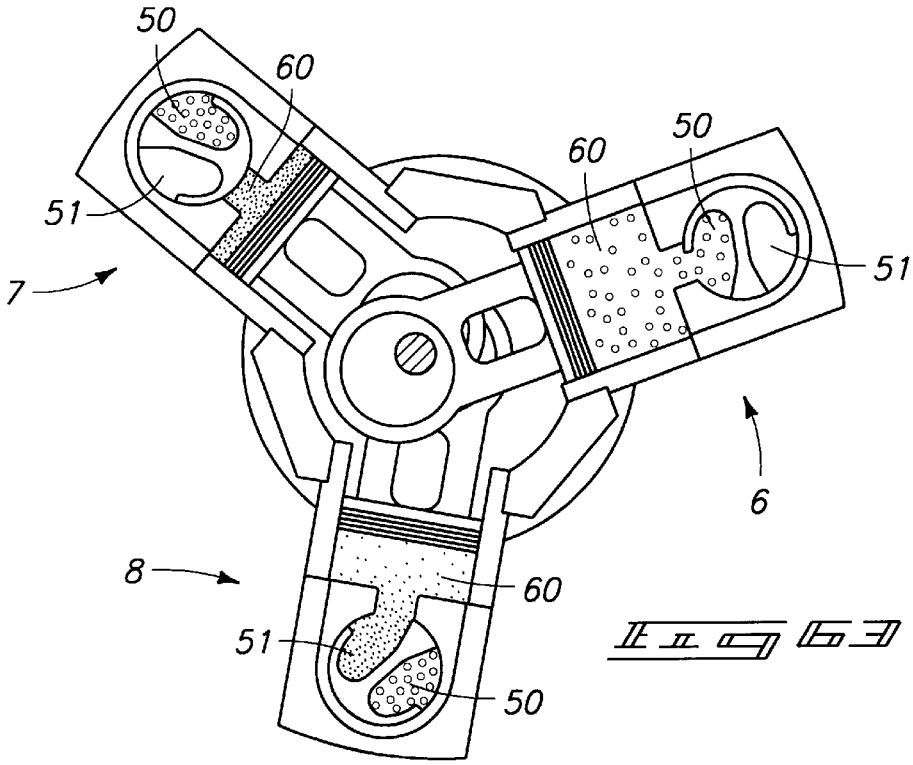
FIG. 63 is 520 degrees clockwise from FIG. 11.
Figure 64:
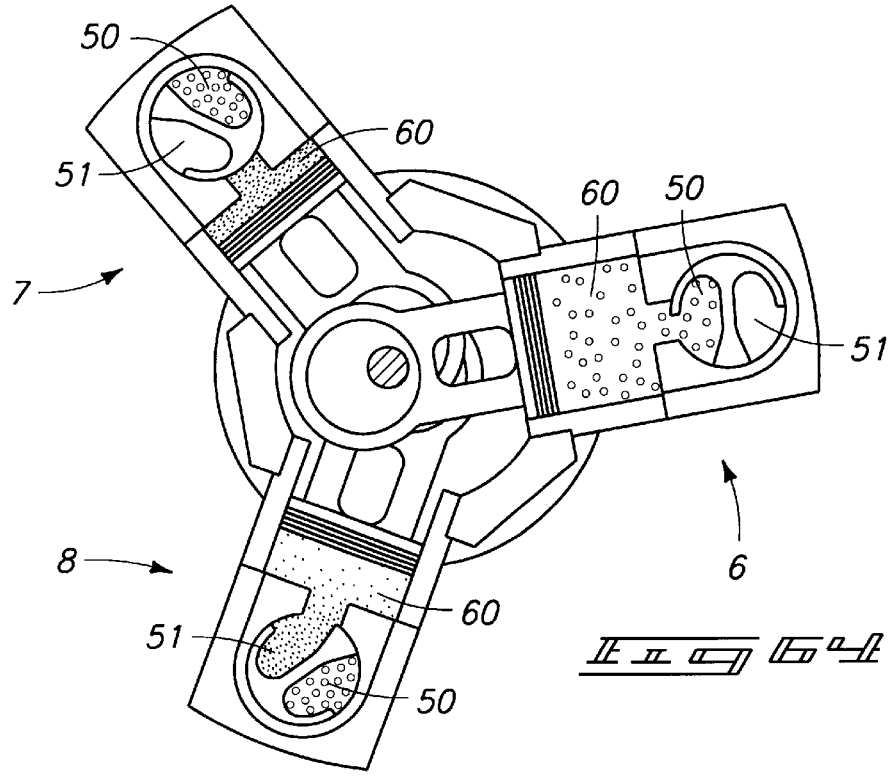
FIG. 64 is 530 degrees clockwise from FIG. 11.
Figure 65:
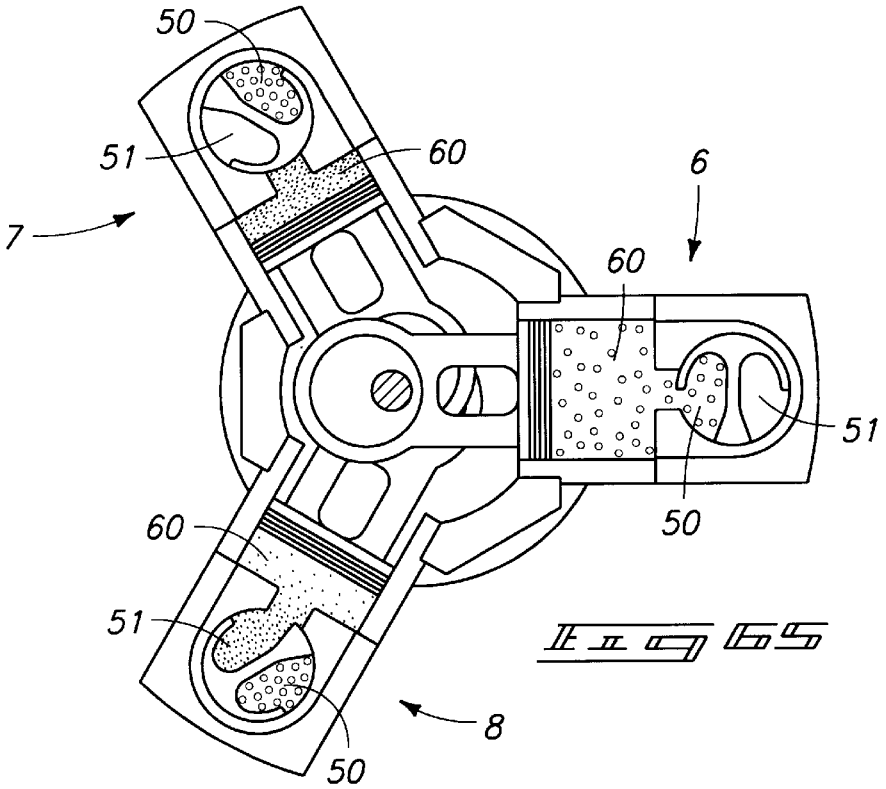
FIG. 65 is 540 degrees clockwise from FIG. 11.
Figure 66:
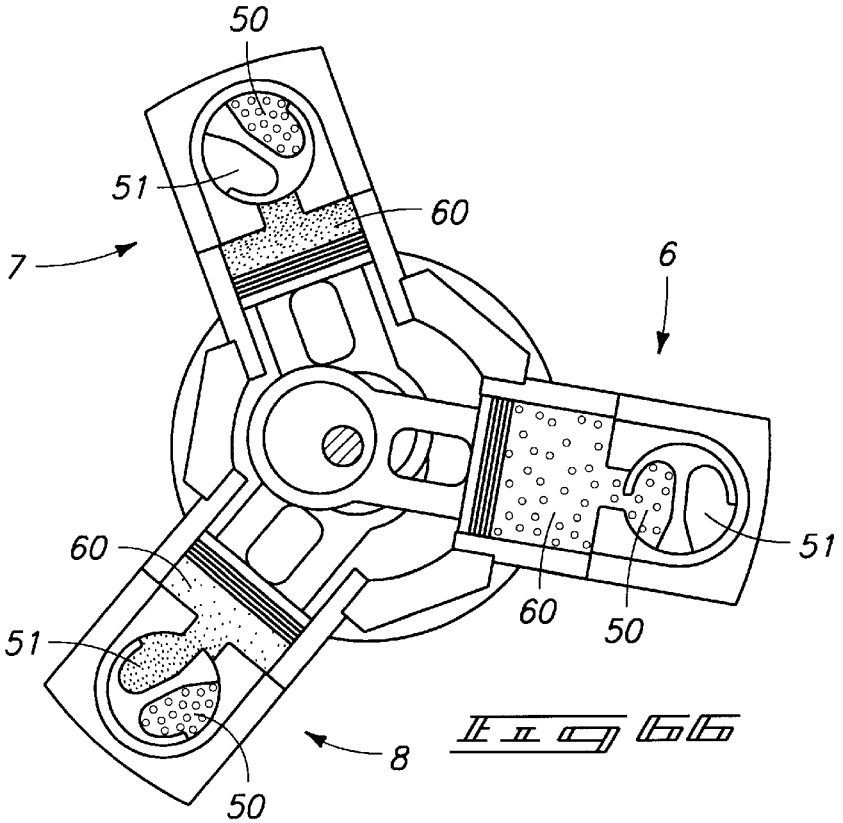
FIG. 66 is 550 degrees clockwise from FIG. 11.
Figure 67:
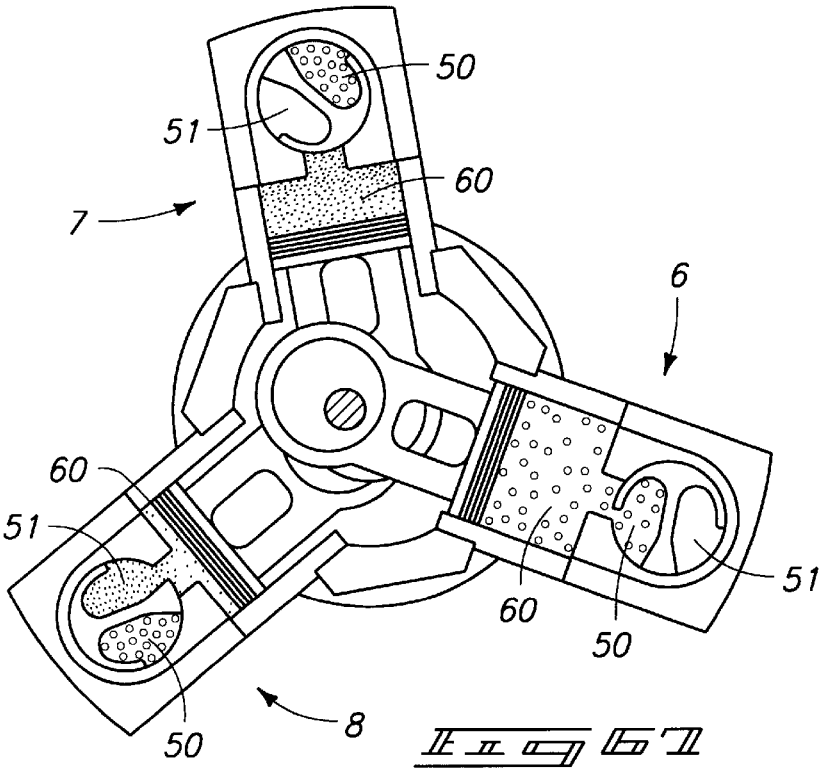
FIG. 67 is 560 degrees clockwise from FIG. 11.
Figure 68:
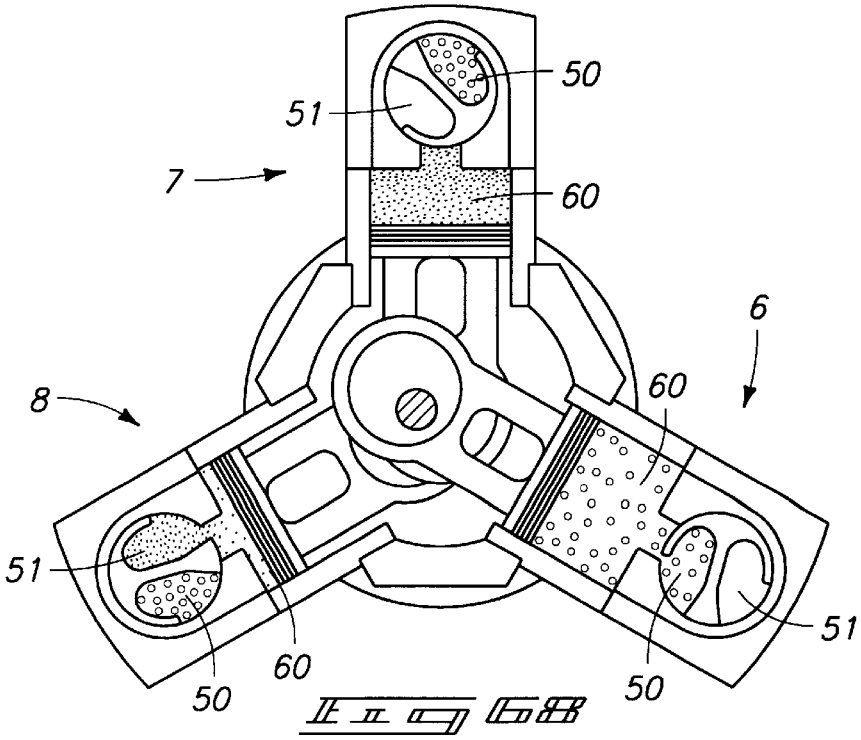
FIG. 68 is 570 degrees clockwise from FIG. 11.
Figure 69:
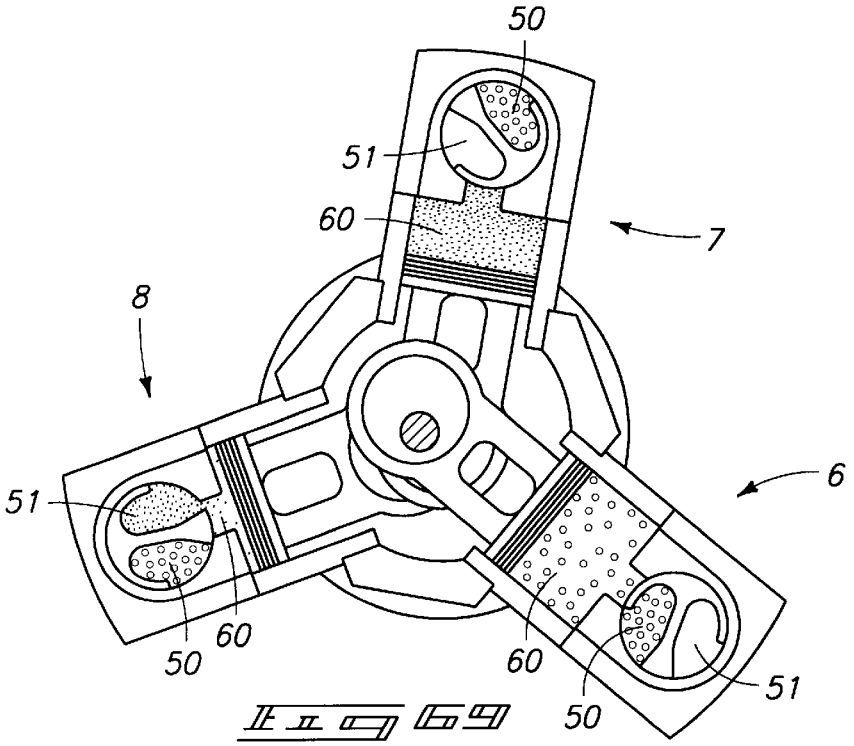
FIG. 69 is 580 degrees clockwise from FIG. 11.
Figure 70:
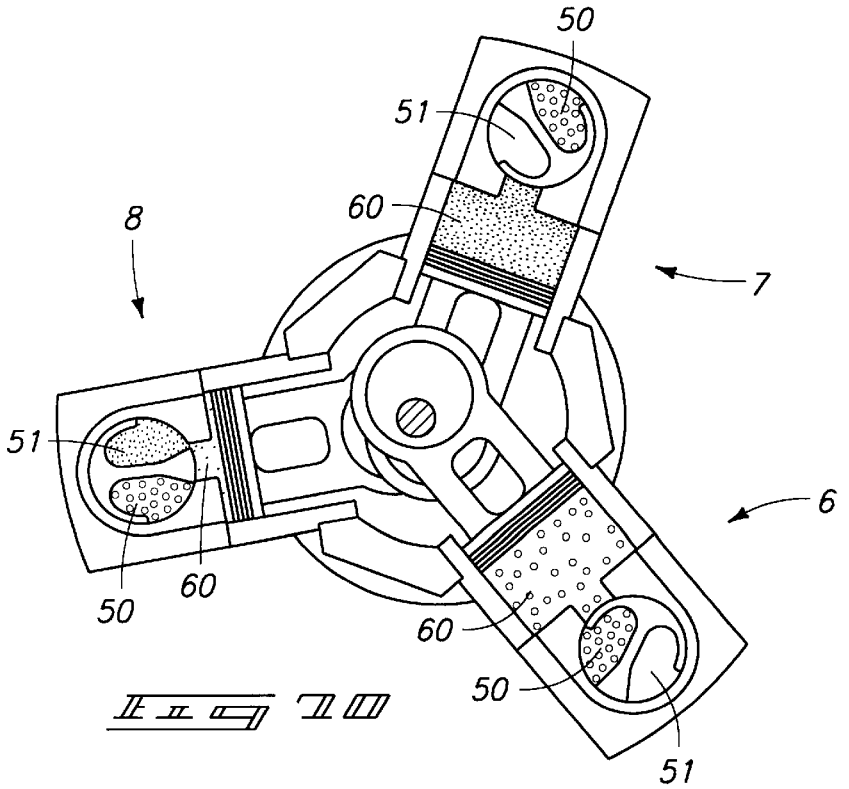
FIG. 70 is 590 degrees clockwise from FIG. 11.
Figure 11:
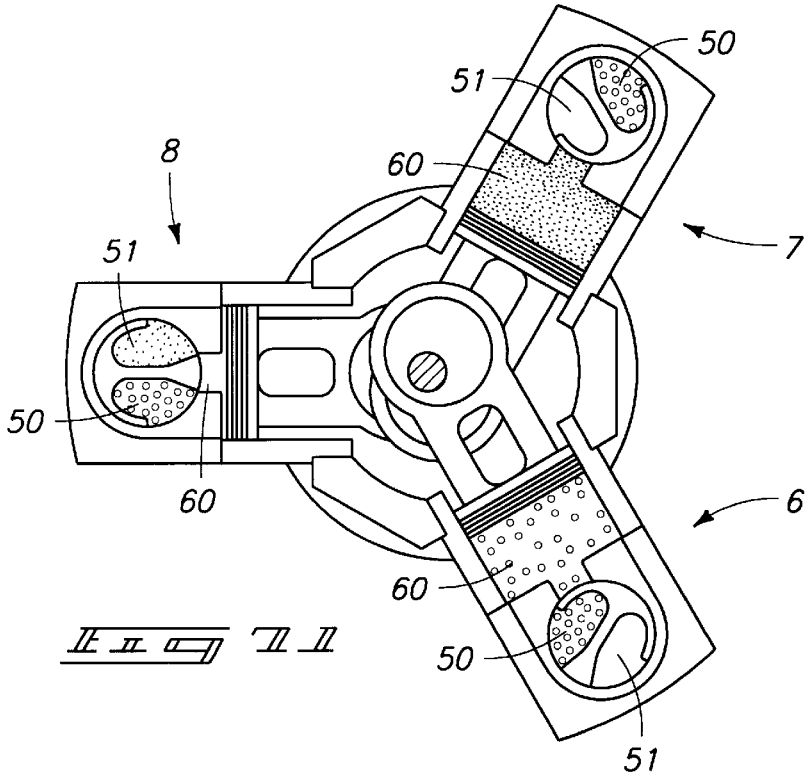
Figure 12:
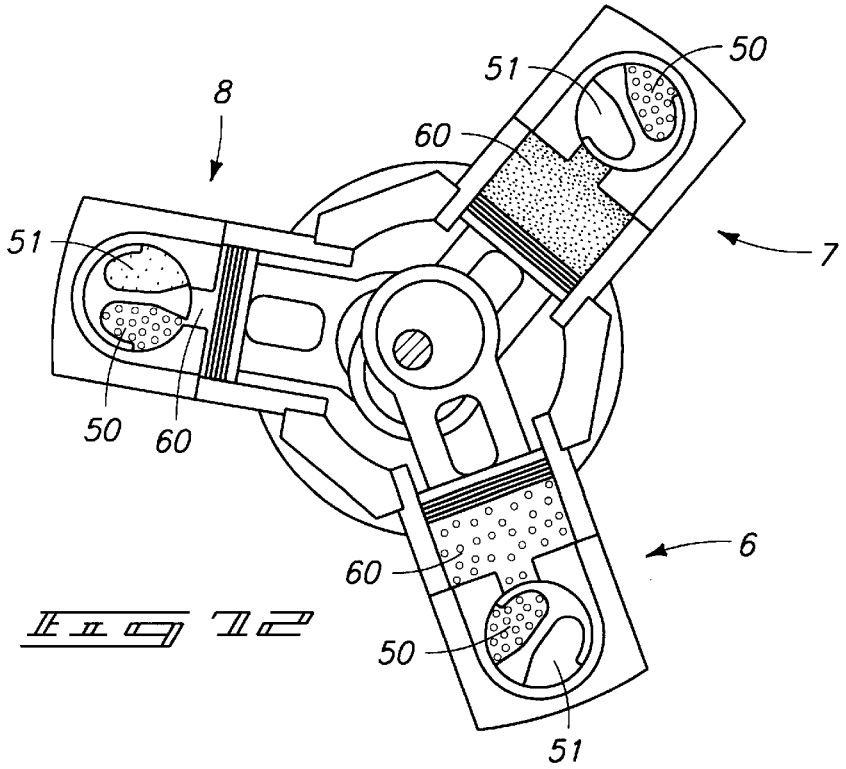
Figure 73:
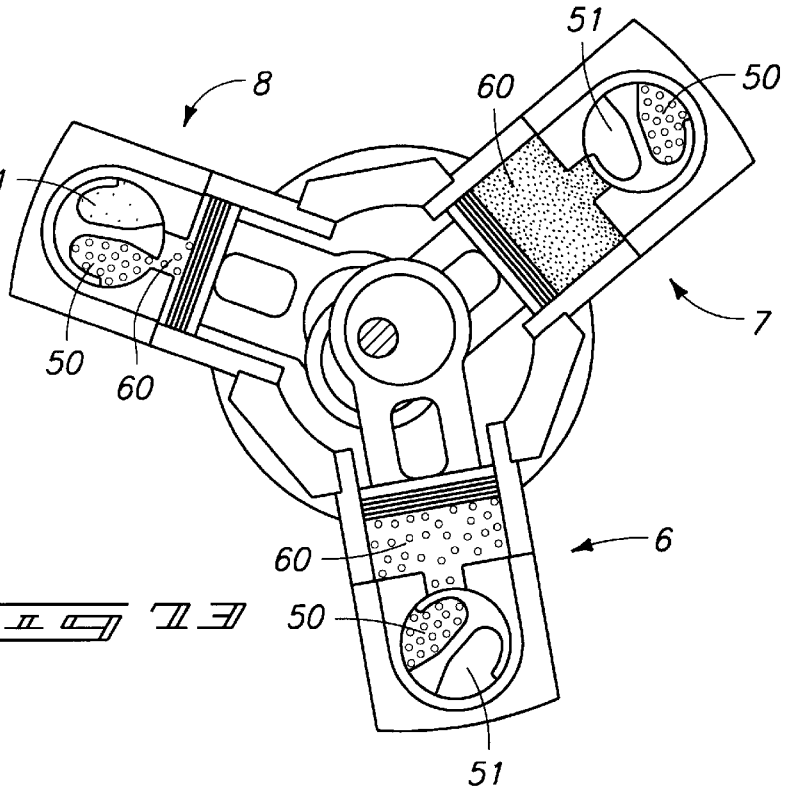
FIG. 73 is 620 degrees clockwise from FIG. 11.
Figure 74:
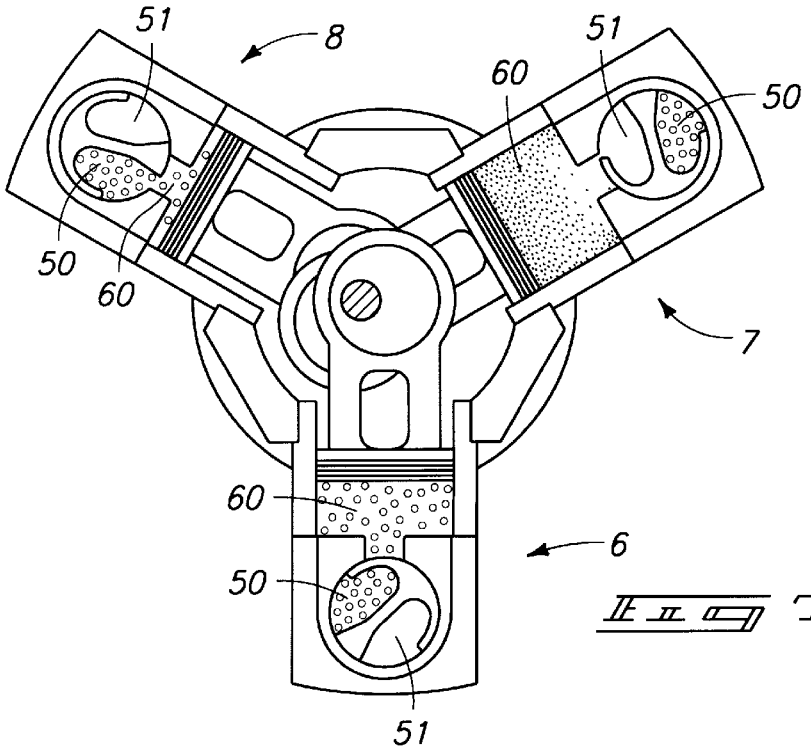
FIG. 74 is 630 degrees clockwise from FIG. 11.
Figure 15:
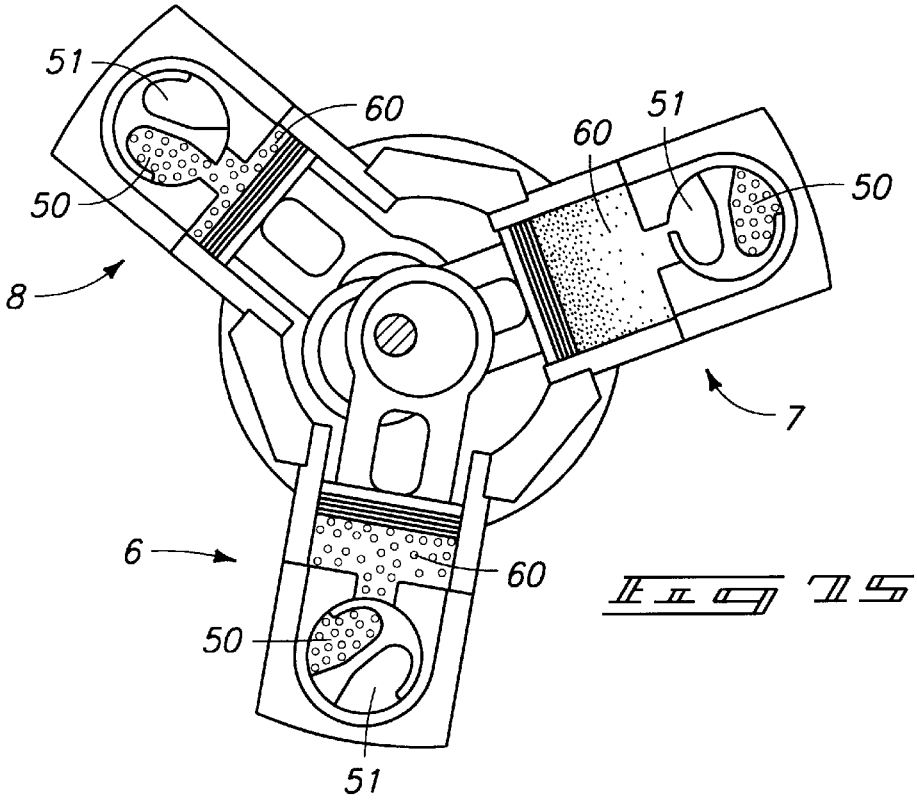
Figure 16:
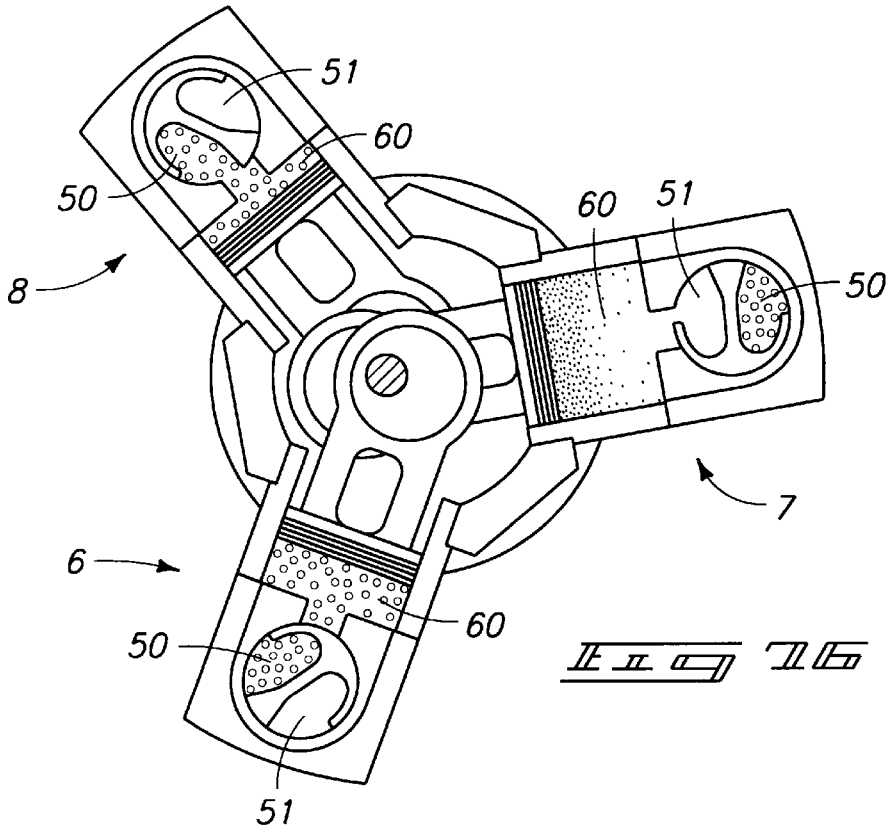
Figure 77:
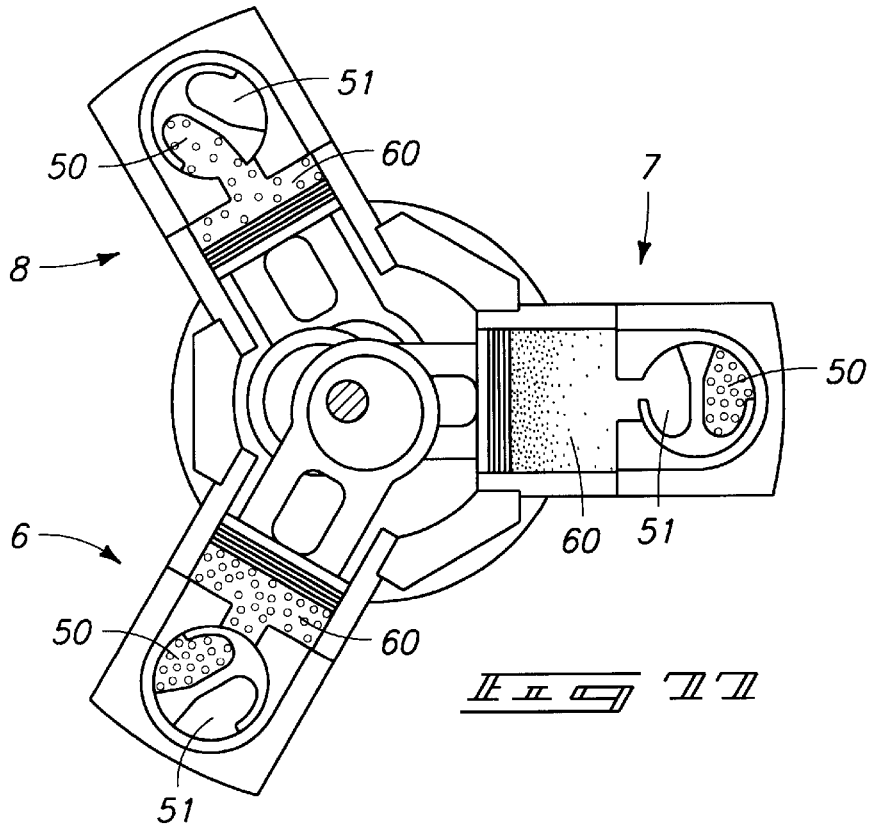
FIG. 77 is 660 degrees clockwise from FIG. 11.
Figure 78:
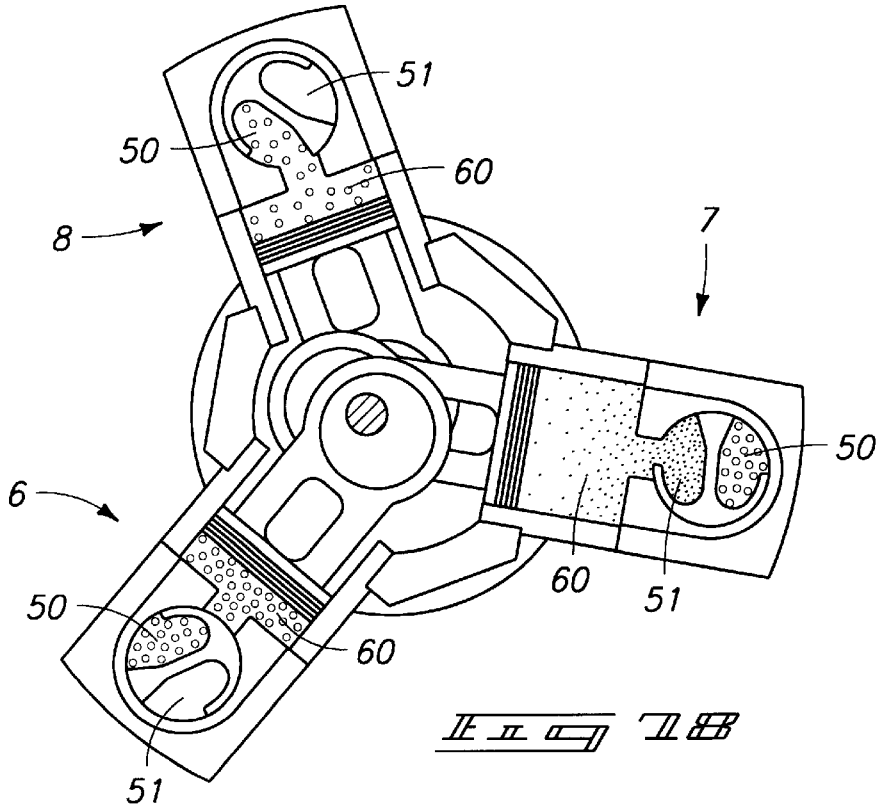
FIG. 78 is 670 degrees clockwise from FIG. 11.
Figure 79:
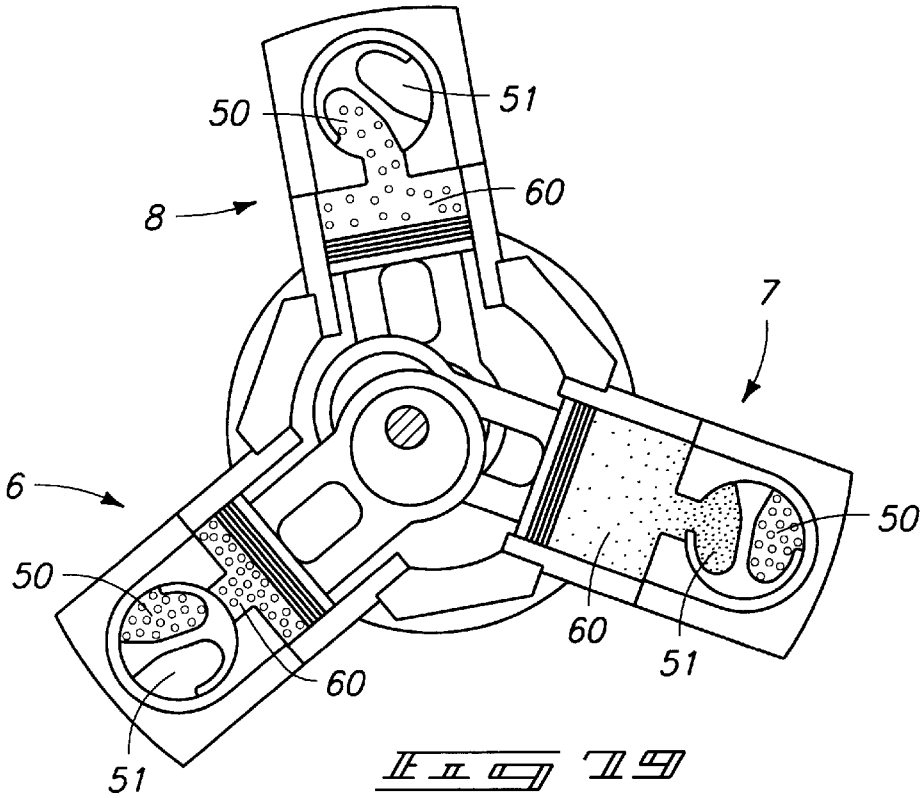
FIG. 79 is 680 degrees clockwise from FIG. 11.
Figure 80:
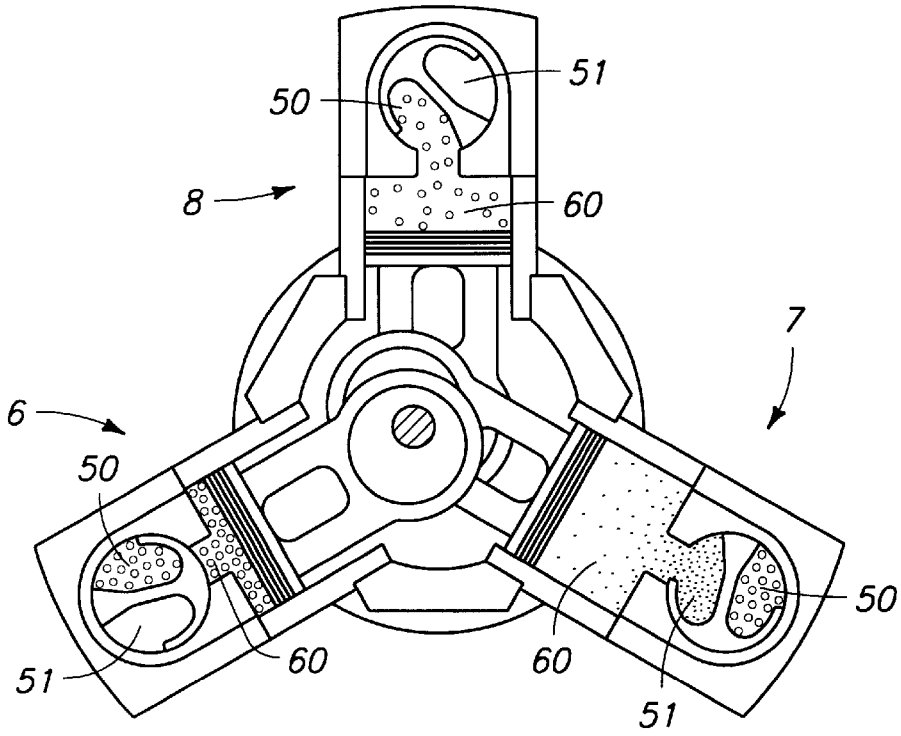
FIG. 80 is 690 degrees clockwise from FIG. 11.
Figure 81:
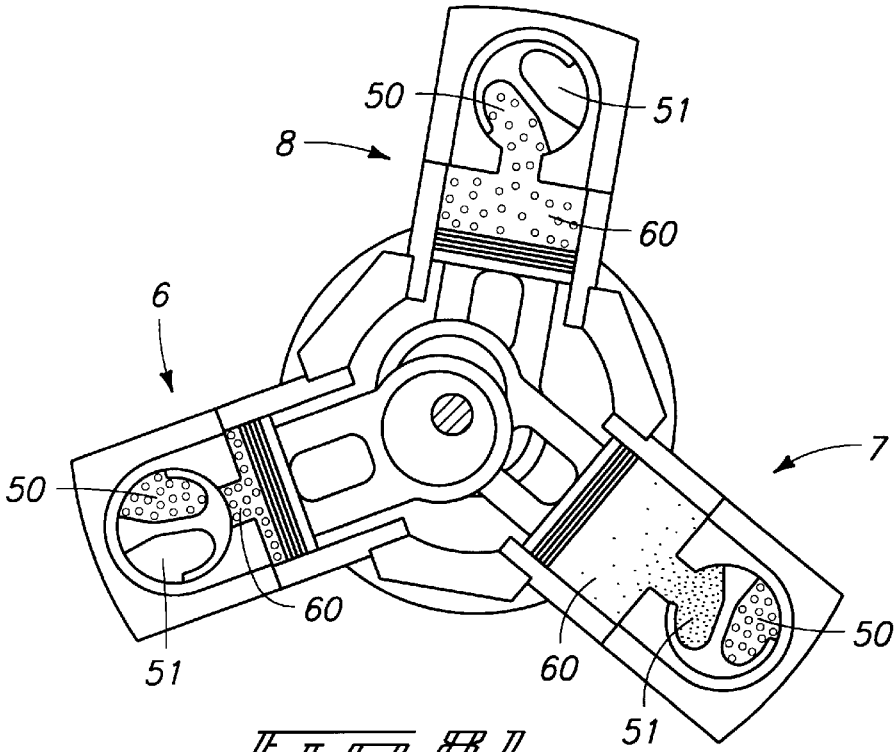
FIG. 81 is 700 degrees clockwise from FIG. 11.

FIG. 35 illustrates a spark or ignition within cylinder assembly 8 and FIG. 59 illustrates a spark or ignition within cylinder assembly 7. The same cycle or sequence would occur with each of the respective cylinder assemblies 6, 7 and 8, however they begin at different times in the overall cycle or sequence of the engine, as illustrated.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A self-sealing valve and cylinder combination for use in an engine, pump or compressor, comprising:

a valve housing;

a valve mounted within the valve housing;

an open cylinder comprising a proximal open end and a transverse terminal end having a transfer port formed through it adjacent to the valve; and a piston movably mounted within the cylinder;

whereby an increase in pressure occurring within the cylinder between the piston and the terminal end of the cylinder imparts a force on the cylinder to cause relative motion of the terminal wall of the cylinder toward and against the valve and thereby creates an effective seal between them.

2. The self-sealing valve and cylinder combination of claim 1 in which the valve includes an intake port and an exhaust port alternately in communication with the transfer port of the cylinder.

3. The self-sealing valve and cylinder combination of claim 1, wherein the valve is a cylindrical valve rotatably mounted within the valve housing.

4. The self-sealing valve and cylinder combination of claim 1, wherein the valve is a cylindrical valve rotatably mounted within the valve housing;

the valve having two ports open about its circumference and leading respectively to opposed axial ends of the valve;

the opposed axial ends of the valve being adapted to be in communication with an intake manifold and an exhaust manifold, respectively.

5. A self-sealing valve and cylinder combination in an engine, pump or compressor, comprising:

a central housing having at least one cylinder aperture;

a valve housing corresponding to each cylinder aperture in the central housing, each valve housing being spaced outwardly from a cylinder aperture and attached to the central housing;

at least one valve mounted within each valve housing;

individual cylinders mounted respectively within each cylinder aperture for motion relative to a corresponding valve;

each cylinder comprising a proximal end open to the central housing, and a transverse terminal end having a transfer port formed through it; and a piston movably mounted within each cylinder;

whereby an increase in pressure occurring within a cylinder between a piston and the terminal end of the cylinder imparts a force on the cylinder to cause relative motion between the terminal wall of the cylinder and the corresponding valve and thereby creates an effective seal between them.

6. The self-sealing valve and cylinder combination of claim 5 in which the valve includes an intake port and an exhaust port alternately in communication with the transfer port of the corresponding cylinder.

7. The self-sealing valve and cylinder combination of claim 5 in which the valve housing is fixed relative to the central housing.

8. The self-sealing valve and cylinder combination of claim 5 in which the valve housing is fixed relative to the central housing by a plurality of interconnecting mounts surrounding a cylinder;

the cylinder being slidably mounted for motion relative to both the valve housing and the central housing.

9. The self-sealing valve and cylinder combination of claim 5, wherein the valve is a cylindrical valve rotatably mounted within the valve housing about an axis that is parallel to a center axis of the central housing.

10. The self-sealing valve and cylinder combination of claim 5, wherein the valve is a cylindrical valve rotatably mounted within the valve housing about an axis that is parallel to a center axis of the central housing;

the valve having two ports open about its circumference and leading respectively to opposed axial ends of the valve;

the opposed axial ends of the valve being in communication with an intake manifold and an exhaust manifold, respectively.

11. A rotary engine, pump or compressor, comprising:

a stationary base;

a housing rotatably mounted about a first axis on the base;

at least one rotary valve mounted for rotational motion relative to the housing about a second axis spaced from and parallel to the first axis;

a stationary timing gear centered about the first axis on the base;

a rotary valve sprocket fixed to each rotary valve; and a timing chain entrained about both the timing gear and rotary valve sprocket for imparting rotational motion to the rotary valve about the second axis in response to rotation of the housing about the first axis.

12. The rotary engine, pump or compressor of claim 11, wherein the valve is a cylindrical valve rotatably mounted within a valve housing fixed relative to the housing.

13. The rotary engine, pump or compressor of claim 11, wherein the valve is a cylindrical valve rotatably mounted within a valve housing fixed relative to the housing, a cylinder mounted inwardly from each valve;

each cylinder comprising a proximal end open to the central housing, and a transverse terminal end having a transfer port formed through it; and a piston movably mounted within each cylinder.

14. The rotary engine, pump or compressor of claim 11, wherein the valve is a cylindrical valve rotatably mounted within a valve housing;

the valve having two ports open about its circumference and leading respectively to opposed axial ends of the valve;

the opposed axial ends being in communication with an intake manifold and an exhaust manifold, respectively.

15. A rotary engine, pump or compressor, comprising:

a stationary base;

a housing rotatably mounted about a first axis on the base;

the housing including a plurality of radial cylinder apertures arranged perpendicularly to the first axis and spaced equiangularly about the first axis;

a straight crank shaft located within the central housing, the crank shaft being mounted on the base for rotational motion about an eccentric axis that is spaced from and parallel to the first axis;

a plurality of valve housings corresponding in number to the number of cylinder apertures in the central housing, each valve housing being mounted to the central housing outwardly of a cylinder aperture;

a rotary valve mounted within each valve housing, each rotary valve being mounted for rotational motion relative to the housing about a second axis spaced from and parallel to the first axis;

a cylinder mounted on the central housing between each cylinder aperture and its corresponding valve housing, each cylinder being relatively movable in relation to the valve mounted within the valve housing;

each cylinder comprising a proximal end open to the central housing and a terminal end having a transfer port openly facing a valve;

a plurality of pistons individually mounted within the respective cylinders, the pistons being mounted in relative reciprocating relation within the cylinders, each piston comprising a piston head with a piston face and a corresponding piston rod having a first end and a second end, the first end of each piston being eccentrically mounted to the crank shaft and its second end being mounted to the piston head.

16. The rotary engine, pump or compressor of claim 15, wherein each piston rod is symmetrically arranged across the center of the piston head;

both the cylinder apertures and the eccentric mounts of the piston rods and crank shaft being axially offset from one another along the first axis.

17. The rotary engine, pump or compressor of claim 15, wherein each piston rod is perpendicularly fixed to its corresponding piston head;

each piston rod having a cylindrical aperture formed through it;

a plurality of cylindrical eccentrics fixed to the crank shaft and corresponding to the respective piston rods, each eccentric being movably engaged within a surrounding cylindrical aperture of a piston rod to maintain the piston rod properly aligned relative to its cylinder.

18. A rotary internal combustion engine according to claim 15, wherein each piston head includes an orifice; and a spark plug mounted on each piston with a spark-producing end of the spark plug being in communication with a space between the piston face and the terminal end of the cylinder in which the piston is mounted.

19. The rotary engine, pump or compressor of claim 15, in which each valve includes an intake port and an exhaust port alternately in communication with the transfer port of its corresponding cylinder.

20. The rotary engine, pump or compressor of claim 15, wherein each valve has two ports open about its circumference and leading respectively to opposed axial ends of the valve;

the opposed axial ends of each valve being in communication with an intake manifold and an exhaust manifold, respectively.

21. The rotary engine, pump or compressor of claim 15 in which each valve housing is fixed relative to the housing.

22. The rotary engine, pump or compressor of claim 15 in which each valve housing is fixed relative to the housing by a plurality of interconnecting mounts surrounding its corresponding cylinder;

the cylinder being slidably mounted relative to both the valve housing and the central housing for reciprocation of the cylinder relative to them.

23. The rotary engine, pump or compressor of claim 15 in which each valve housing is fixed relative to the housing by a plurality of interconnecting mounts surrounding its corresponding cylinder;

the cylinder being slidably mounted relative to both the valve housing and the central housing for reciprocation of the cylinder relative to them, whereby an increase in pressure occurring within a cylinder between a piston and the terminal end of the cylinder imparts a force on the cylinder to cause relative motion between the terminal wall of the cylinder and the corresponding valve and thereby creates an effective seal between them.

24. The rotary engine, pump or compressor of claim 15, further comprising:

a rotary valve sprocket fixed to each rotary valve;

a timing gear mount within the central housing, the timing gear mount being concentrically positioned about the first axis in non-rotational relation to the engine base;

a plurality of timing gears fixed to the timing pulley mount, the number of timing gears corresponding to the number of rotary valves; and a timing chain entrained about each timing gear and a corresponding rotary valve sprocket for imparting rotational motion to the rotary valves about the second axis in response to rotation of the housing about the first axis.

25. The rotary engine, pump or compressor of claim 15, wherein the straight crank shaft is rotatably supported about its eccentric axis by spaced bearings located on the timing gear mount and on the base, respectively.

26. The rotary engine, pump or compressor of claim 15, wherein the timing gear mount and the crank shaft are arranged within the housing in an end-to-end relationship, one end of the crankshaft being rotatably mounted by bearings located at an adjacent end of the timing gear mount and the remaining end of the crankshaft being rotatably mounted by bearings located on the base.

27. The rotary engine, pump or compressor of claim 15, wherein the crank shaft and the housing are movably interconnected by a gear train to synchronize their rotation.

28. The rotary engine, pump or compressor of claim 15, wherein each piston rod is perpendicularly fixed to its corresponding piston head.

* * * * *